US009746268B2

(12) United States Patent
Antell

(10) Patent No.: US 9,746,268 B2
(45) Date of Patent: Aug. 29, 2017

(54) SHOOTING RESTS AND POLE ASSEMBLIES

(71) Applicant: Allan W. Antell, Scottsdale, AZ (US)

(72) Inventor: Allan W. Antell, Scottsdale, AZ (US)

( * ) Notice: Subject to any disclaimer, the term of this patent is extended or adjusted under 35 U.S.C. 154(b) by 0 days.

(21) Appl. No.: 14/722,858

(22) Filed: May 27, 2015

(65) Prior Publication Data

US 2016/0018180 A1 Jan. 21, 2016

Related U.S. Application Data

(63) Continuation-in-part of application No. 14/078,826, filed on Nov. 13, 2013, now Pat. No. 9,200,859.

(60) Provisional application No. 61/725,587, filed on Nov. 13, 2012, provisional application No. 61/750,411, filed on Jan. 9, 2013.

(51) Int. Cl.

| | |
|---|---|
| ***F41A 23/00*** | (2006.01) |
| ***F41A 23/10*** | (2006.01) |
| ***A47C 4/28*** | (2006.01) |
| ***F16B 7/10*** | (2006.01) |
| ***F41A 23/18*** | (2006.01) |
| *F41A 23/16* | (2006.01) |

(52) U.S. Cl.

CPC ..... *F41A 23/10* (2013.01); *F41A 23/18* (2013.01); *F41A 23/16* (2013.01)

(58) Field of Classification Search

CPC ..... F41A 23/10; F41A 23/08; F41A 23/16; F41A 23/12

USPC .... 248/164, 166, 170, 431, 440.1, 136, 137, 248/188, 229.2, 218.4; 42/94; 89/37.01, 89/37.03, 37.04

See application file for complete search history.

(56) References Cited

U.S. PATENT DOCUMENTS

| | | | | |
|---|---|---|---|---|
| 3,898,714 | A | 8/1975 | McFadden | |
| 5,311,693 | A | 5/1994 | Underwood | |
| 5,317,826 | A | 6/1994 | Underwood | |
| 5,332,184 | A | 7/1994 | Davis | |
| 5,377,437 | A | 1/1995 | Underwood | |
| 5,406,732 | A | 4/1995 | Peterson | |
| 5,452,872 | A * | 9/1995 | Barnes | B05B 15/062 248/168 |
| D390,301 | S | 2/1998 | Peterson | |
| 5,884,881 | A | 3/1999 | Band | |
| 5,930,932 | A | 8/1999 | Peterson | |
| 6,505,429 | B2 | 1/2003 | Percival | |
| D473,280 | S | 4/2003 | Briggs | |
| 6,663,071 | B2 | 12/2003 | Peterson | |

(Continued)

*Primary Examiner* — Tan Le

(74) *Attorney, Agent, or Firm* — Michael W. Goltry; Robert A. Parsons; Parsons & Goltry

(57) ABSTRACT

A pole assembly includes a slide mounted reciprocally to a pole. The slide includes an upper extremity, a lower extremity, and a handle between the upper extremity and the lower extremity. First and second jaws are mounted reciprocally to the slide between gripping positions for gripping the pole therebetween and released positions for releasing the pole therebetween. The slide is disabled from moving reciprocally relative to the pole, in the gripping positions of the first and second jaws. The slide is enabled for moving reciprocally relative to the pole, in the released positions of the first and second jaws. Each of the first and second jaws reciprocates obliquely relative to the pole from the released position away from the pole and the upper extremity of the slide, and the gripping position toward the pole and the upper extremity of the slide.

20 Claims, 62 Drawing Sheets

(56) References Cited

U.S. PATENT DOCUMENTS

| | | | | |
|---|---|---|---|---|
| 6,889,465 | B1 | 5/2005 | Holmes | |
| 7,909,301 | B2 * | 3/2011 | Faifer | F16M 11/04 248/166 |
| 7,946,070 | B1 | 5/2011 | Elhart | |
| 7,966,757 | B2 * | 6/2011 | Hyung-Chul | G09F 11/30 160/329 |
| 9,200,859 | B2 * | 12/2015 | Antell | F41A 23/10 |
| 2006/0249641 | A1 * | 11/2006 | Bally | A61G 7/05 248/229.2 |
| 2008/0095573 | A1 * | 4/2008 | Hewett | E04H 15/06 403/190 |

* cited by examiner 376
372
371
377
372
376
371
377
372
376
371
377
372
376

392
390
401A
401B
400
393
394
405
407
401
405
402
361
391

SHOOTING RESTS AND POLE ASSEMBLIES

FIELD OF THE INVENTION

The present invention relates to shooting rests used to receive firearms for shooting stabilization purposes to facilitate shooting accuracy.

BACKGROUND OF THE INVENTION

Shooting is the act of firing firearms, such as rifles, shotguns, and handguns. Shooting can take place in an indoor shooting range, an outdoor shooting range, in the field for hunting, and in warfare. To assist with aiming, skilled artisans have developed a variety of shooting rests used by marksmen to rest and stabilize their firearms for improving accuracy, especially long-range accuracy. Of particular significance is the bipod, which is a form of shooting rest commonly used with rifles and machine guns to provide a forward rest and to reduce motion. Some bipods are attached directly to the firearm, while others are a separate, stand-alone, two-legged support having a rest upon which a firearm is to be rested for shooting. As for the latter, such stand-alone bipods are positioned on the ground or other terrain and the marksman rests his firearm on the bipod rest to reduce fatigue and to increase stability and accuracy in shooting. Unfortunately, attempts to produce a bipod that is easily adjustable for holding the legs in selected angular relationships and at selected locations along the lengths of the legs for providing a shooting with the ability to shoot from standing, kneeling, and sitting positions, and for accommodate uneven terrain, have resulted in both complex and rudimentary bipod structures with results that are not entirely satisfactory.

SUMMARY OF THE INVENTION

According to the principle of the invention, a shooting rest includes a gun rest assembly, and first and second poles each having an upper end, a lower end, and a length therebetween. The gun rest assembly is for holding the first and second poles in selected angular relationships and at selected locations along the lengths of the first and second poles, and includes a swivel connecting a first rest component mounted to the first pole for reciprocal movement along the length thereof, and a second rest component mounted to the second pole for reciprocal movement along the length thereof. A first clamp assembly is carried by the first rest component. The first clamp assembly is movable between a clamped position restricting reciprocal movement of the first rest component along the length of the first pole, and an unclamped position permitting reciprocal movement of the first rest component along the length of the first pole. A second clamp assembly is carried by the second rest component. The second clamp assembly is movable between a clamped position restricting reciprocal movement of the second rest component along the length of the second pole, and an unclamped position permitting reciprocal movement of the second rest component along the length of the second pole. The first and second clamp assemblies are each independently movable between their respective clamped and unclamped positions. The first clamp assembly includes a pair of first jaws mounted to the first rest component on either side of the first pole for movement between clamped positions, defining the clamped position of the first clamp, clamping the first pole therebetween so as to restrict reciprocal movement of the first rest component along the length of the first pole, and unclamped positions, defining the unclamped position of the first clamp, releasing the first pole therebetween so as to permit reciprocal movement of the first rest component along the length of the first pole. The second clamp assembly includes a pair of second jaws mounted to the second rest component on either side of the second pole for movement between clamped positions, defining the clamped position of the second clamp, clamping the second pole therebetween so as to restrict reciprocal movement of the second rest component along the length of the second pole, and unclamped positions, defining the unclamped position of the second clamp, releasing the second pole therebetween so as to permit reciprocal movement of the second rest component along the length of the second pole. A first spring is coupled between the first rest component and each of the first jaws urging the first jaws into the clamped positions away from the unclamped positions. A second spring is coupled between the second rest component and each of the second jaws urging the second jaws into the clamped positions away from the unclamped positions. A first member is mounted to the first rest component for movement between first and second positions. Movement of the first member from the first position to the second position with a force sufficient to overcome the first springs urges corresponding movement of the first jaws from the clamped positions to the unclamped positions, and movement of the first member from the second position to the first position urges corresponding movement of the first jaws from the unclamped positions to the clamped positions via the first springs. A second member is mounted to the second rest component for movement between first and second positions. Movement of the second member from the first position to the second position with a force sufficient to overcome the second springs urges corresponding movement of the second jaws from the clamped positions to the unclamped positions, and movement of the second member from the second position to the first position urges corresponding movement of the second jaws from the unclamped positions to the clamped positions via the second springs.

According to the principle of the invention, a shooting rest includes a gun rest assembly, and first and second poles each having an upper end, a lower end, and a length therebetween. The gun rest assembly is for holding the first and second poles in selected angular relationships and at selected locations along the lengths of the first and second poles. The gun rest assembly includes a swivel connecting a first rest component mounted to the first pole for reciprocal movement along the length thereof, and a second rest component mounted to the second pole for reciprocal movement along the length thereof. There is a first clamp assembly within the first rest component, and a second clamp assembly within the second rest component. The first clamp assembly is movable between a clamped position restricting reciprocal movement of the first rest component along the length of the first pole, and an unclamped position permitting reciprocal movement of the first rest component along the length of the first pole. The second clamp assembly is movable between a clamped position restricting reciprocal movement of the second rest component along the length of the second pole, and an unclamped position permitting reciprocal movement of the second rest component along the length of the second pole. The first and second clamp assemblies are each independently movable between their respective clamped and unclamped positions. The first clamp assembly includes a pair of first jaws mounted within the first rest component on either side of the first pole for movement between clamped positions, defining the clamped position of the first clamp, clamping the first pole therebetween so as to restrict reciprocal movement of the first rest component along the length of the first pole, and unclamped positions, defining the unclamped position of the first clamp, releasing the first pole therebetween so as to permit reciprocal movement of the first rest component along the length of the first pole. The second clamp assembly includes a pair of second jaws mounted within the second rest component on either side of the second pole for movement between clamped positions, defining the clamped position of the second clamp, clamping the second pole therebetween so as to restrict reciprocal movement of the second rest component along the length of the second pole, and unclamped positions, defining the unclamped position of the second clamp, releasing the second pole therebetween so as to permit reciprocal movement of the second rest component along the length of the second pole. There is a first spring, within the first rest component, coupled between the first rest component and each of the first jaws urging the first jaws into the clamped positions away from the unclamped positions. There is a second spring, within the second rest component, coupled between the second rest component and each of the second jaws urging the second jaws into the clamped positions away from the unclamped positions. A first member, extending into the first rest component, is mounted to the first rest component for movement between first and second positions. Movement of the first member from the first position to the second position with a force sufficient to overcome the first springs urges corresponding movement of the first jaws from the clamped positions to the unclamped positions, and movement of the first member from the second position to the first position urges corresponding movement of the first jaws from the unclamped positions to the clamped positions via the first springs. A second member, extending into the second rest component, is mounted to the second rest component for movement between first and second positions. Movement of the second member from the first position to the second position with a force sufficient to overcome the second springs urges corresponding movement of the second jaws from the clamped positions to the unclamped positions, and movement of the second member from the second position to the first position urges corresponding movement of the second jaws from the unclamped positions to the clamped positions via the second springs.

According to the principle of the invention, a shooting rest includes a gun rest assembly, and first and second poles each having an upper end, a lower end, and a length therebetween. The gun rest assembly is for holding the first and second poles in selected angular relationships and at selected locations along the lengths of the first and second poles. The gun rest assembly includes a swivel connecting a first rest component to a second rest component. The first pole is received slidably through the first rest component. The second pole is received slidably through the second rest component. There is a first cavity in the first rest component, and a second cavity in the second rest component. The first pole extends through the first cavity of the first rest component, and the second pole extends through the second cavity of the second rest component. A first clamp assembly is within the first cavity of the first rest component, and a second clamp assembly is within the second cavity of the second rest component. The first clamp assembly is movable between a clamped position restricting sliding movement of the first pole through the first rest component, and an unclamped position permitting sliding movement of the first pole through the first rest component. The second clamp assembly is movable between a clamped position restricting reciprocal movement of the second rest component along the length of the second pole, and an unclamped position permitting reciprocal movement of the second rest component along the length of the second pole. The first and second clamp assemblies are each independently movable between their respective clamped and unclamped positions. The first clamp assembly includes a pair of first jaws mounted within the first cavity on either side of the first pole for movement between clamped positions, defining the clamped position of the first clamp, clamping the first pole therebetween so as to restrict sliding movement of the first pole through the first rest component, and unclamped positions, defining the unclamped position of the first clamp, releasing the first pole therebetween so as to permit sliding movement of the first pole through the first rest component. The second clamp assembly includes a pair of second jaws mounted within the second cavity on either side of the second pole for movement between clamped positions, defining the clamped position of the second clamp, clamping the second pole therebetween so as to restrict sliding movement of the second pole through the second rest component, and unclamped positions, defining the unclamped position of the second clamp, releasing the second pole therebetween so as to permit sliding movement of the second pole through the second rest component. There is a first spring, enclosed within the first cavity, coupled between the first rest component and each of the first jaws urging the first jaws into the clamped positions away from the unclamped positions. There is a second spring, enclosed within the second cavity, coupled between the second rest component and each of the second jaws urging the second jaws into the clamped positions away from the unclamped positions. A first member, extending into the first cavity, is mounted to the first rest component for movement between first and second positions. There is a first operative coupling, enclosed within the first cavity, between the first member and the first jaws, whereby movement of the first member from the first position to the second position with a force sufficient to overcome the first springs urges corresponding movement of the first jaws from the clamped positions to the unclamped positions, and movement of the first member from the second position to the first position urges corresponding movement of the first jaws from the unclamped positions to the clamped positions via the first springs. A second member, extending into the second cavity, is mounted to the second rest component for movement between first and second positions. There is a second operative coupling, enclosed within the second cavity, between the second member and the second jaws, whereby movement of the second member from the first position to the second position with a force sufficient to overcome the second springs urges corresponding movement of the second jaws from the clamped positions to the unclamped positions, and movement of the second member from the second position to the first position urges corresponding movement of the second jaws from the unclamped positions to the clamped positions via the second springs.

According to the principle of the invention, an apparatus includes a slide mounted reciprocally to a pole. The slide includes an upper extremity, a lower extremity, and a handle between the upper extremity and the lower extremity. First and second jaws are mounted reciprocally to the slide between gripping positions for gripping the pole therebetween and released positions for releasing the pole therebetween. The slide is disabled from moving reciprocally relative to the pole, in the gripping positions of the first and second jaws. The slide is enabled for moving reciprocally relative to the pole, in the released positions of the first and second jaws. Each of the first and second jaws reciprocates obliquely relative to the pole from the released position away from the pole and the upper extremity of the slide, and the gripping position toward the pole and the upper extremity of the slide. Each of the first and second jaws is mounted reciprocally to the slide with upper and lower pin-and-slot assemblies. A first spring, coupled between the first jaw and the slide constantly urges the first jaw toward the gripping position, and a second spring, coupled between the second jaw and the slide, constantly urges the second jaw toward to the gripping position. The first and second jaws are enclosed within the slide. A member extends into the slide and is mounted to the slide for movement between first and second positions. There is an operative coupling, enclosed within the slide, between the member and the first and second jaws, whereby the first and second jaws move from the gripping positions to the released positions, in response to movement of the member from the first position to the second position with a force sufficient to overcome the first and second springs, and the first and second jaws move from the released positions to the gripping positions, in response to movement of the member from the second position to the first position via the first and second springs. The member is located between the upper extremity of the slide and the handle, and the handle is located between the member and the lower extremity. A slide lock is mounted to the slide. The slide is disabled from moving reciprocally relative to the pole, in a locked position of the slide lock, and the slide is enabled for moving reciprocally relative to the pole, in an unlocked position of the slide lock. The slide lock is formed in the lower extremity of the slide.

According to the principle of the invention, an apparatus includes first and second pole assemblies. Each of the first and second pole assemblies includes a slide mounted reciprocally to a pole. The slide includes an upper extremity, a lower extremity, and a handle between the upper extremity and the lower extremity. First and second jaws are mounted reciprocally to the slide between gripping positions for gripping the pole therebetween and released positions for releasing the pole therebetween. The slide is disabled from moving reciprocally relative to the pole, in the gripping positions of the first and second jaws. The slide is enabled for moving reciprocally relative to the pole, in the released positions of the first and second jaws. The first pole assembly is mounted rotatably to the second pole assembly with a joint assembly including a first joint component thereof carried by the slide of the first pole assembly and a second joint component thereof carried by the slide of the second pole assembly. The first joint component is releasable from the second joint component, in a rotationally offset position of the first pole assembly relative to the second pole assembly. The first joint component is a pin. The pin includes outwardly-directed lugs. An inwardly-directed notch is between each pair of adjacent outwardly-directed lugs. The second joint component is a socket. The socket includes inwardly-directed lugs. An outwardly-directed notch is between each pair of adjacent inwardly-directed lugs. The pin is rotated to the socket. The outwardly-directed lugs are behind the inwardly directed lugs. The outwardly-directed lugs relate to the outwardly-directed notches and the outwardly-directed lugs relate to the inwardly-directed notches for allowing the first joint component to be pulled apart from the second joint component for separating the first pole assembly from the second pole assembly, in the rotationally offset position of the first pole assembly relative to the second pole assembly. The inwardly-directed lugs interfere with the outwardly-directed lugs behind the inwardly-directed lugs for preventing the first joint component from being pulled apart from the second joint component for preventing separation of the first pole assembly from the second pole assembly, other than in the rotationally offset position of the first pole assembly relative to the second pole assembly. The apparatus further includes a joint lock for locking and unlocking the joint assembly. The first joint component and the second joint component are disabled from rotating relative to one another for disabling rotation of the first pole assembly relative to the second pole assembly, in a locked position of the joint lock. The first joint component and the second joint component are enabled for rotating relative to the second joint component for enabling rotation of the first pole assembly relative to the second pole assembly, in an unlocked position of the joint lock. The joint lock includes a collar carried by the slide of one of the first and second pole assemblies. The collar encircles the joint assembly. A cam lever assembly is mounted to the slide of the other one of the first and second pole assemblies. The cam lever assembly is released from the collar for unlocking the joint assembly, in an open position of the cam lever assembly. The cam lever assembly is engaged to the collar for locking the joint assembly, in a closed position of the cam lever assembly. Each of the first and second jaws reciprocates obliquely relative to the pole from the released position away from the pole and the upper extremity of the slide and the gripping position toward the pole and the upper extremity of the slide, in each of the first and second pole assemblies. Each of the first and second jaws is mounted reciprocally to the slide with upper and lower pin-and-slot assemblies, in each of the first and second pole assemblies. A first spring, coupled between the first jaw and the slide, constantly urges the first jaw toward the gripping position, and a second spring, coupled between the second jaw and the slide, constantly urges the second jaw toward to the gripping position, in each of the first and second pole assemblies. The first and second jaws are enclosed within the slide, in each of the first and second pole assemblies. In each of the first and second pole assemblies, a member extends into the slide and mounted to the slide for movement between first and second positions, and an operative coupling, enclosed within the slide, is between the member and the first and second jaws, whereby the first and second jaws move from the gripping positions to the released positions, in response to movement of the member from the first position to the second position with a force sufficient to overcome the first and second springs, and the first and second jaws move from the released positions to the gripping positions, in response to movement of the member from the second position to the first position via the first and second springs. The member is located between the upper extremity of the slide and the handle, in each of the first and second pole assemblies. In each of the first and second pole assemblies, a slide lock mounted to the slide, the slide is disabled from moving reciprocally relative to the pole, in a locked position of the slide lock, and the slide is enabled for moving reciprocally relative to the pole, in an unlocked position of the slide lock. The slide lock is formed in the lower extremity of the slide, in each of the first and second pole assemblies.

According to the principle of the invention, an apparatus includes first and second pole assemblies, and a coupling. Each of the first and second pole assemblies includes a slide mounted reciprocally to a pole. The slide includes an upper extremity, a lower extremity, and a handle between the upper extremity and the lower extremity. First and second jaws are mounted reciprocally to the slide between gripping positions for gripping the pole therebetween and released positions for releasing the pole therebetween. The slide is disabled from moving reciprocally relative to the pole, in the gripping positions of the first and second jaws. The slide is enabled for moving reciprocally relative to the pole, in the released positions of the first and second jaws. The first pole assembly is mounted rotatably to the coupling with a first joint assembly including a first joint component thereof carried by the slide of the first pole assembly and a second joint component thereof carried by the coupling, and the second pole assembly is mounted rotatably to the coupling with a second joint assembly including a third joint element thereof carried by the slide of the second pole assembly and a fourth joint element thereof carried by the coupling. A pole is mounted pivotally to the coupling. The first joint component is releasable from the second joint component, in a rotationally offset position of the first pole assembly relative to the coupling. The third joint element is releasable from the fourth joint element, in a rotationally offset position of the second pole assembly relative to the coupling. Each of the first and second jaws reciprocates obliquely relative to the pole from the released position away from the pole and the upper extremity of the slide and the gripping position toward the pole and the upper extremity of the slide, in each of the first and second pole assemblies. Each of the first and second jaws is mounted reciprocally to the slide with upper and lower pin-and-slot assemblies, in each of the first and second pole assemblies. A first spring coupled between the first jaw and the slide constantly urging the first jaw toward the gripping position, and a second spring coupled between the second jaw and the slide constantly urging the second jaw toward to the gripping position, in each of the first and second pole assemblies. The first and second jaws are enclosed within the slide, in each of the first and second pole assemblies. In each of the first and second pole assemblies, a member extends into the slide and is mounted to the slide for movement between first and second positions, and an operative coupling, enclosed within the slide, is between the member and the first and second jaws, whereby the first and second jaws move from the gripping positions to the released positions, in response to movement of the member from the first position to the second position with a force sufficient to overcome the first and second springs, and the first and second jaws move from the released positions to the gripping positions, in response to movement of the member from the second position to the first position via the first and second springs. The member is located between the upper extremity of the slide and the handle, in each of the first and second pole assemblies. In each of the first and second pole assemblies, a slide lock is mounted to the slide, the slide is disabled from moving reciprocally relative to the pole, in a locked position of the slide lock, and the slide is enabled for moving reciprocally relative to the pole, in an unlocked position of the slide lock. The slide lock is formed in the lower extremity of the slide, in each of the first and second pole assemblies.

According to the principle of the invention, a slide is mounted reciprocally to a pole. The slide includes an upper extremity, a lower extremity, and a handle between the upper extremity and the lower extremity. First and second jaws are mounted reciprocally to the slide between gripping positions for gripping the pole therebetween and released positions for releasing the pole therebetween. The slide is disabled from moving reciprocally relative to the pole, in the gripping positions of the first and second jaws. The slide is enabled for moving reciprocally relative to the pole, in the released positions of the first and second jaws. An attachment is mounted rotatably to the slide with a joint assembly including a first joint component thereof carried by the attachment and a second joint component thereof carried by the slide. The first joint component is releasable from the second joint component, in a rotationally offset position of the attachment relative to the slide. A lock assembly is coupled between the attachment and the slide. The attachment is disabled from moving rotatably relative to the slide, in a locked position of the lock assembly. The attachment is enabled for moving rotatably relative to the slide, in an unlocked position of the lock assembly. Each of the first and second jaws is mounted reciprocally to the slide with upper and lower pin-and-slot assemblies. A first spring, coupled between the first jaw and the slide, constantly urges the first jaw toward the gripping position. A second spring, coupled between the second jaw and the slide, constantly urges the second jaw toward to the gripping position. The first and second jaws are enclosed within the slide. A member extends into the slide and is mounted to the slide for movement between first and second positions, and an operative coupling, enclosed within the slide, is between the member and the first and second jaws, whereby the first and second jaws move from the gripping positions to the released positions, in response to movement of the member from the first position to the second position with a force sufficient to overcome the first and second springs, and the first and second jaws move from the released positions to the gripping positions, in response to movement of the member from the second position to the first position via the first and second springs. The member is located between the upper extremity of the slide and the handle. A slide lock is mounted to the slide. The slide is disabled from moving reciprocally relative to the pole, in a locked position of the slide lock. The slide is enabled for moving reciprocally relative to the pole, in an unlocked position of the slide lock. The slide lock is formed in the lower extremity of the slide. The first joint component is a pin. The pin includes outwardly-directed lugs and an inwardly-directed notch between each pair of adjacent outwardly-directed lugs. The second joint component is a socket. The socket includes inwardly-directed lugs and an outwardly-directed notch between each pair of adjacent inwardly-directed lugs. The pin is rotated to the socket. The outwardly-directed lugs are behind the inwardly directed lugs. The outwardly-directed lugs relate to the outwardly-directed notches and the outwardly-directed lugs relate to the inwardly-directed notches for allowing the first joint component to be pulled apart from the second joint component for separating the first pole assembly from the second pole assembly, in the rotationally offset position of the first pole assembly relative to the second pole assembly. The inwardly-directed lugs interfere with the outwardly-directed lugs behind the inwardly-directed lugs for preventing the first joint component from being pulled apart from the second joint component for preventing separation of the first pole assembly from the second pole assembly, other than in the rotationally offset position of the first pole assembly relative to the second pole assembly.

BRIEF DESCRIPTION OF THE DRAWINGS

Referring to the drawings.

DETAILED DESCRIPTION

Figure 1:
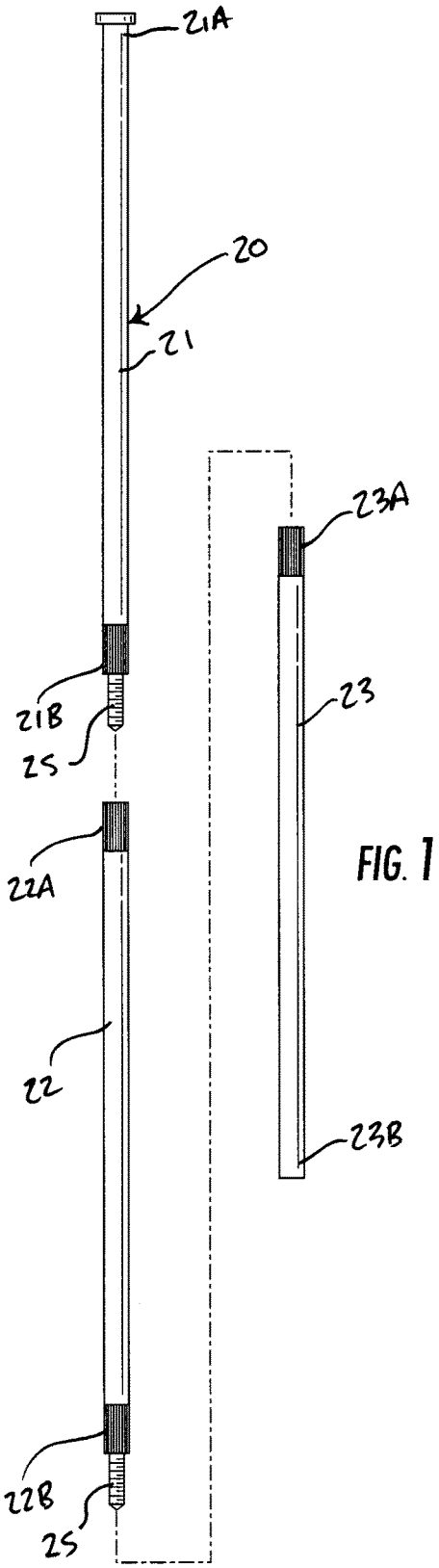
FIG. 1 is an exploded view of a pole for use in a shooting rest.
Figure 3:
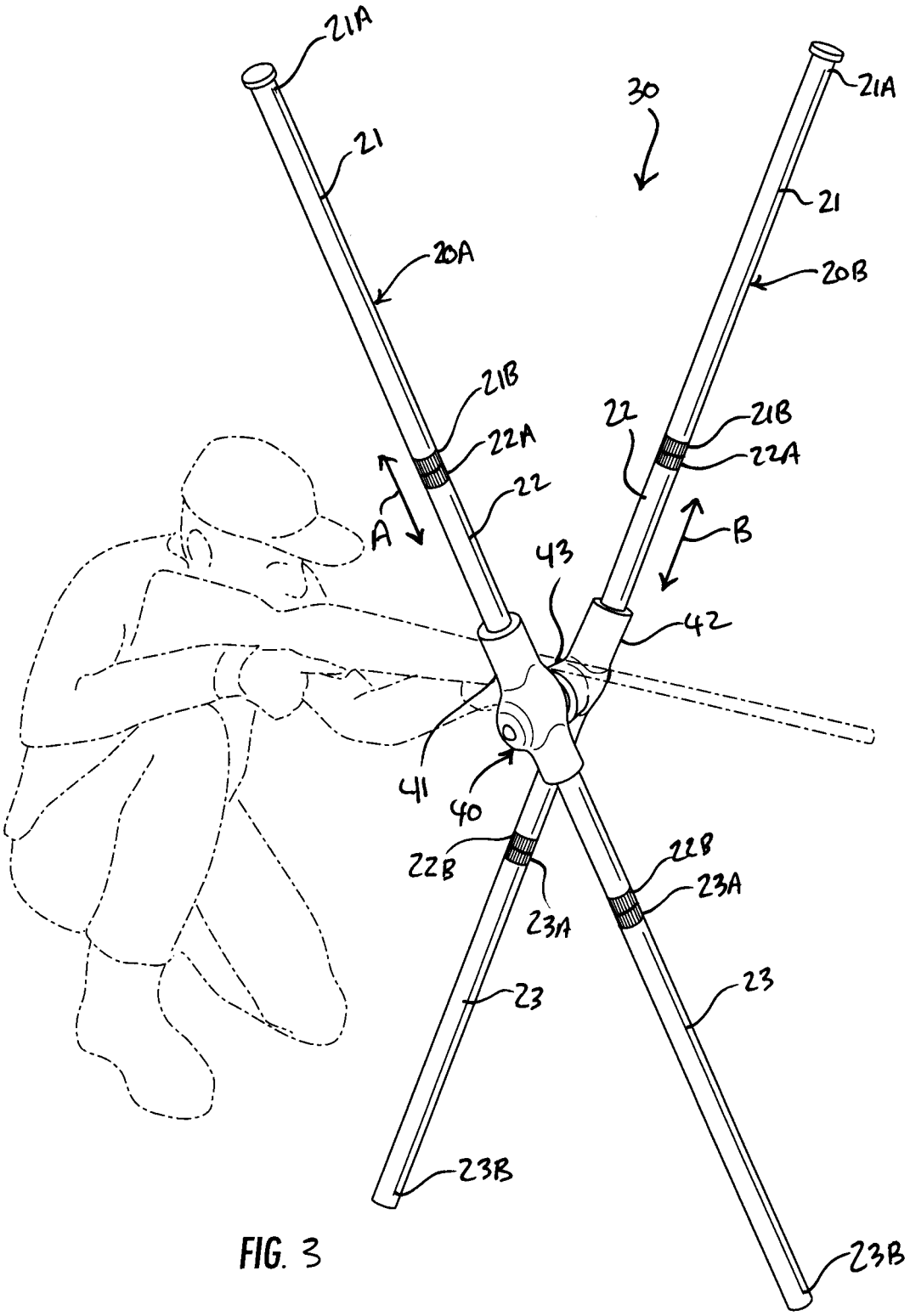
FIG. 3 is a perspective view of a shooting rest constructed and arranged in accordance with the principle of the invention, the shooting rest shown as it would appear in use and includes a gun rest assembly mounted to poles each being constructed and arranged according to the embodiment of FIG. 1.

Turning now to the drawings, in which like reference characters indicate corresponding elements throughout the several views, attention is first directed to FIG. 1 in which there is seen a pole 20 disassembled, two such poles when assembled form parts of a shooting rest 30 constructed and arranged in accordance with the principle of the invention as shown in FIGS. 3-8. Pole 20 is an assembly of pole segments 21, 22, and 23 each fashioned of wood, metal, plastic, carbon fiber, fiberglass or other material or combination of materials having the properties of rigidity, flexibility, resilience, and impact resistance. Segments 21, 22, and 23 area each elongate and straight, have a preselected external cross section that in the preferred embodiment is circular although the scope of this invention would include other cross sections such as square, oval, triangular, hexagonal, or other preselected cross section. Segments 21, 22, and 23 can be solid or hollow, and are preferably the latter for reduced weight. Segments 21, 22, and 23 are releasably connectable in series so as to form the assembled pole, which is long, such as approximately 6 feet in length, straight, and cylindrical in external cross section in the preferred embodiment. Depending on the chosen external cross sections of segments 21, 22, and 23, the assembled pole 20 can have other external cross sections such as square, oval, triangular, hexagon, or other preselected cross section. Two such assembled poles 20 are shown in FIG. 3 in an assembled shooting rest constructed and arranged in accordance with the principle of the invention. In FIG. 3, poles 20A and 20B are identical to one another in every respect.

Segment 21 is an upper or uppermost segment, segment 23 is a lower or lowermost segment, and segment 22 is a middle or intermediate segment between upper segment 21 and lower segment 22. Segment 21 includes upper extremity or end 21A, and lower extremity or end 21B. Segment 22 includes upper extremity or end 22A, and lower extremity or end 22B. Segment 23 has upper extremity or end 23A, and lower extremity or end 23B. Lower end 21B of segment 21 is releasably connected to upper end 22A of segment 22 with a connector assembly, and lower end 22B of segment 22 is releasably connected to upper end 23A of segment 23 with a connector assembly. The connector assembly between lower end 21B of segment 21 and upper end 22A of segment 22, and the connector assembly between lower end 22B of segment 22 and upper end 23A of segment 23 are identical.

Figure 2:
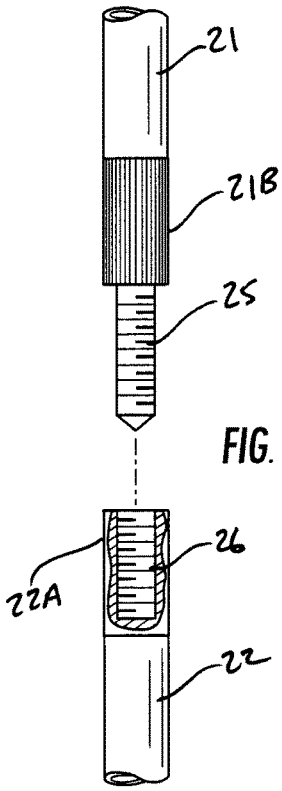
FIG. 2 is an enlarged, fragmented view of a connector assembly of the embodiment of FIG. 1.

In FIG. 2 each connector assembly includes an engagement element 25 and a corresponding releasably connectable complementing engagement element 26. In the present embodiment, engagement element 25 is a male engagement element in the form of a threaded shaft that is threaded into a complementing engagement element 26, which is a female engagement element in the form of a threaded bore, and the two are secured and tightened together and also loosened and released from one another via rotation. To assist with this rotation, lower end 21B of segment 21, upper end 22A of segment 22, lower end 22B of segment 22, and upper end 23A of segment 23 are externally knurled. This optional knurling assists a user in obtaining a firm grip for rotation purposes.

In FIG. 2 the described connector assembly is between lower end 21B of segment 21 and upper end 22A of segment 22. Again, the identical connector assembly is used between lower end 22B of segment 22 and upper end 23A of segment 23. Those having regard for the art will appreciate that the location of the engagement element 25 and the complemental engagement element 26 of each of the two connecting joints can be reversed if so desired without departing from the invention. In alternate embodiments, it is within the scope of the invention that other forms of connector assemblies can be used to releasably connect the various segments of pole 20, such as snap-fit connectors, tongue-and-groove connectors, magnetic connectors, or other preselected connector assembly.

Figure 4:
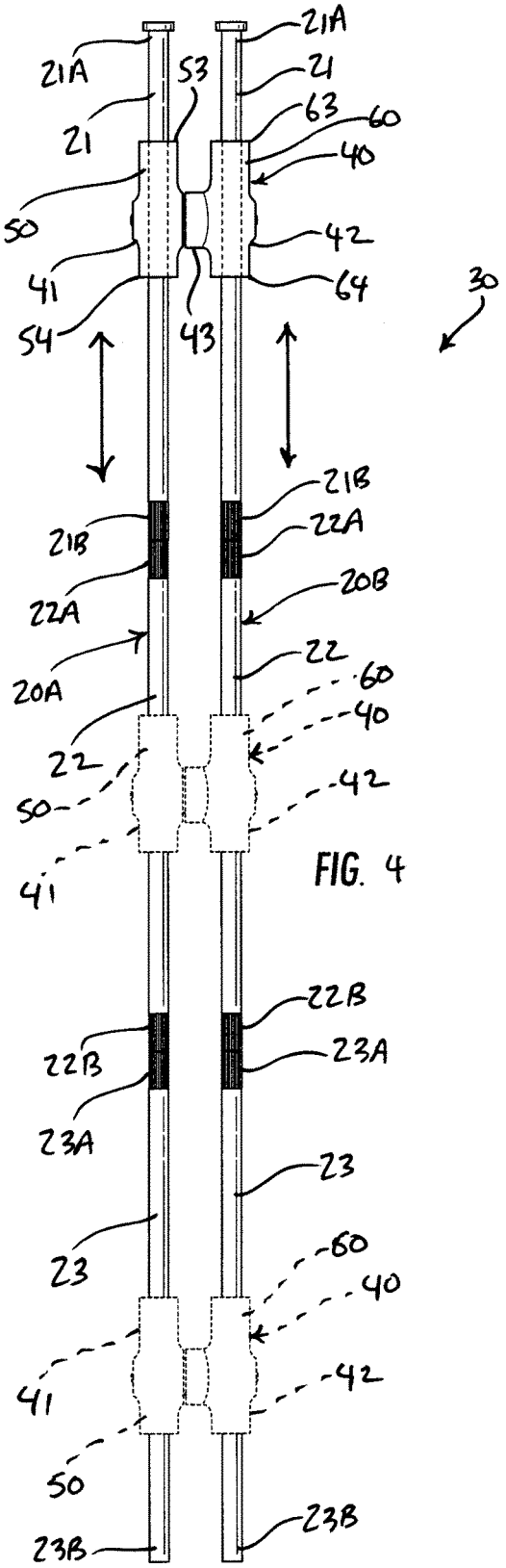
FIG. 4 is a front elevation view of the embodiment of FIG. 3 illustrating the poles as they would appear parallel relative to each other, and the gun rest assembly schematically shown as it would appear in different positions along the lengths of the poles.
Figures 5, 6, 7, 8:
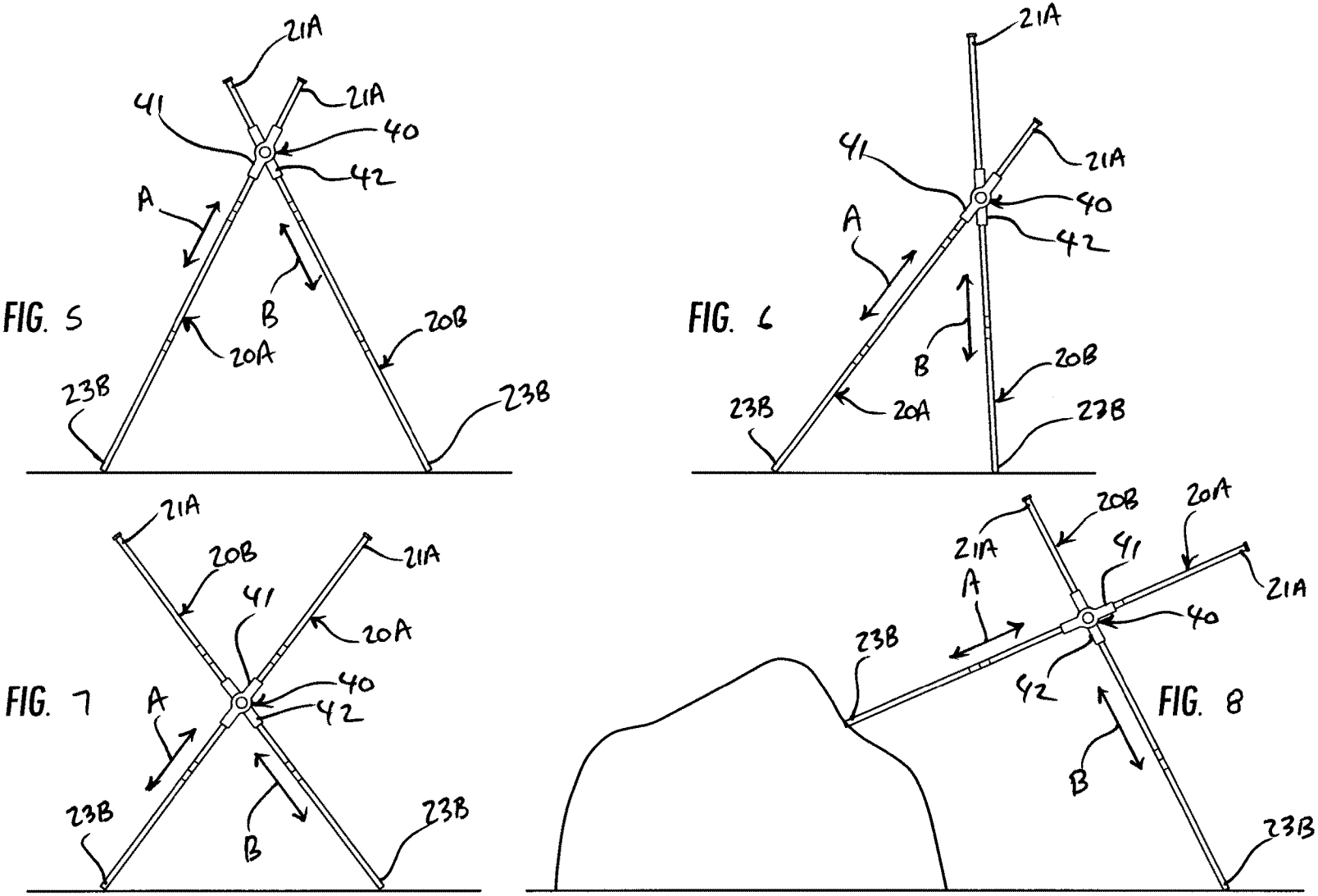
FIGS. 5-8 illustrate different configurations of the embodiment of FIG. 3.

In FIGS. 3-8 shooting rest 30 includes identical poles 20A and 20B, and gun rest assembly 40, forming a bipod, a two-legged support. In FIG. 3 a shooter is shown in phantom outline using shooting rest 30 to support a rifle barrel. Poles 20A and 20B, as described above, each have upper end 21A, lower end 23B, and a length from upper end 21A to lower end 23B, which is approximately 6 feet in the present embodiment. Upper ends 21A of rods 20A and 20B have end caps and the lower ends 23B of rods 20A and 20B can incorporate caps or points for providing good contact with the ground. Gun rest assembly 40 is for holding poles 20A and 20B parallel relative each other in FIG. 4, and in selected angular relationships or, in other words, selected angular crossing positions, as shown in FIGS. 5-8, and at selected longitudinal locations along the longitudinal axes or lengths of poles 20A and 20B, as shown in FIG. 4. FIG. 4 shows how gun rest assembly 40 is moved along the longitudinal axes or lengths of poles 20A and 20B. In FIG. 3 the solid depiction of gun rest assembly 40 is positioned near the upper ends 21A of poles 20A and 20B, a phantom depiction of gun rest assembly 40 is positioned near the middle or middle portion of poles 20A and 20B, and a second phantom depiction of gun rest assembly 40 is positioned near lower ends 23B of poles 20A and 20B. Accordingly, there is a height adjustment available which translates into a choice by the shooter as to how high off the ground he wants the cross poles 20A and 20B to be for resting his gun on gun rest assembly 40.

Gun rest assembly 40 includes gun rest component 41 swiveled to gun rest component 42, shown in FIGS. 4, 9, 10, and 12. Gun rest component 41 is a slide mounted reciprocally to pole 20A. Gun rest component 41 is a slide mounted reciprocally to pole 20B. Gun rest components 41 and 42 are substantially coextensive. In FIGS. 2, 4, 9, 10, and 12 a swivel joint or swivel 43 swivels and connects gun rest component 41 to gun rest component 42. Swivel 43 allows gun run rest components 41 and 42 to turn around freely relative to each other, especially to turn in a full circle relative to each other. This allows gun rest components 41 and 42 to be rotated/swiveled relative to each other for holding poles 20A and 20B in a parallel relationship relative to each other as shown in FIG. 4, and in selected angular relationships or angular crossing positions as in FIGS. 5-8. Accordingly, there is an angular adjustment available which translates into a choice by a shooter as to how far apart he wants to spread poles 20A and 20B apart to selected angular crossing positions.

Gun rest assembly 40 and poles 20A and 20B are coupled together for relative reciprocal movement. Specifically, gun rest component 41 is mounted to pole 20A for reciprocal movement along the longitudinal axis or length of pole 20A as indicated by double arrowed line A in FIGS. 3-8 from upper end 21A of pole 20A to lower end 23B of pole 20A to set gun rest component 41, and thus gun rest assembly 40, at preselected locations along the longitudinal axis or length of pole 20A. Moreover, gun rest component 41 and pole 20A are coupled together for relative reciprocal movement, which not only allows gun rest component 41 to be reciprocated along the longitudinal axis or length of pole 20A from upper end 21A to lower end 23B, but also allows pole 20A to be slid up and down relative to and through gun rest component 41. This allows a user to hold gun rest assembly 40 stationary and slide pole 20A through gun rest component 41 up or down in order to set gun rest component 41, and thus gun rest assembly 40, at preselected locations along the longitudinal axis or length of pole 20A.

Identically, gun rest component 42 is mounted to pole 20B for reciprocal movement along the longitudinal axis or length thereof as indicated by double arrowed line B in FIGS. 3-8 from upper end 21A of pole 20B to lower end 23B of pole 20B as shown in FIG. 4 to set gun rest component 42, and thus gun rest assembly 40, at preselected locations along the longitudinal axis or length of pole 20A. Moreover, gun rest component 42 and pole 20B are coupled together for relative reciprocal movement, which not only allows gun rest component 42 to be reciprocated along the longitudinal axis or length of pole 20B from upper end 21A to lower end 23B, but also allows pole 20B to be slid up and down through and relative to gun rest component 42. This allows a user to hold gun rest assembly 40 stationary and slide pole 20B through gun rest component 42 up or down in order to set gun rest component 42, and thus gun rest assembly 40, at preselected locations along the longitudinal axis or length of pole 20A. Gun rest assembly 40 is structured and arranged to allow the reciprocal adjustment of gun rest component 41 relative to pole 20A to be performed independent of the reciprocal adjustment between gun rest assembly 42 and pole 20B. Accordingly, in FIGS. 6 and 8 there is an independent location adjustment available which translates into a choice by the shooter as to where to locate each gun rest component 41 and 42 along the longitudinal axes or length of each corresponding pole 20A and 20B to allow a user flexibility of positioning poles in different angular positions in FIG. 6 and on uneven ground in FIG. 8 for how high off the ground he wants the cross poles 20A and 20B to be for resting his gun on gun rest assembly 40.

The releasably connectable joints between the corresponding segments 21, 22, and 23 of pole 20 allow pole 20 to be disassembled and assembled when needed, and when assembled provide smooth or even joints along the external cross sections of poles 20A and 20B to allow a user to slide gun rest components 41 and 42 of gun rest assembly 40 across the joints of the corresponding poles 20A and 20B to any position along the entire longitudinal axes or lengths of poles 20A and 20B from upper ends 21A to lower ends 23B of poles 20A and 20B without interference or restriction.

Figure 9:
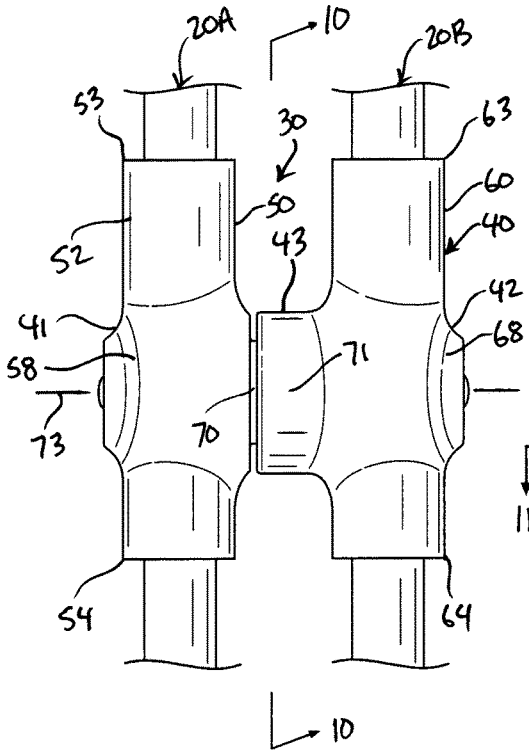
FIG. 9 is an enlarged, fragmented, front elevation view of the embodiment of FIG. 3 illustrating the gun rest assembly mounted on the poles.
Figure 10:
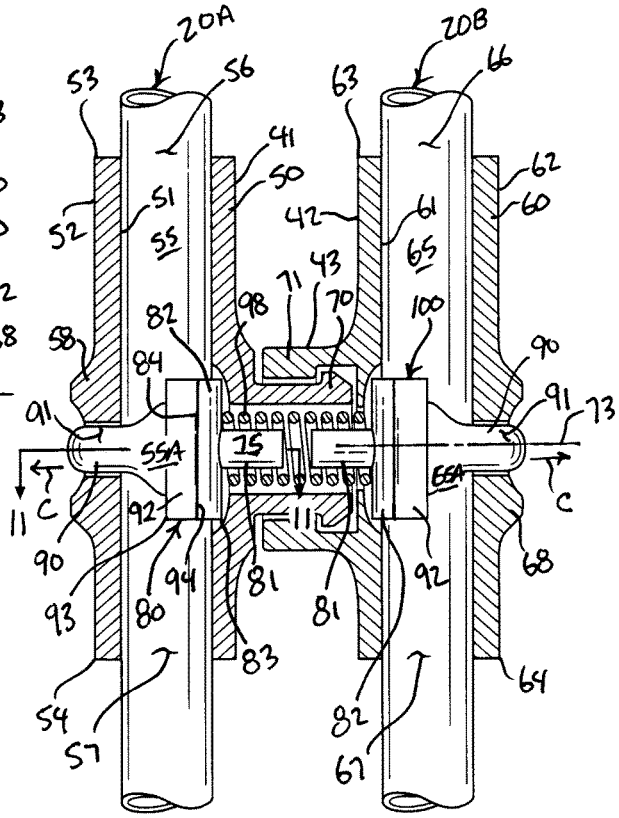
FIG. 10 is a section view taken along line 10-10 of FIG. 9 illustrating a clamp assembly as it would appear in a clamped position clamping the gun rest assembly to the poles.

In FIGS. 9 and 10 gun rest component 41 is an elongate body in the form of sleeve 50 that includes inner surface 51 in FIG. 10, outer surface 52, upper end 53, and lower end 54. Sleeve 50 has a middle portion or middle 58 between upper and lower ends 53 and 54 thereof. Gun rest component 42 is an elongate body in the form of sleeve 60 that includes inner surface 61 in FIG. 10, outer surface 62, upper end 63, and lower end 64. Sleeve 60 has a middle portion or middle 68 between upper and lower ends 53 and 54 thereof. Sleeves 50 and 60 are each fashioned of wood, metal, plastic, carbon fiber, fiberglass or other material or combination of materials having the properties of rigidity, flexibility, resilience, and impact resistance, and are preferably integrally formed, such as by molding or machining.

Figure 12:
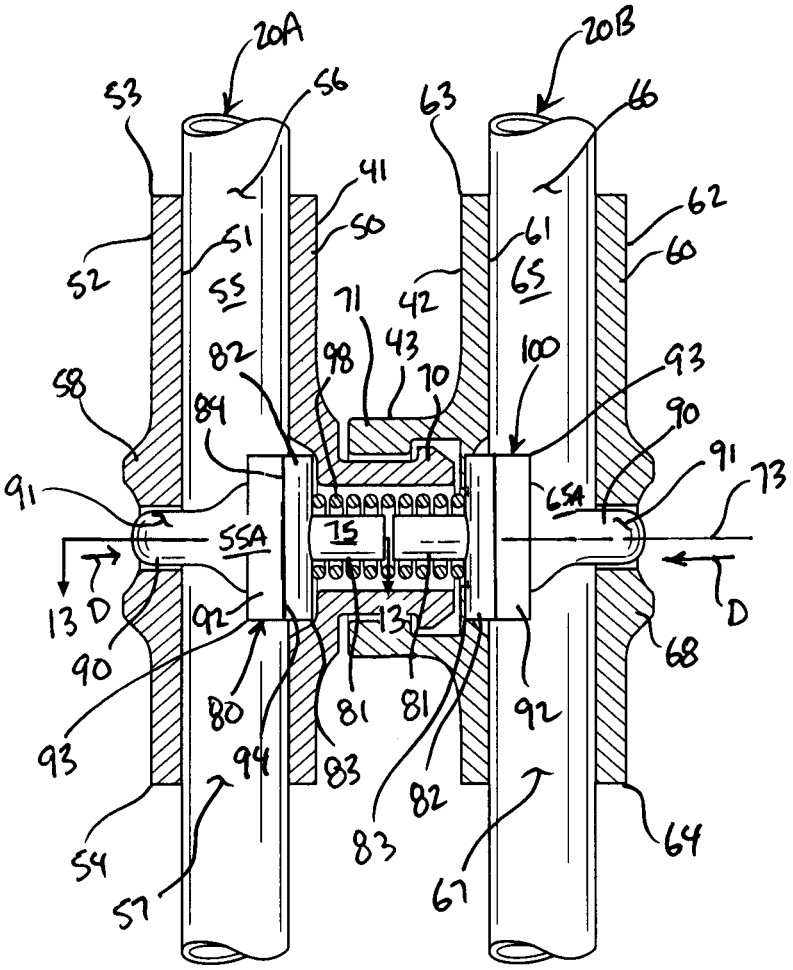
FIG. 12 is a view similar to that of FIG. 10 illustrating the clamp assembly as it would appear in an unclamped position releasing the gun rest assembly from the poles.

In FIGS. 10 and 12 a channel 55 extends through sleeve 50 from opening 56 in upper end 53 to opening 57 in lower end 54 through which pole 20A extends and is received slidably. At middle 58 of sleeve 50 channel 55 is somewhat enlarged to define cavity 55A through which pole 20A extends. Cavity 55A is part of channel 55. Channel 65 extends through sleeve 60 from opening 66 in upper end 63 to opening 67 in lower end 54 through which pole 20B extends. At middle 68 of sleeve 60 channel 65 is somewhat enlarged to define cavity 65A through which pole 20B extends and is received slidably. Cavity 65A is part of channel 65.

And so pole 20A is received slidably through sleeve 50, and pole 20B is received slidably through sleeve 60. Channel 55 from opening 56 to opening 57 has an internal cross section preselected to freely receive pole 20A. Channel 65 from opening 66 to opening 57 also has an internal cross section to freely receive pole 20B. Sleeve 50 circumscribes pole 20A, which extends through channel 55 from opening 56 to opening 57. Preferably, pole 20A and channel 55 have the same or similar cross-sections, which allows pole 20A to freely slide up-and-down through sleeve 50. This arrangement allows sleeve 50, and thus gun rest component 41, and pole 20A to freely mutually reciprocate relative to each other. Sleeve 60 likewise circumscribes pole 20B, which extends through channel 65 from opening 66 to opening 67. Pole 20B and channel 65 have the same or similar cross-sections, which allows pole 20B to freely slide up-and-down through sleeve 60. This arrangement allows sleeve 60, and thus gun rest component 42, and pole 20A to freely mutually reciprocate relative to each other.

FIGS. 10 and 12 show how swivel 43 connects gun rest assemblies 41 and 42. More specifically, swivel 43 connects sleeves 50 and 60 at the inner sides of their respective middles 58 and 68. Swivel 43 is a coupling formed by two parts that turn independently. Swivel 43 consists of two interlocking elements, including interlocking inner and outer collars 70 and 71 in this example. Inner collar 70 is a part of sleeve 50 and is integral with middle 58 of sleeve 50 and extends outwardly from the inner side of middle 58, and outer collar 71 is a part of sleeve 60 and is integrally formed with middle 68 of sleeve 60 and extends outwardly from the inner side of middle 68. Outer collar 71 encircles inner collar 70, outer and inner collars 71 and 70 interlock to releasably connect the one to the other, and outer and inner collars 71 and 70 are free to swivel or rotate independently relative to each other for allowing a user to place poles 20A and 20B in a parallel relationship relative to each other as shown in FIG. 4, and to deploy or spread poles 20A and 20B apart in in selected angular relationships, namely, selected angular crossing positions as shown in FIGS. 5-8. Although inner collar 70 is formed with sleeve 50 and outer collar 71 is formed with sleeve 60, this can be reversed in an alternate embodiment according to the scope of the invention.

In FIGS. 10 and 12 interlocking inner and outer collars 70 and 71 encircle a chamber 75 that extends through swivel 43 to and between cavities 55A and 65A of channels 55 and 65. Chamber 75 is open to cavity 55A of channel 55, and is open to cavity 65A of channel 65. Chamber 75 and channels 55 and 65, including cavities 55A and 65A, define the internal cavity, chamber or hollowing of gun rest assembly 40. Sleeves 50 and 61 pivot at interlocking inner and outer collars 70 and 71 about pivot axis 73 in FIGS. 9, 10, and 12. Pivot axis 73 extends centrally through chamber 75, and is orthogonal with respect to gun rest assemblies 41 and 42, channels 55 and 65, the longitudinal axes or lengths of poles 20A and 20B through channels 55 and 65.

In FIGS. 10 and 12 gun rest assembly 40 includes first and second clamp assemblies 80 and 100 enclosed in the internal cavity of gun rest assembly 40. Enclosed in gun rest assembly 40 first and second clamp assemblies 80 and 100 are protected from becoming damaged and rendered in operable through exposure to external influences. First clamp assembly 80 is arranged with gun rest component 41 and pole 20A and is used to clamp and unclamp pole 20A relative to gun rest component 41. Second clamp assembly 100 is arranged with gun rest component 42 and pole 20B and is used to clamp and unclamp pole 20B relative to gun rest component 42. First clamp assembly 80 is movable between a clamped position in FIGS. 10 and 11 that clamps gun rest component 41 to pole 20A to restrict relative reciprocal movement between gun rest component 41 and pole 20A along the length of pole 20A, and an unclamped position in FIGS. 12 and 13 that unclamps gun rest component 41 from pole 20A to permit relative reciprocal movement between gun rest component 41 and pole 20A along the length of pole 20A. Identically to that of the first clamp assembly 80, second clamp assembly 100 is movable between a clamped position in FIG. 10 that clamps gun rest component 42 to pole 20B to restricts relative reciprocal movement between gun rest component 42 and pole 20B along the length of pole 20B, and an unclamped position in FIG. 12 that unclamps gun rest component 42 from pole 20B to permit relative reciprocal movement between gun rest component 42 and pole 20B along the length of pole 20B.

First and second clamp assemblies 80 and 100 are each independently movable in reciprocal directions relative to the longitudinal axes or lengths of poles 20A and 20B and channels 55 and 65 through which poles 20A and 20B extend between their respective clamped and unclamped positions, which allows poles 20A and 20B to be clamped and unclamped relative to the respect gun rest components 41 and 42 independently relative to each other. This allows each pole and gun rest component pair be clamped together independently of the other pole and gun rest pair, and allows each pole and gun rest assembly pair to be unclamped independently of the other pole and gun rest pair to allow each pole and gun rest component pair to reciprocally adjusted independently of the other pole and gun rest component pair.

Figure 11:
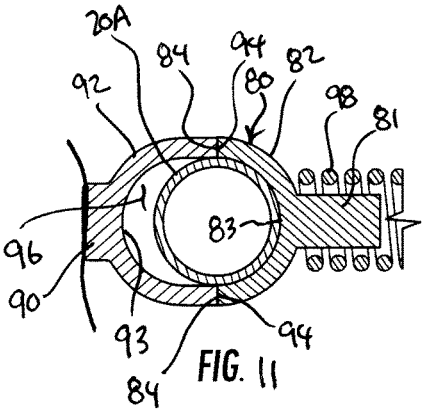
FIG. 11 is a section view taken along line 11-11 of FIG. 10.

Looking to FIGS. 10 and 11 in relevant part, first clamp assembly 80 enclosed in the interior of gun rest assembly 40 is used to clamp pole 20A to sleeve 50. Clamp assembly 80 includes location pin 81 enclosed in chamber 75 having an end formed with u-shaped body or yoke 82 enclosed in cavity 55A of channel 55. Yoke 82 in cavity 55A of channel 55 at middle 58 of sleeve 50 is juxtaposed along and faces an inner side of pole 20A. Yoke 82 has a bight 83 and two legs 84 that extend therefrom in parallel or substantially parallel spaced apart relationship so as to extend along either side of an inner side of pole 20A in channel 55 at middle 58 of sleeve 50. Yoke 82 is shaped to relate to the external cross section of pole 20A. Location pin 81 extends into chamber 75 from yoke 82 toward middle 58 of the inner side of sleeve 60. A button 90 extends into cavity 55A of channel 55 through opening 91 in the outer side of middle 58 of sleeve 50 to u-shaped body or yoke 92 enclosed in cavity 55A. Moreover, button 90 extends into cavity 55A where clamp assembly 80 is enclosed in cavity 55A and chamber 75. Yoke 92 is diametrically opposed from yoke 82 and is enclosed in cavity 55A of channel 55 along an outer side of pole 20A opposite to yoke 82. Yoke 92 has a bight 93 and two legs 94 that extend therefrom in parallel or substantially parallel spaced apart relationship so as to extend along either side of an outer side of pole 20A. The outer ends of legs 94 of yoke 92 extend to and contact the respective outer ends of legs 84 of yoke 82, and it is there at these contact points where the opposed legs are affixed to one another, such as by welding, heat bonding, an adhesive, or the like. This connects yokes 82 and 92, to form an encircling band, which together circumscribe pole 20A and encircle an elongate opening 96 through which pole 20A extends. Elongate opening 96 through which pole 20A extends allows yokes 82 and 92 to freely reciprocally translate laterally-back-and-forth in an orthogonal direction relative to the longitudinal axis or length of pole 20A in the movement of clamp assembly 80 between its clamped and unclamped positions.

Second clamp assembly 100 is used to clamp pole 20B to sleeve 50 and is identical in every respect to first clamp assembly 80 and is discussed briefly here. In common with clamp assembly 80, in FIGS. 10 and 12 clamp assembly 100 shares location pin 81 in chamber 75, yoke 82 enclosed in cavity 65A, button 90 that extends into cavity 65A through opening 91 to yoke 92 that is enclosed in cavity 65A and connected to yoke 82, and all related components previously discussed in connection with first clamp assembly 80. Yoke 82 located in cavity 65A of channel 65 at middle 58 of sleeve 60 and is juxtaposed along and faces an inner side of pole 20B and extends along either side of an inner side of pole 20B in channel 65 at middle 58 of sleeve 60. Yoke 82 is shaped to relate to the external cross section of pole 20B. Location pin 81 extends into chamber 75 from yoke 82 toward middle 58 of the inner side of sleeve 60 and toward location pin 82 of clamp assembly 80. Location pins 81 in chamber 75 are diametrically opposed and are spaced apart from one another defining a gap or space therebetween. Button 90 extends into channel 65 through opening 91 in the outer side of middle 68 of sleeve 60 to u-shaped body or yoke 92. Yoke 92 is diametrically opposed from yoke 82 and is enclosed in cavity 65A of channel 65 along an outer side of pole 20B opposite to yoke 82 and extends along either side of an outer side of pole 20B and is connected to yoke 82. Yokes 92 and 92 form an encircling band and together circumscribe pole 20B and encircle the elongate opening through which pole 20B extends. The elongate opening defined by yokes 92 and 82 of clamp assembly 100 through which pole 20B extends allows yokes 82 and 92 of clamp assembly 100 to freely reciprocally translate laterally-back-and-forth in an orthogonal direction relative to the longitudinal axis or length of pole 20B in the movement of clamp assembly 100 between its clamped and unclamped positions.

In FIGS. 10 and 12 a spring 98 is enclosed in chamber 75 through swivel 43. Spring 98 is a conventional outwardly-biased compression spring in the present embodiment. Spring 98 concurrently encircles location pins 81 in chamber 75, which holds spring 98 in place, and spring 98 is captured by and between, and is in direct contact with, yokes 82 of clamp assemblies 80 and 100. Spring 98 provides a constant bias, and acts against and between yokes 82 constantly biasing or pushing clamp assemblies 80 and 90 outwardly in the direction of arrowed lines C, respectively, forcibly exerting yokes 82 directly against the inner sides of the corresponding poles 20A and 20B, as in FIG. 10 and FIG. 11. The direction of arrowed lines C is orthogonal relative to channels 55 and 65 and the longitudinal axes of poles 20A and 20B extending through channels 55 and 65. This clamps poles 20A and 20B between the yokes 82 of the respective clamp assemblies 80 and 100 and the respective inner surfaces 51 and 61 of the corresponding sleeves 50 and 60, which restricts poles 20A and 20B from sliding up and down through the respective gun rest assemblies 41 and 42 which, in turn, restricts relative reciprocal movement between gun rest components 41 and 42 and the respective poles 20A and 20B. With sleeves 50 and 60 clamped to poles 20A and 20B in the clamped positions of the respectively clamp assemblies 80 and 100, gun rest components 41 and 42 are restricted from reciprocal movement along the longitudinal axes or lengths of poles 20A and 20B and can be swiveled at swivel 43 to place poles 20A and 20B in a parallel relationship relative to each other as shown in FIG. 4, and to deploy or spread poles 20A and 20B apart in selected angular crossing positions as in FIGS. 5-8.

Sleeves 50 and 60 can be released from poles 20A and 20B to permit relative reciprocal adjustment between poles 20A and 20B and sleeves 50 and 60 of the respective gun rest components 41 and 41 for the purpose of setting gun rest assembly 40 at selected locations along the longitudinal axes or lengths of poles 20A and 20B. Buttons 90 are reciprocated between depressed and released positions by hand to move the respective clamp assemblies 80 and 100 between the clamped and unclamped positions. In the released positions of buttons 90 in FIG. 10, they are each in an unclamped position corresponding to the unclamped positions of the respective clamp assemblies 80 and 100. In the depressed positions of buttons 90 in FIG. 12, they are each in a clamped position corresponding to the clamped position of the respective clamp assemblies 80 and 100.

Figure 13:
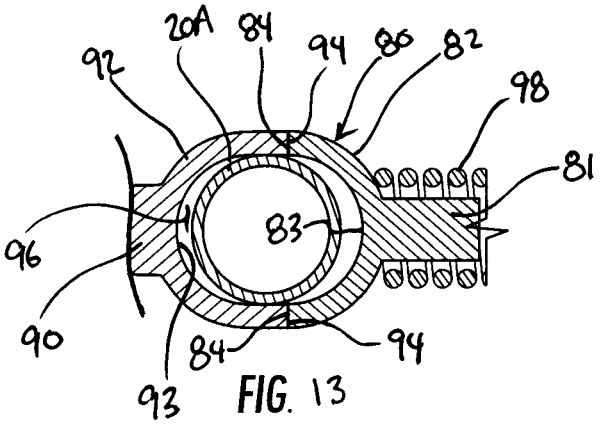
FIG. 13 is a section view taken alone line 13-13 of FIG. 12.

Buttons 90 are not enclosed within gun rest assembly 40, which provides access to buttons 90 for pressing. Using his or her hand a user presses buttons 90 inwardly in the directions of corresponding arrowed lines D in FIG. 12 with a force sufficient to overcome the bias applied by spring 98, which moves buttons 90 inwardly toward poles 20A and 20B from their released/unclamped positions in FIG. 10 to their depressed/clamped positions in FIG. 12, which, in turn, displaces yokes 82 inwardly toward one another and away from the inner sides of the respective poles 20A and 20B. The direction of arrowed lines D is orthogonal relative to channels 55 and 65 and the longitudinal axes of poles 20A and 20B extending through channels 55 and 65. This brings clamp assemblies 80 and 100 toward one another into their unclamped positions. And so movement of buttons 90 from their released/unclamped positions to their depressed/clamped position with a force with a force sufficient to overcome the bias of spring 98 urges corresponding movement of yokes 82 from their clamped positions to their unclamped positions. In the unclamped position of clamp assembly 80, yoke 82 of clamp assembly 80 is moved inwardly in the direction of arrowed line D in FIG. 12 out of contact with the inner side of pole 20A as shown in FIG. 13 so as to substantially center pole 20A in elongate opening 96. This removes the clamping force of clamp assembly 80 clamping pole 20A to inner surface 51 of sleeve 50 so as to unclamp pole 20A from between yoke 82 of clamp assembly 80 and inner surface 51 of sleeve 50. In the unclamped position of clamp assembly 100, yoke 82 of clamp assembly 100 is moved inwardly in the direction of arrowed line D in FIG. 12 out of contact with the inner side of pole 20B so as to substantially center pole 20A in the elongate opening encircled by yokes 82 and 92 of clamp assembly 1-100. As with gun rest component 41 previously described, this removes the clamping force clamping pole 20B to inner surface 61 of sleeve 60 as provided by clamp assembly 100 so as to unclamp pole 20B from between yoke 82 of clamp assembly 100 and inner surface 61 of sleeve 60. By holding down buttons 90 in their inwardly depressed positions to retain clamp assemblies 80 and 100 in their unclamped positions, poles 20A and 20B and the respective gun rest components 41 and 42 are free to be reciprocated relative to each other, and a user can simply then slide gun rest assembly 40 up and down poles 20A and 20B along the longitudinal axes or lengths of poles 20A and 20B as desired to a selected position along the longitudinal axes or lengths of poles 20A and 20B, or a user can hold gun rest assembly 40 stationary and freely slide poles 20A and 20B up and down to set gun rest assembly 40 at a preselected locations along the longitudinal axes or lengths of poles 20A and 20B.

In response to releasing buttons 90, spring 98 bias takes over and again concurrently acts against yokes 82 of clamp assemblies 80 and 100 urging clamp assemblies 80 and 100 in the direction of the corresponding arrowed lines C in FIG. 10 from their unclamped positions in the depressed positions of buttons 90 positions in FIG. 12 to their clamped positions in FIG. 10 in the released positions of buttons 90, which again clamps and locks poles 20A and 20B between the respective yokes 82 and the respectively inner surfaces 51 and 61 of the corresponding sleeves 50 and 60 of the corresponding gun rest components 41 and 42 thereby restricting relative reciprocal movement between, on the one hand, poles 20A and 20B, and, on the other hand, gun rest components 41 and 42 of gun rest assembly 40. And so movement of buttons 90 from their depressed/clamped positions to their released/unclamped positions urges corresponding movement of yokes 82 from their clamped positions to their unclamped positions via spring 98.

Clamp assemblies 80 and 100 can be operated independently of one another via their respective buttons 90. In other words, buttons 90 can be depressed and released independent of one another to allow a user to independently clamp and unclamp of poles 20A and 20B relative to the corresponding gun rest components 41 and 42 of gun rest assembly 40. Again, this allows each pole and gun rest component pair be clamped together independently of the other pole and gun rest pair, and allows each pole and gun rest assembly pair to be unclamped independently of the other pole and gun rest pair to allow each pole and gun rest component pair to reciprocally adjusted independently of the other pole and gun rest component pair.

Figure 14:
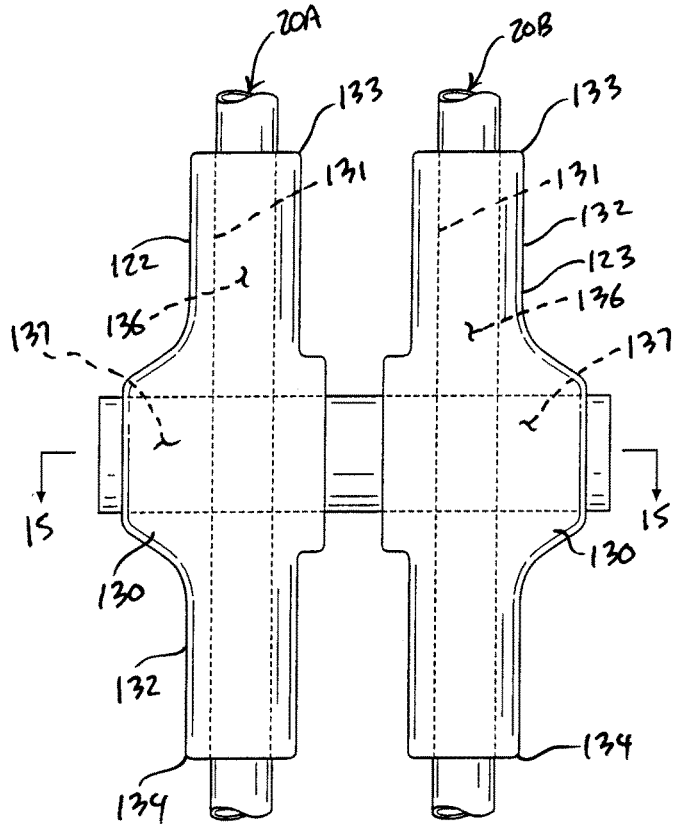
FIG. 14 is a view similar to that of FIG. 9 illustrating an alternate embodiment of a gun rest assembly mounted on poles to form a shooting rest.
Figure 15:
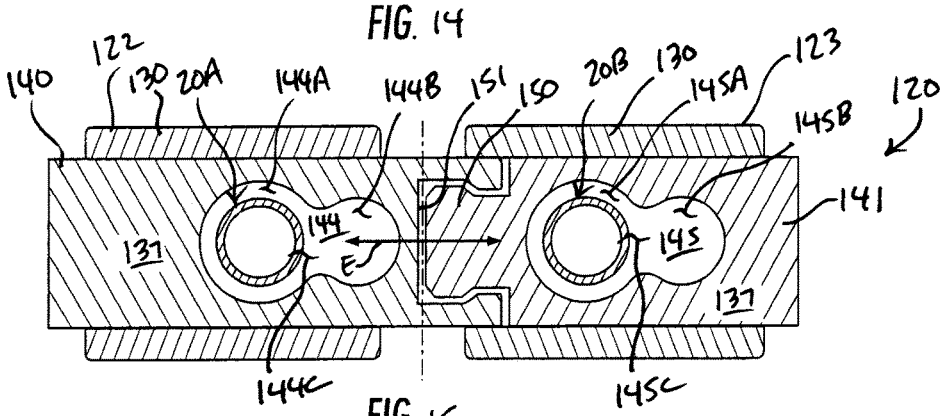
FIG. 15 is a section view taken along line 15-15 of FIG. 14 illustrating the gun rest assembly as it would appear unclamped from the poles.
Figure 16:
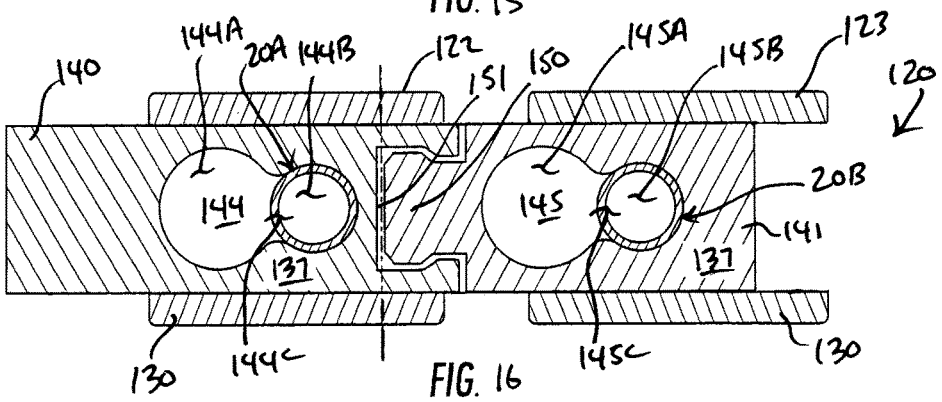
FIG. 16 is a view similar to that of FIG. 15 illustrating the gun rest assembly as it would appear clamped to the poles.

FIGS. 14-16 show an alternate embodiment of a gun rest assembly 120, which is mounted on poles 20A and 20B so as to form a shooting rest. Like gun rest assembly 40, gun rest assembly 120 is for holding poles 20A and 20B in selected angular relationships, namely, selected angular crossing positions, and at selected longitudinal locations along the longitudinal axes or lengths of poles 20A and 20B.

Looking to FIGS. 14-16 in relevant part, gun rest assembly 120 includes a connector assembly 121 connecting opposed gun rest components 122 and 123. Gun rest component 121 is a slide mounted reciprocally to pole 20A. Gun rest component 122 is a slide mounted reciprocally to pole 20B. Gun rest components 121 and 123 are the mirror image of one another and each includes a sleeve 130 that has inner surface 131 (shown in dotted outline in FIG. 14), outer surface 132, upper end 133, lower end 134, middle portion or middle 135 between upper and lower ends 133 and 134, channel 136 (shown in dotted outline in FIG. 14) extends through sleeve 130 from opening 140 in upper end 133 to opening 141 in lower end 134, and bore 136 (shown in dotted outline in FIG. 14) extends laterally through middle 135 form the inner side to the outer side of sleeve 130 in a direction that is orthogonal relative to the direction of channel 136. Sleeves 130 are fashioned of fashioned of wood, metal, plastic, carbon fiber, fiberglass or other material or combination of materials having the properties of rigidity, flexibility, resilience, and impact resistance, and are preferably integrally formed, such as by molding or machining.

Pole 20A is received slidably through channel 136 of gun rest component 122, and pole 20B is received slidably through channel 136 of gun rest component 123. This allows poles 20A and 20B and gun rest components 122 and 123 of gun rest assembly to freely reciprocate relative to each other. Pole 20A and channel 136 have the same or similar cross-sections, which allows pole 20A to freely slide up-and-down through gun rest component 122. Pole 20B and channel 136 have the same or similar cross-sections, which allows pole 20B to freely slide up-and-down through gun rest component 123.

In FIGS. 15 and 16, connector 121 includes interlocking fixtures 140 and 141. Fixture 140 extends through bore 137 of gun rest component 122, and fixture 141 extends through bore 137 of gun rest component 123. Fixtures 140 and 141, and bores 137, have the same or similar cross-sections, which allows fixtures 140 and 141 to reciprocate back and forth in bores 137 relative to the longitudinal axes or lengths of poles 20A and 20B, and channels 136.

Openings 144 and 145 are formed through the respective fixtures 140 and 141, through which the respective poles 20A and 20B extend. Openings 144 and 145 are identical. Opening 144 has an enlarged part 144A and a narrowed part 144B separated by a waist part 144C, and opening 145 has an enlarged part 145A and a narrowed part 145B separated by a waist part 145C. A pivot joint pivotally connects fixtures 140 and 141 and this, in turn, pivotally connects or swivels gun rest component 122 to gun rest component 123. The pivot joint is a ball 150 and socket 151 joint, and other forms of pivot joints can be used if so desired, including the pivot joint of the previous embodiment. Ball 150 is formed in fixture 141 and socket 151 is formed in fixture 140. Ball 150 and socket 151 are swiveled to together in that they pivotally interlock, and sleeves 130 swivel or pivot at and between interlocking ball 150 and socket 151 about a pivot axis that runs centrally through fixtures 140 and 141 and the ball 150 and socket 151 joint. Gun rest assembly 20 holds poles 20A and 20B. Interlocking ball 150 and socket 151 form the pivot joint interconnecting sleeves 130 to permit adjustment of poles 20A and 20B in selected angular crossing positions.

Fixtures 140 and 141 extend through the respective bores 137 of gun rest components 122 and 123 and project outwardly from the opposed outer sides of the respective sleeves 130 and are free to concurrently displace relative to poles 20A and 20B through bores 137 in reciprocal directions indicated by double arrowed line E in FIG. 15 between an unclamped position locating poles 20A and 20B in enlarged parts 144A and 145B of openings 144 and 145 in FIG. 15, respectively, and a clamped position locating poles 20A and 20B in narrowed parts 144B and 145B of openings 144 and 145 in FIG. 16. In response to the concurrently movement of fixtures 140 and 141 from the unclamped position to the clamped position, poles 20A and 20B translate past the respective waists 144C and 145C from enlarged parts 144A and 145A of the corresponding openings 144 and 145 to the narrowed parts 144B and 145B of the corresponding openings 144 and 145 and are snap-received in narrowed parts 144B and 145B. In response to the concurrently movement of fixtures 140 and 141 from the clamped position to the unclamped position, poles 20A and 20B translate past waists 144C and 145C of the corresponding openings 144 and 145 from narrowed parts 144B and 145B of the corresponding openings 144 and 145 to the enlarged parts 144A and 145A of the corresponding openings 144 and 145 and are snap-received in enlarged parts 144A and 145A.

In the clamped position of locking fixtures 140 and 141 with poles 20A and 20B applied to narrowed parts 144B and 145B of the corresponding openings 144 and 145 so as to be snap-received in narrowed parts 144B and 145B past waist parts 144C and 145C, narrowed parts 144B and 145B bite directly against the exterior cross sections of the corresponding poles 20A and 20B to clamp and secure poles 20A and 20B thereby clamping sleeves 130 to the corresponding poles 20A and 20B restricting relative reciprocal movement of poles 20A and 20B relative to sleeves 130 of gun rest components 122 and 123, respectively, of gun rest assembly 120. With sleeves 130 so clamped in place in FIG. 16, the pivot joint between sleeves 130 and 131 permits a user to deploy or spread poles 20A and 20B apart to selected crossing positions and to use gun rest assembly 120 to support a rifle barrel. In the unclamped position of locking fixtures 140 and 141 in FIG. 15 with poles 20A and 20B applied to enlarged parts 144A and 73A of the corresponding openings 144 and 145 so as to be snap-received in enlarged parts 144A and 145A past waist part 144C and 145C, enlarged parts 144A and 145B release poles 20A and 20B to permit relative reciprocal adjustment between sleeves 130 of gun rest components 122 and 123 and poles 20A and 20B to adjust gun rest components 122 and 123 to selected positions along the longitudinal axes or lengths of poles 20A and 20B. Fixtures 140 and 141 are moved between their clamped and unclamped positions by hand simply by exerting opposed forces against poles 20A and 20B and fixtures 140 and 141. Pole 20A and gun rest component 122 can be moved reciprocally to clamp and unclamp pole 20A relative to gun rest component 122 independently of pole 20B and gun rest component 123. This permits pole 20A and gun rest component 122 to be clamped and unclamped independently of pole 20B and gun rest component 123, and vice versa.

Figure 17:
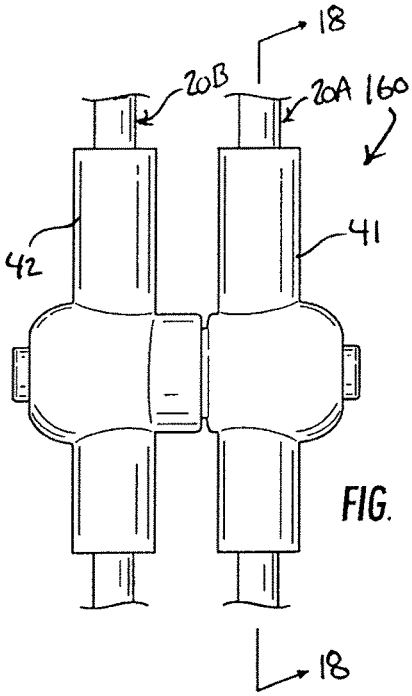
FIG. 17 is a view similar to that of FIG. 9 illustrating an alternate embodiment of a gun rest assembly mounted on poles to form a shooting rest.

FIG. 17 shows another embodiment of a gun rest assembly 160 that, in common with gun rest assembly 40, shares gun rest components 41 and 42 mounted to poles 20A and 20B to form a shooting rest. Gun rest assembly 160 is the same as gun rest assembly 40 in overall external shape and function for holding poles 20A and 20B in selected angular relationships or, in other words, selected angular crossing positions, and at selected longitudinal locations along the longitudinal axes or lengths of poles 20A and 20B. The depiction of gun rest assembly 160 in FIG. 17 is presented for reference purposes in connection with the ensuing discussion.

Gun rest components 41 and 42 through which poles 20A and 20B extend each include an alternate embodiment of a clamp assembly for clamping and unclamping the respective poles 20A and 20B. The clamping assemblies of gun rest components 41 and 42 are identical in gun rest assembly 160, and the details of just one clamp assembly will now be discussed in conjunction with gun rest component 41 with the understanding that the ensuing discussion applies equally to the clamp assembly of gun rest component 42 of gun rest assembly 160.

Figure 18:
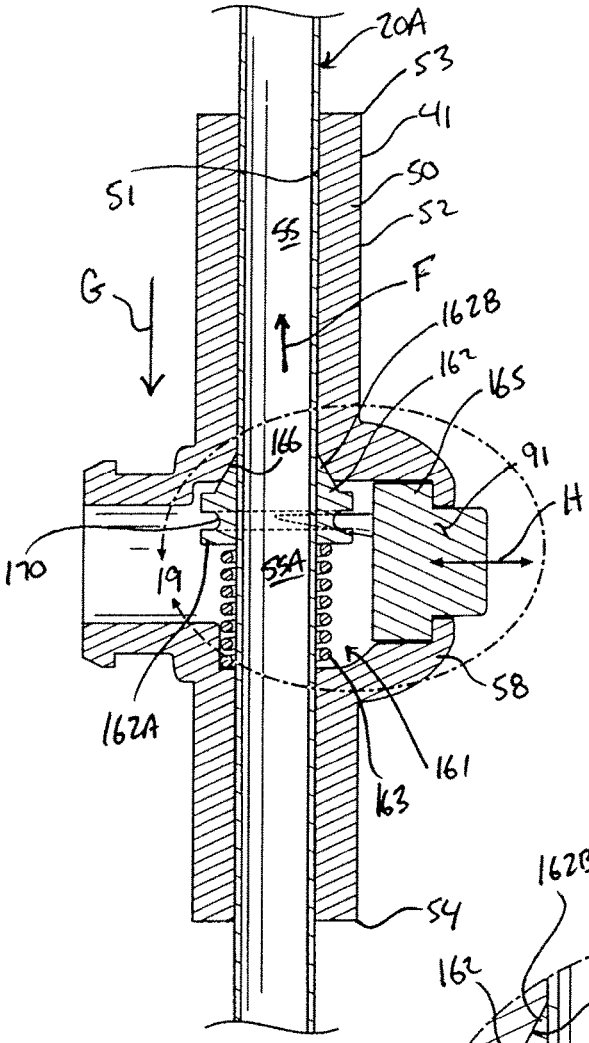
FIG. 18 is a section view taken along line 18-18 of FIG. 17 illustrating a clamp assembly as it would appear in a clamped position clamping a gun rest component of the gun rest assembly to a pole.
Figure 19:
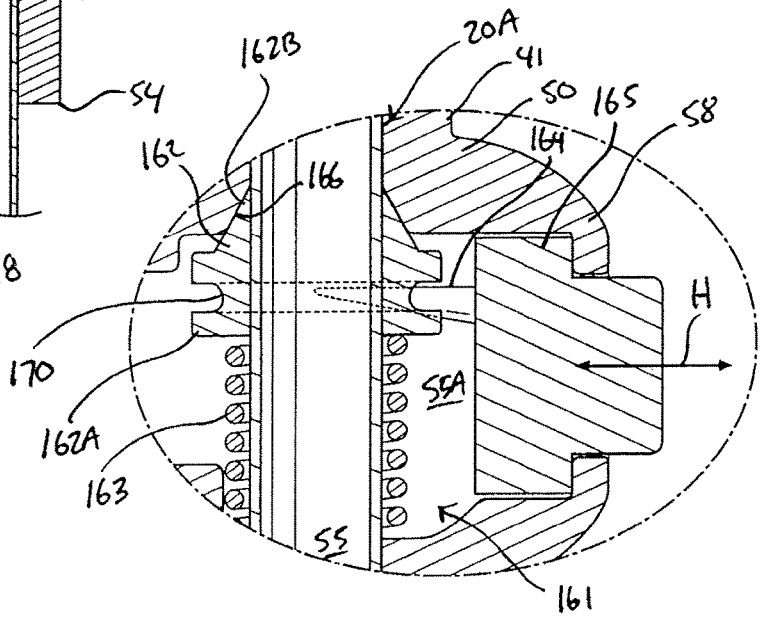
FIG. 19 is an enlarged view of a circled portion of the embodiment depicted in FIG. 18.
Figure 20:
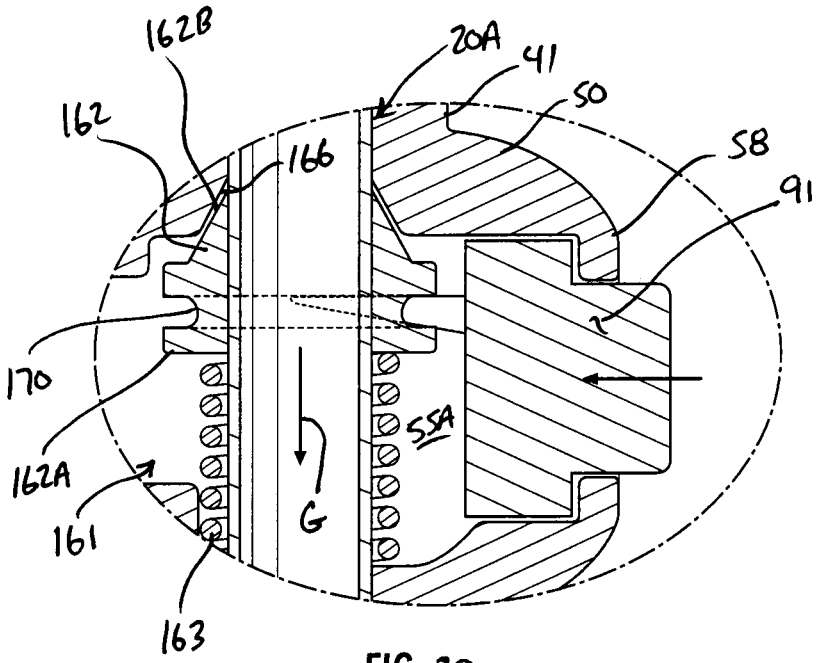
FIG. 20 is a view similar to that of FIG. 19 illustrating the clamp assembly as it would appear in an unclamped position releasing the gun rest component from the pole.

In FIGS. 18-20 clamp assembly 161 is enclosed in cavity 55A of channel 55 in the interior of gun rest component 41 of gun rest assembly 160. Enclosed in gun rest component 41 of gun rest assembly 160 clamp assembly 161 is protected from becoming damaged and rendered in operable through exposure to external influences. Clamp assembly 161 includes collet 162, spring 163, cam 164 formed in button 165, and chamfer 166. Button 165 extends into cavity 55A of channel 55 through opening 91 in the outer side of middle 58 of sleeve 50 to cam 164 enclosed in cavity 55A. Button 165 is enlarged in cavity 55A, which holds button 165 in cavity 55A and prevents it from falling outwardly through opening 91. Cam 164 interacts with collet 162 enclosed in cavity 55A. Button 165 is pressed and released so as to be moved in reciprocal directions, as indicated by double arrowed line H in FIGS. 18 and 19, relative to channel 55 and the longitudinal axis or length of pole 20A. This concurrently moves cam 164 in reciprocal directions in the direction of arrowed line H, whereby cam 164 interacts with collet 162 producing corresponding reciprocal movement of collet 162 between a clamped position defining the clamped position of clamp assembly 161 and an unclamped position defining the unclamped position of clamp assembly 161. Collet 162 and spring 163 circumscribe pole 20A.

Collet 162 has a butt end 162A and an opposed tapered end 162B directed toward an annular chamfer 166 formed in sleeve 50 in cavity 55A of channel 55. Collet 162 reciprocates along the longitudinal axis or length of pole 20A between clamped and unclamped positions relative to chamfer 166 as indicated by opposed arrowed lines F and G in FIG. 18, which directions are orthogonal with respect to the direction of reciprocal movement of button 165 and cam 164 indicated by double arrowed line H.

Spring 163 is captured between butt end 162A of collet 162 and an opposed inner surface portion of sleeve 50 in cavity 55A opposite to chamfer 166. Spring 163 is outwardly biased and constantly biases collet 162 in the direction of arrowed line F into a clamped position to forcibly exert tapered end 162B against chamfer 166, which tightens tapered end 162B of collet 162 around pole 20A to grip and clamp pole 20A, which restricts pole 20A from moving in reciprocal directions through sleeve 50 and, more particularly, which restricts gun rest assembly 41 from moving in a downward direction along pole 20A in the direction of arrowed line G, which is the direction that a firearm, such as a rifle, is set against gun rest assembly 160 in preparation for shooting. The more downward force is applied to sleeve 50 in the direction of arrowed line G, the more collet 162 and chamfer 166 are forced together and the stronger collet 162 grips and clamps 20A, which is the direct result of the interaction between tapered end 162B of collet 162 and chamfer 166 formed in sleeve 50. To release or unclamp sleeve 50 from pole 20A to allow relative reciprocal movement between pole 20A and gun rest component 41, collet 162 and chamfer 166 need only be moved apart to place collet 162 in an unclamped position to disengage collet 162 from chamfer 166 in FIG. 20, and this is done via the interaction between cam 164 and collet 162, enclosed in cavity 55A.

Button 165 is mounted to sleeve 50 for reciprocal movement in the direction of double arrowed line H in FIGS. 18 and 19 between a clamped position in FIGS. 18 and 19 and an unclamped position in FIG. 20. Because cam 164 is carried by button 165, cam 164 is, in turn, mounted for reciprocal movement relative to pole 20A in the direction of double arrowed line H between an unclamped position away from pole 20A in FIG. 20 and a clamped position toward pole in FIGS. 18 and 19. In response to moving cam 164 enclosed in cavity 55A in reciprocal directions indicated by arrowed line H in FIGS. 18 and 19 between its clamped and unclamped positions, the interaction between cam 164 and collet 162 enclosed in cavity 55A urges corresponding movement of collet in reciprocal directions relative to chamfer 166 in the directions of arrowed lines F and G in FIG. 18 between clamped and unclamped positions of collet 162. The interaction between cam 164 and collet 162 enclosed in cavity 55A is an operative coupling between cam 164 and collet 162, whereby movement of cam 164 between its clamped and unclamped positions via movement of button 165 between its clamped and unclamped positions urges corresponding reciprocal movement of collet 162 between its clamped and unclamped positions.

Figure 21:
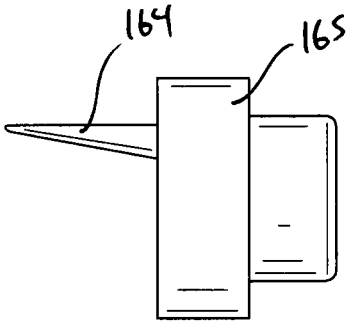
FIG. 21 is a side elevation view of a button of the gun rest assembly of FIGS. 17-20.
Figure 22:
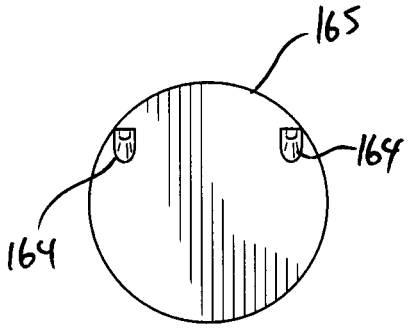
FIG. 22 is a front elevation view of the embodiment of FIG. 21.
Figure 23:
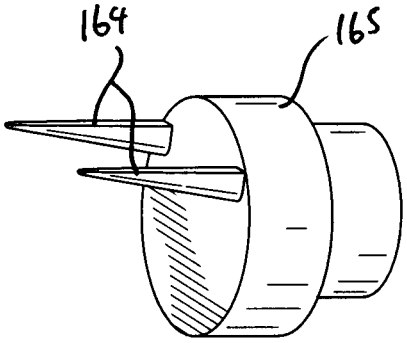
FIG. 23 is a perspective view of the embodiment of FIG. 21.

Annular recess 170 is formed in butt end 162A of collet 162 into which cam 164 is received. In FIGS. 21-23, cam 164 consists of opposed extensions or fingers, which taper outwardly from button 165. These fingers are on either side butt end 162A of collet 162 on either side of pole 20A and are applied to, and interact with, annular recess 170 to form the operative coupling between cam 164 and collet 162. Cam 164 is formed in button 165, which is mounted to sleeve 50 for movement in reciprocal directions indicated by double arrowed line H in FIGS. 18 and 19 that is perpendicular or otherwise orthogonal with respect to the longitudinal axis or length of pole 20A and the directions of arrowed lines F and G in FIG. 18 between its released or unclamped position in a direction away from pole 20A and collet 162, and its opposite depressed or clamped position toward pole 20A and collet 162. In the released and clamped position of button 165 and thus of cam 164 in FIGS. 18 and 19, collet 162 is free from the influence of cam 164 allowing spring 163 to constantly bias collet 162 into its clamped position to clamp/lock sleeve 50 with respect to pole 20A. In the depressed and unclamped position of button 165 in FIG. 20, which is normally done by hand, button 165 and cam 164 are concurrently driven inwardly toward collet 162 bringing collet 162 under the influence of cam 164. Specifically, cam 164 is driven against recess 170 so as to act on recess 170 of collet 162 overcoming the bias applied by spring 163 to displace collet 162 in the direction of arrowed line G away from chamfer 166 and into the unclamped position of collet 162 unclamping sleeve 50 from pole 20A to allow mutual reciprocation between pole 20A and sleeve 50 along the longitudinal axis or length of pole 20A. To re-clamp sleeve 50 to pole 20A as in FIGS. 18 and 19, button 165 is simply released, which causes spring 163 to resume its influence against collet 162 urging collet 162 from its unclamped position back into its clamped position against chamfer 166, which, in turn, causes recess 170 of collet 162 to act against cam 164 concurrently urging cam 164 and button 165 back into the unclamped position.

Figure 24:
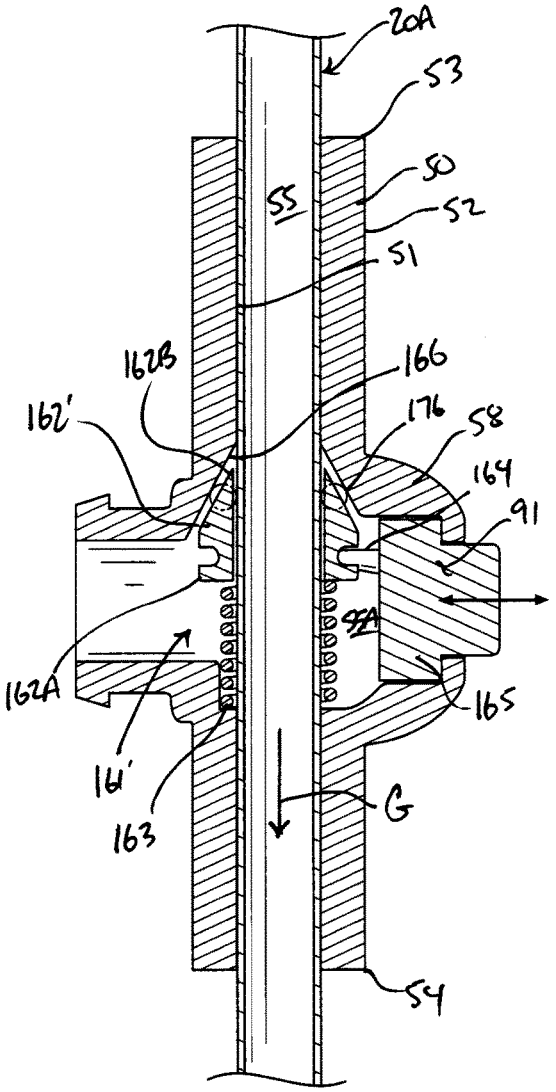
FIG. 24 is a view similar to that of FIG. 18 illustrating an alternate embodiment of a clamp assembly as it would appear in a clamped position clamping a gun rest component of a gun rest assembly to a pole.
Figure 25:
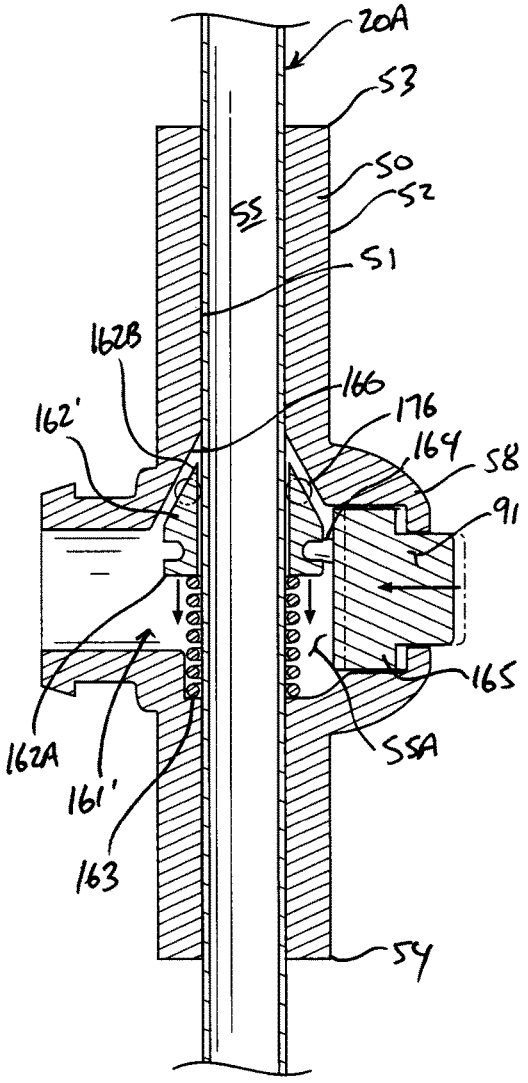
FIG. 25 is a view similar to that of FIG. 24 illustrating the clamp assembly as it would appear in an unclamped position releasing the gun rest component from the pole.
Figure 26:
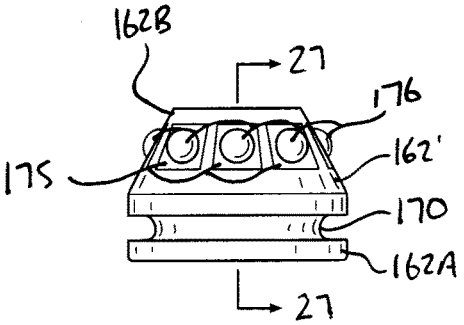
FIG. 26 is a side elevation view of a collet of the clamp assembly of FIGS. 24 and 25.

FIGS. 24 and 25 are views similar to that of FIG. 18 illustrating an alternate embodiment of a collet 162' in an alternate embodiment of a clamp assembly 161'. FIG. 24 illustrates clamp assembly 161' in a clamped position clamping gun rest component 41 of a gun rest assembly to pole 20A, and FIG. 25 illustrates clamp assembly 161' in an unclamped position unclamping gun rest component 41 of a gun rest assembly from pole 20A. Clamp assembly 161' is enclosed in gun rest component 41 so as to be protected from becoming damaged and rendered in operable through exposure to external influences. Clamp assembly 161' is identical to clamp assembly 161 in that it shares spring 163, cam 164, button 165, and chamfer 166. In common with collet 162, collet 162' in FIGS. 24-25 has butt end 162A formed with annular recess 170, tapered end 162B that is applied into annular chamfer 166 formed in sleeve 50. In collet 162', a bearing is formed in tapered end 162B. This bearing consists of an annular population of sockets 175 formed in tapered end 162B, and ball bearings 176 held in sockets 175. Bearings 176 held in sockets 175 circumscribe pole 20A. In FIG. 24, spring 163 is outwardly biased and normally biases collet 162' toward chamfer 166 into a clamped position exerting bearings 176 concurrently against chamfer 166 and pole 20A, which clamps bearings 176 around pole 20A to grip and clamp pole 20A like that of collet 162 but with bearings 176. To release or unclamp sleeve 50 from pole 20A to allow relative reciprocal movement between pole 20A and sleeve 50 in FIG. 25, collet 162' and chamfer 166 need only be moved apart to place collet 162' in an unclamped position so as to disengage bearings 125 of the bearing formed in tapered end 162B of collet 162' from chamfer 116, and this is done via cam 164 and button 165 discussed above in clamp assembly 161.

Figure 28:
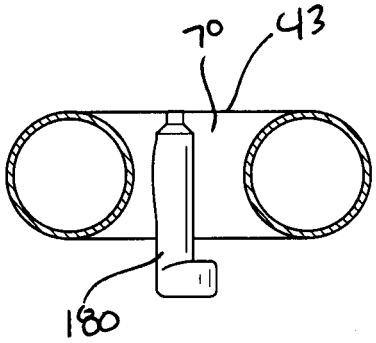
FIG. 28 is a highly generalized schematic representation of a cam lock for locking a rotating joint between sleeve assemblies of a gun rest assembly of a shooting rest constructed and arranged in accordance with the principle of the invention.
Figure 29:
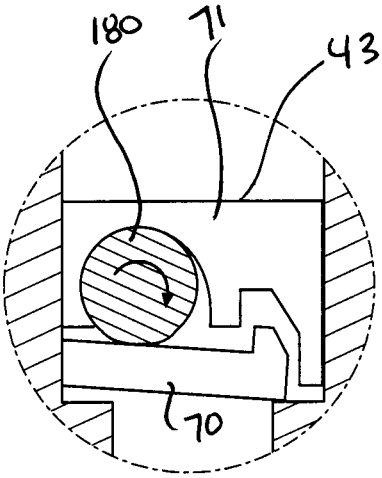
FIG. 29 is a highly generalized, enlarged, fragmented, vertical section view illustrating the cam lock of FIG. 28 shown as it would appear in a locked position locking a rotating joint.
Figure 30:
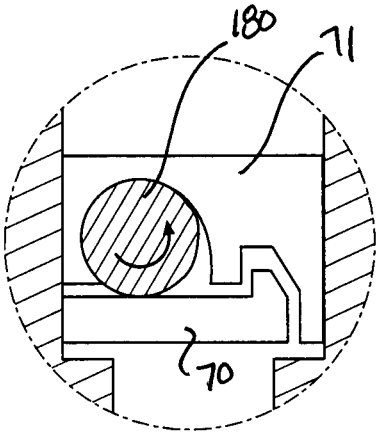
FIG. 30 is a view similar to that of FIG. 29 illustrating the cam lock as it would appear in an unlocked position releasing the rotating joint.

Swivel 43 discussed above in gun rest assembly 40 can be furnished with lock or clamp structures or the like for locking swivel 43. An example of such an embodiment is depicted in FIGS. 28-30 illustrating rotary cam 180 coupled between collars 70 and 71 (collar 71 not shown in FIG. 28). Rotary cam 180 is captured between collars 70 and 71 and rotates between an unlocked position in FIG. 30 to permit collars 70 and 71 to swivel relative to one another, and a locked position in FIG. 29 locking collars 70 and 71 together to resist swiveling. Cam 180 is an elongated, handled, rotating cam that rotates between collars 70 and 71 between its unlocked position in FIG. 30 and its locked position in FIG. 29. In the locked position in FIG. 29, cam 180 is forcibly exerted between collars 70 and 71 to restrain collars 70 and 71 from swiveling relative to each other. In the unlocked position in FIG. 30, collars 70 and 71 are free from the influence of cam 180 and are unrestrained for swiveling. Depending on the type of pivot joint employed, other forms of pivot locking mechanisms can be used without departing from the invention.

Figure 31:
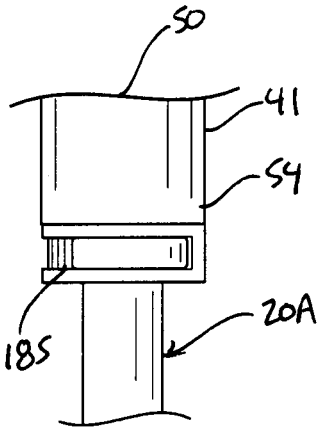
FIG. 31 is a fragmented side elevation view of an extremity of a gun rest component fashioned with a cam lever for locking the gun rest component to a pole.
Figure 32:
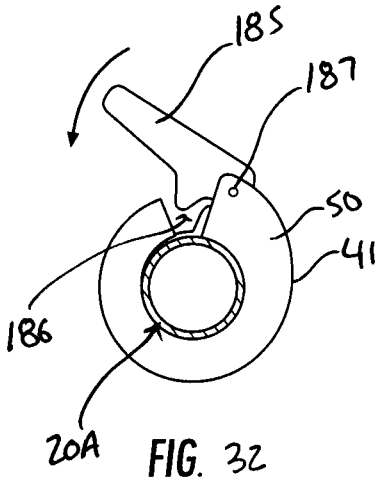
FIG. 32 is a top plan view of the cam lever of the embodiment of FIG. 31 shown as it would appear open releasing the gun rest component from the pole.
Figure 33:
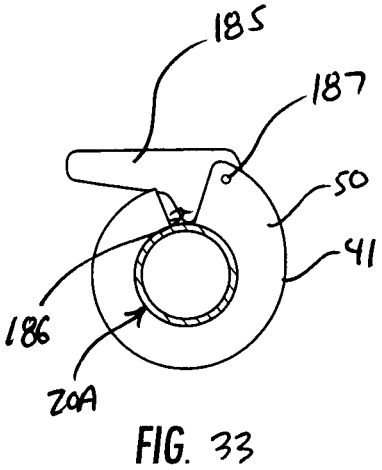
FIG. 33 is a view similar to that of FIG. 32 illustrating the cam lever as it would appear closed locking the gun rest component to the pole.

FIG. 31 is a fragmented side elevation view of an extremity of gun rest component 41 fashioned with a cam lever 185 for locking gun rest component 41 to pole 20A for restricting relative reciprocal movement between pole 20A and gun rest component 41. Cam lever 185 can be used with any of the gun rest assembly embodiments disclosed herein. The extremity of gun rest component 41 in this example is lower end 54 of sleeve 50 and upper end 53 can be formed with cam lever 185 in an alternate embodiment. FIG. 32 is a top plan view of cam lever 185 shown as it would appear open releasing the gun rest component 40 from pole 20A, and FIG. 33 is a view like that of FIG. 32 illustrating cam lever 185 as it would appear closed clamping gun rest component 41 to pole 20A. A pivot 187 in FIGS. 32 and 33 pivotally attaches cam lever 185 to lower end 54, which is formed with a cam-receiving opening 186 to pole 20A. Cam lever 185 pivots between an open position in FIG. 32 away from pole 20A defining an unlocked/unclamped position of cam lever 185, and a closed position in FIG. 33 toward pole 20 defining a locked/clamped position of cam lever 185. In the open position in FIG. 32, cam lever 185 is pivoted away from pole 20A and cam-receiving opening 186 unlocking/unclamping cam lever 185 from pole 20A to allow relative reciprocal movement between pole 20A and gun rest component 41. In the closed position of cam lever 185 in FIG. 33, cam lever 185 is pivoted in a direction toward pole 20A through cam-receiving opening 186 and is forcibly and frictionally engaged directly against the exterior of pole 20A so as to bite or frictionally secure/clamp pole 20A locking/clamping pole 20A to sleeve 50. Gun rest component 42 can be formed with cam lever 185 as well.

Figure 34:
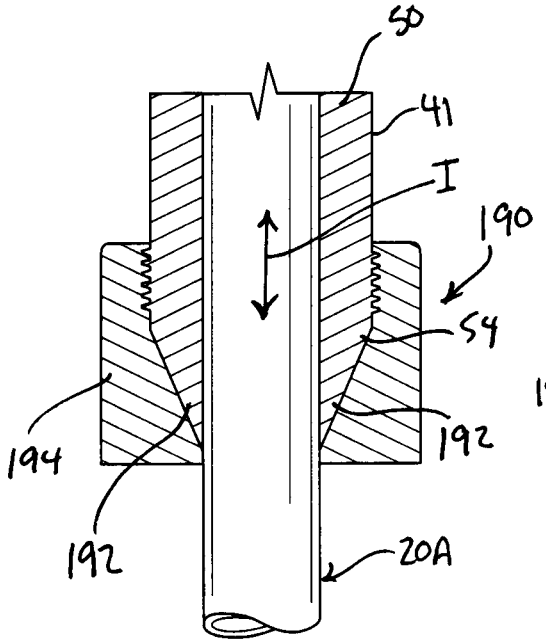
FIG. 34 is a fragmented side elevation view of a pole, and a sectioned view of a locknut assembly shown as it would appear locking an extremity of a gun rest component to the pole.

FIG. 34 is a fragmented side elevation view of pole 20A, and a sectioned view of a locknut assembly 190 for locking gun rest component 41 to pole 20A for restricting relative reciprocal movement between pole 20A and gun rest component 41. Locknut assembly 190 can be used with any of the gun rest assembly embodiments disclosed herein. In FIG. 34 locknut assembly is shown as it would appear locking an extremity of gun rest component 41 to pole 20A. The extremity of gun rest component 41 shown here is lower end 54 of sleeve 50 and upper end 53 can be formed with cam lever 185 in an alternate embodiment.

Figure 35:
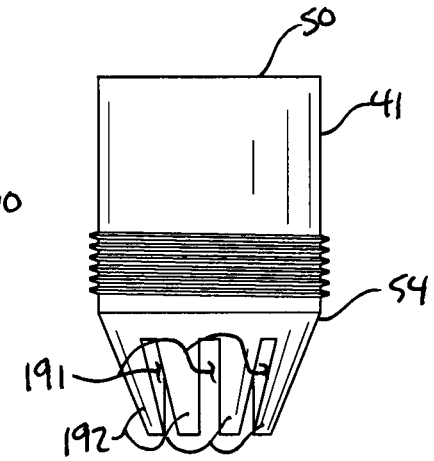
FIG. 35 is a side elevation view of the extremity of the gun rest component of the embodiment of FIG. 34.

FIG. 35 is a side elevation view of the extremity of the gun rest component of the embodiment of FIG. 34. Lower end 54 is forked in FIG. 35 being formed with alternating slots/gaps 191 and forklike branches 192, and is tapered downwardly toward pole 20A. The exterior of lower end 54 is externally threaded above slots 191 and branches 192. An internally-threaded locknut 194 concurrently circumscribes pole 20A and lower end 54, and is threaded onto lower end 54. Locknut 194 is adjustable via rotation in reciprocal directions as indicated by double arrowed line I in FIG. 34 between lowered and raised positions relative to lower end 54. In the lowered position of locknut 194, locknut 194 is in an unlocked/unclamped position loosened from the tapered, forked end of lower end 54. This loosens the tapered, forked lower end 54 from pole 20A allowing relative reciprocal movement between pole 30A of sleeve 50. In the raised position of locknut in FIG. 34, locknut 194 is in a locked/clamped position tightened against the tapered, forked lower end 54, which frictionally tightens the branches 192 of tapered, forked lower end 54 directly against pole 20A so as to bite or frictionally secure pole 20A locking/clamping pole 20A to sleeve 50 restricting relative reciprocal movement between pole 20A and sleeve 50. The forked configuration of the tapered, lower end 54 of sleeve 50 allows the forklike braches 192 to compress in the locked/clamped position of locknut 194 and to expand in the unlocked/unclamped position of locknut 194. Gun rest component 42 can be formed with this locknut assembly 190.

Figure 36:
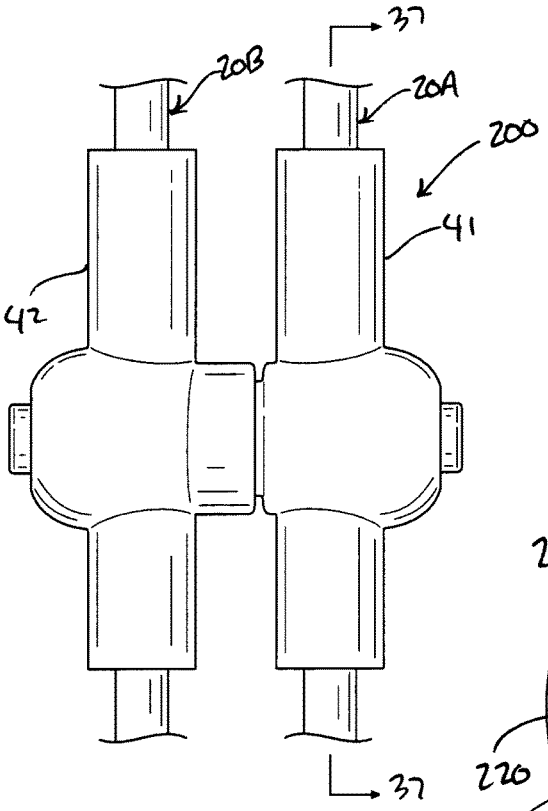
FIG. 36 is a view similar to that of FIG. 17 illustrating an alternate embodiment of a gun rest assembly mounted on poles to form a shooting rest.

FIG. 36 shows another embodiment of a gun rest assembly 200 that, in common with gun rest assembly 40, shares gun rest component 41 and 42 mounted to poles 20A and 20B to form a shooting rest. Gun rest assembly 200 is the same as gun rest assembly 40 in overall external shape and function for holding poles 20A and 20B in selected angular relationships or, in other words, selected angular crossing positions, and at selected longitudinal locations along the longitudinal axes or lengths of poles 20A and 20B. The depiction of gun rest assembly 200 in FIG. 36 is presented for reference purposes in connection with the ensuing discussion.

Gun rest components 41 and 42 of gun rest assembly 200 through which poles 20A and 20B extend each includes an alternate embodiment of a clamp assembly for clamping and unclamping the respective poles 20A and 20B. The clamping assemblies of gun rest components 41 and 42 are identical in gun rest assembly 200, and the details of just one clamp assembly will now be discussed in conjunction with gun rest component 41 with the understanding that the ensuing discussion applies equally to the clamp assembly of gun rest component 42 of gun rest assembly 200.

Figure 37:
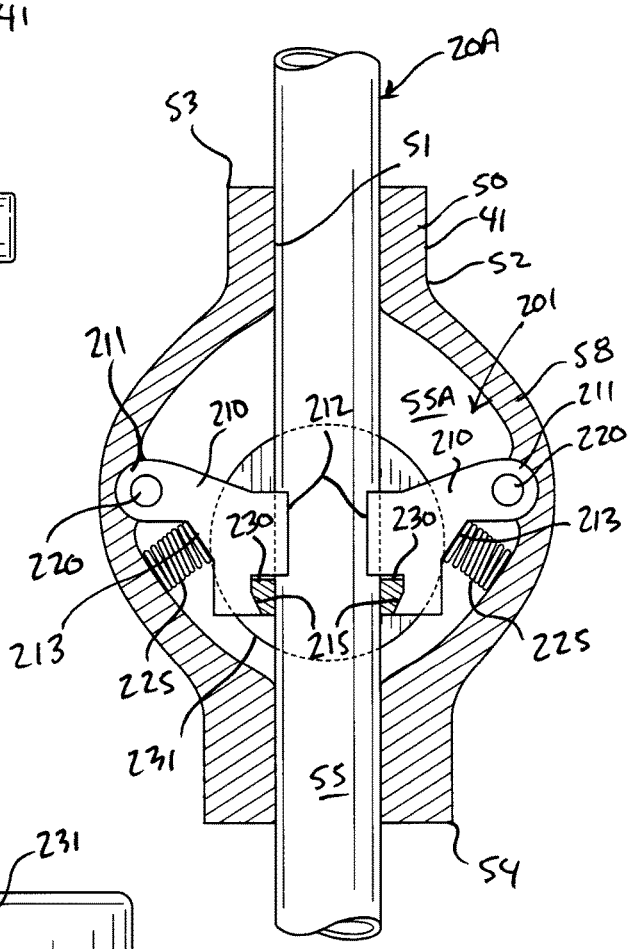
FIG. 37 is a section view taken along line 37-37 of FIG. 36 illustrating a clamp assembly as it would appear in a clamped position clamping a gun rest component of the gun rest assembly to a pole.
Figure 38:
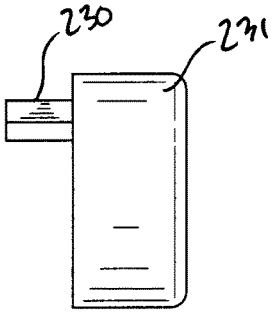
FIG. 38 is a side elevation view of a button of the clamp assembly of FIG. 37.
Figure 39:
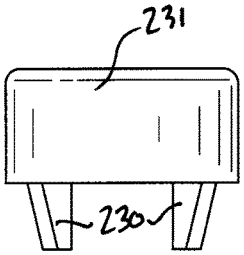
FIG. 39 is a top plan view of the embodiment of FIG. 38.
Figure 40:
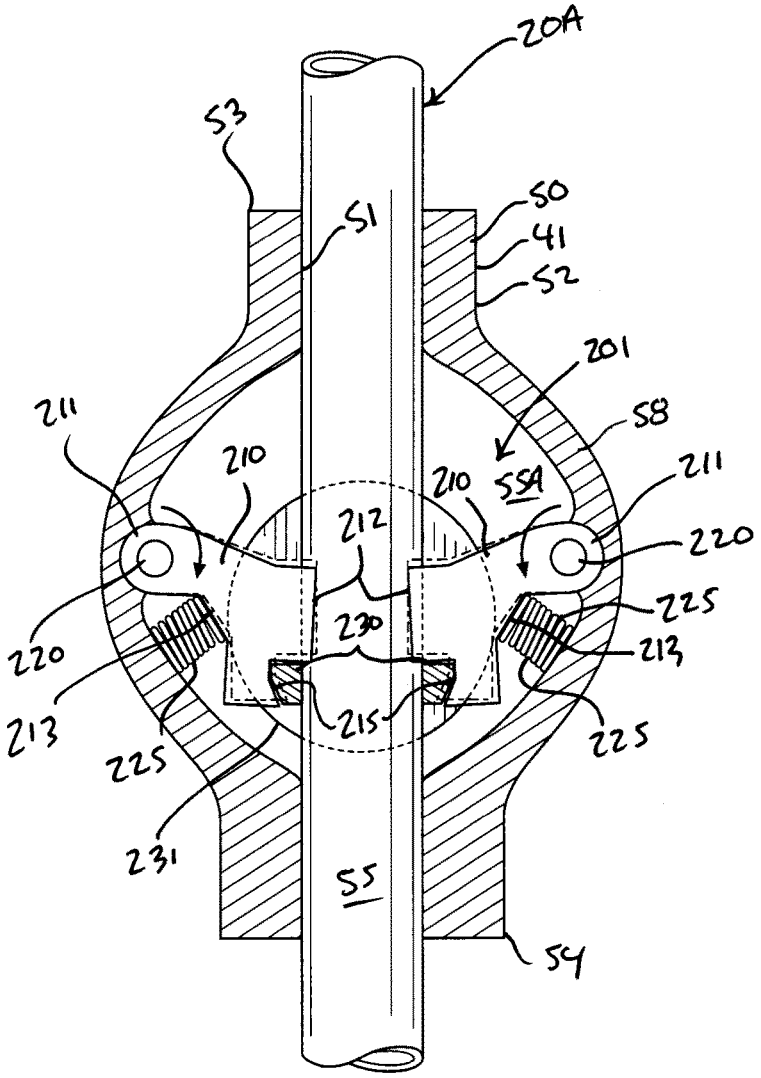
FIG. 40 is a view similar to that of FIG. 36 illustrating the clamp assembly as it would appear in an unclamped position releasing the gun rest component of the gun rest assembly from the pole.

In FIGS. 37 and 40, clamp assembly 201, which can also be referred to simply as a clamp, is enclosed in cavity 55A of channel 55 in the interior of gun rest component 41 of gun rest assembly 200. Enclosed in gun rest component 41 of gun rest assembly 200 clamp assembly 201 is protected from becoming damaged and rendered in operable through exposure to external influences. Pole 20A extends through channel 55. At middle 58 of sleeve 50 channel 55 is enlarged forming cavity 55A that encloses clamp assembly 201. Clamp assembly 201 includes a pair of opposed jaws 210 enclosed in cavity 55A on either side of pole 20A. Jaws 210 are diametrically opposed on either side of pole 20 and are the mirror image of one another. Jaws 210 are mounted to inner surface 51 of sleeve 50 in cavity 55A for movement between clamped positions in FIGS. 37 and 41 defining the clamped position of clamp assembly 201 clamping pole 20A therebetween restricting relative reciprocal movement between pole 20A and gun rest component, and unclamped positions in FIGS. 40 and 42 defining the unclamped position of clamp assembly 201 releasing pole 20A therebetween permitting relative reciprocal movement between pole 20A and gun rest component 41.

Jaws 210 each include an outer end 211 pivoted to inner surface 51 of sleeve 50 with a pivot pin 220, an opposed inner yoke end 212 confronting pole 20A, and a middle 213 therebetween. Yoke ends 212 are each shaped to relate to the external cross section of pole 20A. Jaws 210 pivot at pivot pins 220 between clamped positions clamping pole 20A by and between yoke ends 212 in FIGS. 37 and 41, and unclamped positions in FIGS. 40 and 42 unclamping pole 20A between yoke ends 212. A compression spring 225 is applied between inner surface 51 of sleeve 50 and middle 213 of each jaw 210. Springs 225 are enclosed in cavity 55A and act against inner surface 51 of sleeve 50 and the middles 213 of the respective jaws 210 constantly biasing or urging jaws 210 into their clamped positions in FIGS. 37 and 40. The direction of springs 2225, and the constant biases supplied by springs 225, between inner surface 51 of sleeve 50 and jaws 210 is upward toward upper end 53 of sleeve 50 away from lower end 54 of sleeve 50, and is oblique with respect to the longitudinal axis or length of pole 20.

Figure 41:
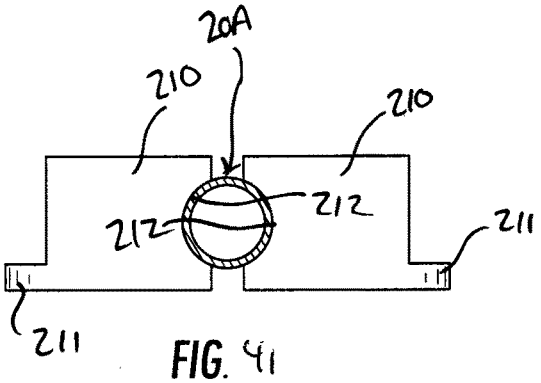
FIG. 41 is a schematic representation illustrating the clamp assembly as it would appear in the clamped position as in FIG. 37 clamping the gun rest component of the gun rest assembly to the pole.
Figure 42:
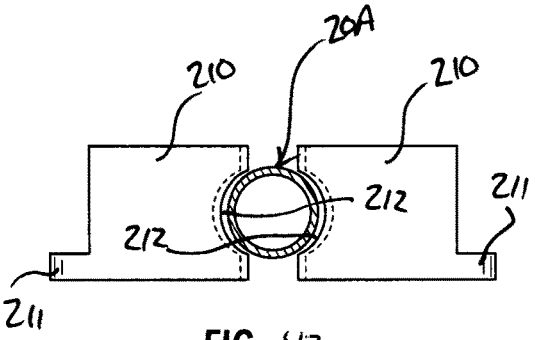
FIG. 42 is a schematic representation illustrating the clamp assembly as it would appear in the unclamped position as in FIG. 40 releasing the gun rest component of the gun rest assembly from the pole.

In the clamped positions of jaws 210 in FIGS. 37 and 41, yoke ends 212 are concurrently applied directly against either side of pole 20A, and are in direct frictional contact against the exterior cross section of either side of pole 20A.

Yoke ends 212 are shaped to relate to the exterior cross section of pole 20A to provide a close, intimate contact between yoke ends 212 and pole 20A in the clamped positions of jaws 210. In the unlocked position of jaws 212 in FIGS. 40 and 42, yoke ends 212 are pivoted downwardly toward lower end 54 of sleeve 50 and away from pole 20A and are released from pole 20A.

Figure 27:
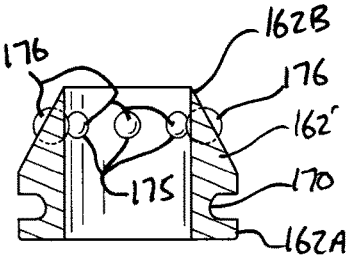
FIG. 27 is a section view taken along line 27-27 of FIG. 26.

The constant bias supplied by springs 225 constantly biases or urges jaws 212 into the clamped positions. In FIGS. 27 and 40, a cam 230 enclosed in cavity 55A interacts with jaws 212 enclosed in cavity 55A is used to overcome the bias of springs 225 to move jaws 212 back and forth between their clamped and unclamped positions.

Cam 230 is formed in button 231. Button 231 is mounted to sleeve 50 for reciprocal movement between a clamped position and an unclamped position. Because cam 230 is carried by button 231, cam 230 is, in turn, mounted for reciprocal movement relative to pole 20A between an unclamped position away from pole 20A and a clamped position toward pole. In response to moving cam 230 enclosed in cavity 55A in reciprocal directions between its clamped and unclamped positions, the interaction between cam 230 and jaws 210 enclosed in cavity 55A urges corresponding movement of jaws 210 between clamped and unclamped positions. The interaction between cam 230 and jaws 210 enclosed in cavity 55A is an operative coupling, whereby movement of cam 230 between its clamped and unclamped positions urges corresponding movement of jaws 210 between their clamped and unclamped positions.

Cam 230 consists of opposed extensions/fingers formed on either side of pole 20A between pole 20A and notched ends 215, respectively, which taper outwardly from button 231. Cam 230 is formed in button 231, which extends into cavity 55A through an opening in middle 58 of sleeve 50. Button 231 is mounted to sleeve 50 for movement in reciprocal directions relative to pole 20A between a released or unclamped position and a depressed or clamped position, such that cam 230 is, in turn, mounted for movement in reciprocal directions relative to pole 20A. The direction of reciprocal movement is parallel with respect the pivot axes about which jaws 212 pivot. In response to moving cam 230 enclosed in cavity 55A in reciprocal directions in response to moving button 231 in reciprocal directions, the interaction between cam 230 and notched extremities 215 enclosed in cavity 55A produces corresponding pivotal movement of jaws 210 between their clamped and unclamped positions. In the un-depressed or unclamped position of button 231 and thus of cam 230, in FIG. 37, notched extremities 215 are free from the influence of cam 230 allowing springs 225 to constantly bias the respective jaws 212 into the clamped position to clamp/lock sleeve 50 with respect to pole 20A. In the depressed position of button 231, which is normally done by hand, button 231 and cam 230 are concurrently driven inwardly toward pole 20A, whereby the fingers of cam 230 act on notched extremities 215 between pole 20A and notched extremities 215 bringing jaws 212 under the influence of cam 230. Specifically, cam 230 is driven against notched extremities 215 between pole 20A and notched extremities 215 overcoming the constant bias applied by springs 225 so as to notched extremities 215, and thus jaws 212, downwardly toward lower end 54 of sleeve 50 and outwardly away from pole 20A from their clamped positions in FIGS. 37 and 41 to their unclamped positions in FIGS. 40 and 42 unclamping sleeve 50 from pole 20A to allow mutual reciprocation between pole 20A and sleeve 50 along the longitudinal axis or length of pole 20A. To clamp sleeve 50 to pole 20A as in FIGS. 37 and 41, button 230 is released, which causes springs 225 to resume influence against jaws 212 urging jaws 212 from their unclamped positions back into their clamped positions, which, in turn, causes notched extremities 215 to act against cam 230 concurrently urging cam 230 and button 231 back into the unclamped position.

According to this disclosure, the bias supplied by springs 225 constantly biases jaws 212 into their clamped positions. Other spring forms and arrangements can be used to supply the described bias. As matter of example, coil springs can be applied around pivot pins 220 to supply the bias to jaws 212 if so desired.

Figures 43, 44, 45:
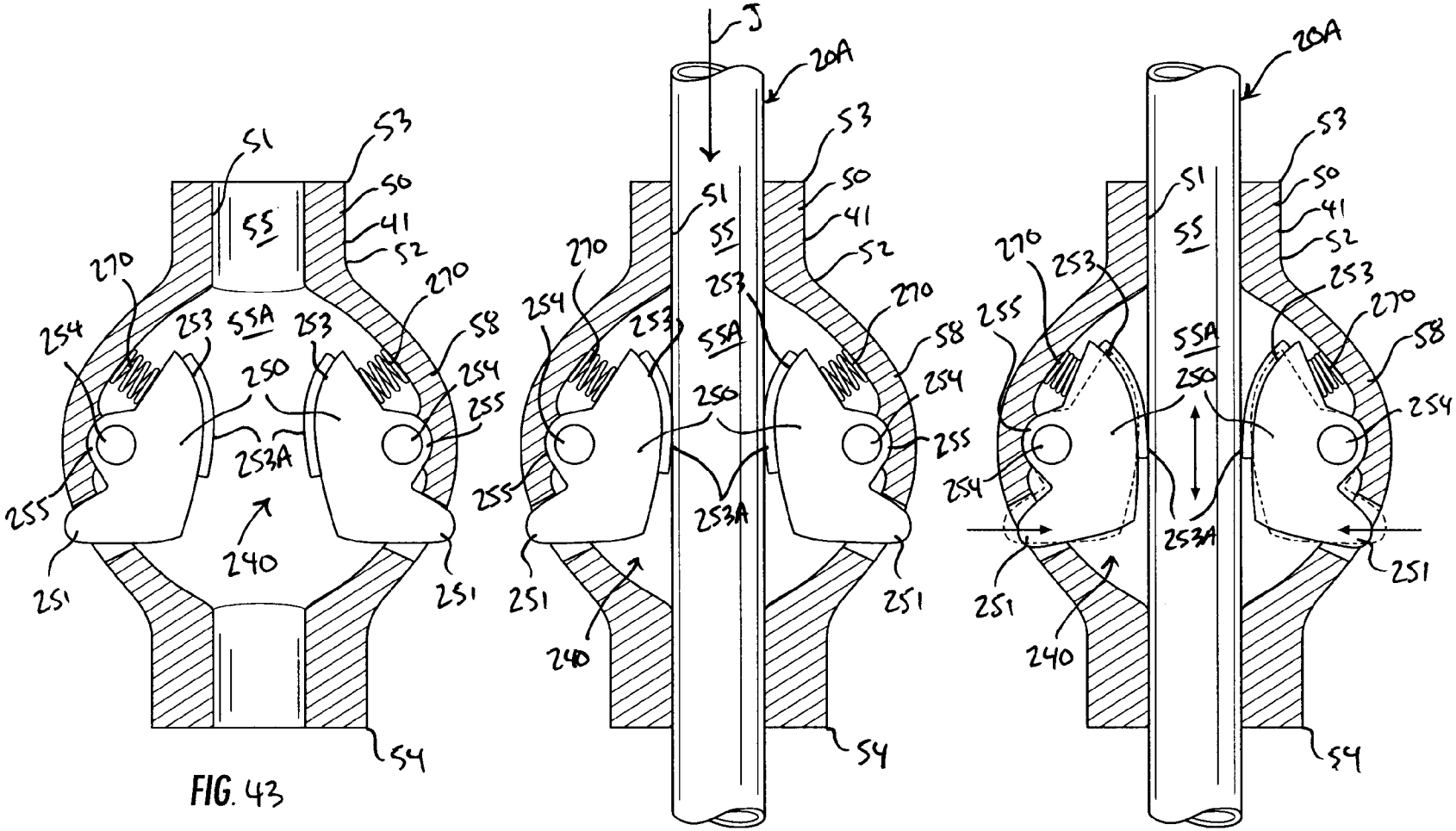
FIG. 43 is a view similar to that of FIG. 40 illustrating an alternate embodiment of clamp assembly of a gun rest component of a gun rest assembly.
FIG. 44 is a view similar to that of FIG. 43 illustrating a pole inserted through the gun rest component, and a clamp assembly as it would appear in a clamped position clamping the gun rest component to the pole.
FIG. 45 is a view similar to that of FIG. 44 illustrating the clamp assembly as it would appear in an unclamped position releasing the gun rest component from the pole.

FIG. 43 is a view similar to that of FIG. 40 illustrating an alternate embodiment of clamp assembly 240 of gun rest component 41 of a gun rest assembly. FIG. 44 is a view similar to that of FIG. 43 illustrating pole 20A inserted through gun rest component 41, and clamp assembly 240 as it would appear in a clamped position clamping gun rest component 41 to pole 20A for restricting relative reciprocal movement between pole 20A and gun rest component 41, and FIG. 45 is a view similar to that of FIG. 44 illustrating clamp assembly 240 as it would appear in an unclamped position releasing or unclamping gun rest component 41 from pole 20A to permit relative reciprocal movement between gun rest component 41 and pole 20A. In FIGS. 43-45, clamp assembly 240, which may also be referred to simply as a clamp, is enclosed in cavity 55A of channel 55 in the interior of gun rest component 41. Pole 20A extends through channel 55 in FIGS. 44 and 45, and at middle 58 of sleeve 50 channel 55 is enlarged forming cavity 55A that encloses clamp assembly 240.

Clamp assembly 240 is enclosed in cavity 55A in gun rest component 41 so as to be protected from becoming damaged and rendered in operable through exposure to external influences. Clamp assembly 240 includes jaws 250 enclosed in cavity 55A on either side of pole 20A in FIGS. 44 and 45. Jaws 250 are diametrically opposed on either side of cavity 55A and on either side of pole 20A as in FIGS. 44 and 45 and are the mirror image of one another. Each jaw 250 has an outer end 251 that extends through opening 260 in either side of middle 58 of sleeve 50, an opposed curved inner end 253 formed with a curved pad 253A, and a middle 255 pivoted to the inner surface 51 of sleeve 50 with a pivot pin 257. Jaws 250 pivot at the respective pivot pins 257 between clamped positions in FIG. 44 and unclamped positions in FIG. 45. The outer surface of pole 20A is tangential relative to the curved pad 253A of the curved inner end 253 of each jaw 250.

A compression spring 270 is positioned between inner surface 51 of sleeve 50 and each jaw 250 between middle 255 and inner end 253 above the pivot point at pivot pin 257. Springs 260 are enclosed in cavity 55A and act obliquely relative to the longitudinal axis or length of pole 20A and downwardly in the direction of lower end 54 of sleeve 50 between inner surface 51 of sleeve 50 contact points of the respective jaws 50 between curved inner end 253 and pivot pin 254 at middle 255 of each jaw 250 constantly biasing jaws 250 in the clamped positions. Again, the direction of spring 270, and the bias supplied by spring 270, between inner surface 51 of sleeve 50 and jaw 250 is downwardly, in the direction of lower end 54 of sleeve 50, and oblique with respect to the long axis of pole 20A.

In the clamped position of jaws 250 in FIG. 44, curved pads 253A of curved inner ends 253 are applied directly against the outer surface of pole 20A on either side of pole 20A so as to be in direct frictional contact against the outer surface of pole 20A. The outer surface of pole 20A is tangential to the curved pads 253A and the more downward force of pole 20A in the direction of arrowed line J in FIG. 44 only works to pivot jaws 250 further thereby pinching curved pads 253A even harder against pole 20A ever increasing the clamping force between curved pads 253A of curved inner ends 253 and the outer surface of pole 20. In the unclamped position of jaws 250 pivoted upwardly in FIG. 45 toward upper end 53 of sleeve 50, curved pads 253A of curved inner ends 253 are displaced in a direction upwardly and away from pole 20A in the direction of upper end 53 of sleeve 50 so as to be sufficiently relaxed or released from the outer surface of pole 20 to permit pole 20A to be moved through sleeve 50 in the direction of arrowed line K in FIG. 45.

In the clamped positions of jaws 250 in FIG. 44, curved pads 253A of curved inner ends 253 are concurrently applied directly against the outer surface of pole 20A on either side of pole 20A so as to each be in direct frictional contact against the outer surface of pole 20A and this clamps pole 20A by and between curved pads 253A of curved inner ends 253 restricting relative reciprocal movement between pole 20A and sleeve 50 and, more specifically, restricting pole 20A from sliding through sleeve 50 in the direction of arrowed line J in FIG. 44. Again, forcing pole 20A downwardly in the direction of arrowed line J only increases the pinching or clamping force between curved pads 253A of curved inner ends 253 and the outer surface of pole 20A due to the locations of the pivot points of jaws 250 at pivot pins 257 under the tangential contact points between the outer surface of pole 20A and curved pads 253A of curved inner ends 253 of jaws 250 and the oblique, downwardly biases supplied by springs 260. Forcing pole 20 upwardly in the direction of arrowed line K in FIG. 45, however, causes the outer surface of pole 20A to slide and act against the curved pads 253A of curved inner ends 253 of clamp bodies 251. This overcomes the bias supplied by springs 260 causing jaws 250 to partially pivotally displace upwardly, in the direction of upper end 53 of sleeve 50, and away from pole 20A so as to be sufficiently relaxed or released from the outer surface of pole 20A to allow pole 20A to slide upwardly through sleeve 50 in the direction of arrowed line K in FIG. 45. This is due to the locations of the pivot points of jaws 250 defined by pivot pins 257 under the tangential contact points between the outer surface of pole 20A and curved pads 253A of curved inner ends 253 of jaws 250 and the oblique, downward biases supplied by springs 260.

By holding jaws 250 in their unclamped positions in FIG. 45, curved pads 253A of curved inner ends 253 are concurrently held displaced in a direction upwardly toward upper end 53 of sleeve 50 and away from pole 20A so as to be sufficiently concurrently relaxed or released from the outer surface of pole 20A to unclamp pole 20A from sleeve 50 to permit relative reciprocal movement between pole 20A and sleeve 50. To pivot jaws 250 between their clamped and unclamped positions and to hold jaws 250 in their unclamped positions, outer ends 251 of jaws 250 extending through opening 260 can be depressed inwardly by hand toward pole 20A with a force sufficient to overcome the bias of springs 270 to pivot jaws 250 from their clamped positions in FIG. 44 to their unclamped positions in FIG. 45. By releasing outer ends 251, springs 270 resume their influence causing jaws 250 to pivot from their unclamped positions in FIG. 45 to their clamped positions in FIG. 44. A cam and button arrangement can be used to pivot jaws 250 between their clamped and unclamped positions if so desired as discussed in previous embodiments.

According to this disclosure, the bias supplied by springs 270 biases jaws 250 into their clamped positions. Other spring forms and arrangements can be used to supply the described bias. As matter of example, coil springs can be applied around pivot pins 257 to supply the bias to jaws 250 if so desired.

Figure 46:
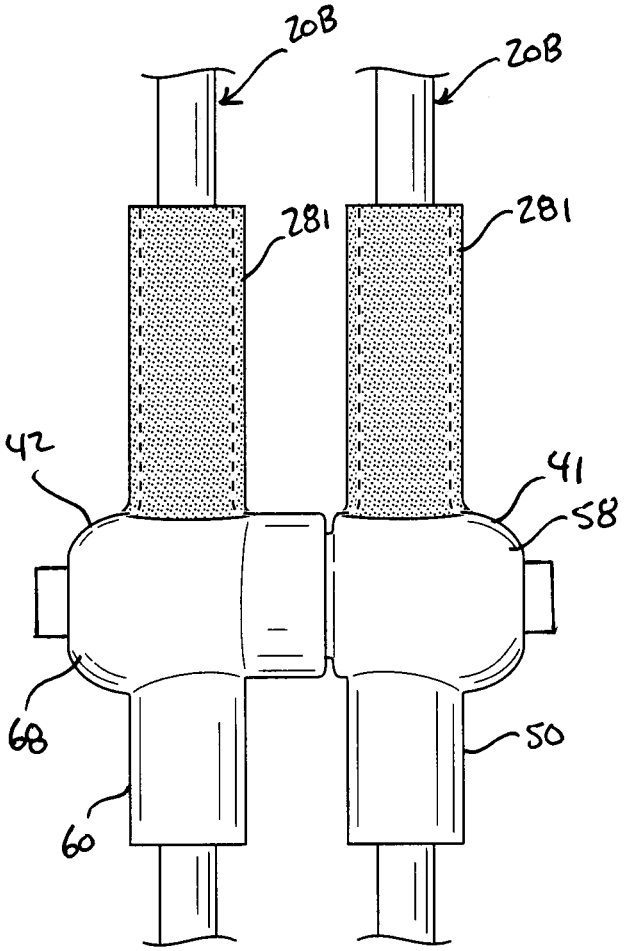
FIG. 46 is a view similar to that of FIGS. 17 and 36 illustrating an alternate embodiment of a gun rest assembly mounted on poles.

FIG. 46 is a view similar to that of FIGS. 17 and 36 illustrating an alternate embodiment of a gun rest assembly mounted on poles 20A and 20B. In FIG. 30 the gun rest assembly includes gun rest components 41 and 42 through which poles 20A and 20B extend. Any of the previously discussed clamp assemblies can be formed in gun rest components 41 and 42 for clamping and unclamping poles 20A and 20B of gun rest assembly 280. In FIG. 46 protective boots 281 are applied over the upper extremities of sleeves 50 and 60. Boots 281 circumscribe the upper extremities of sleeves 50 and 60 and extend between middles 58 and 68 and upper ends 53 and 63 of the respective sleeves 50 and 60. Boots 281 are formed of soft rubber, plastic, leather, or the like, to protect these portions of sleeves 50 and 60 and to protect the surface of a gun applied therebetween. Such boots 281 can be incorporated with any of the embodiments set forth in this disclosure.

Figure 47:
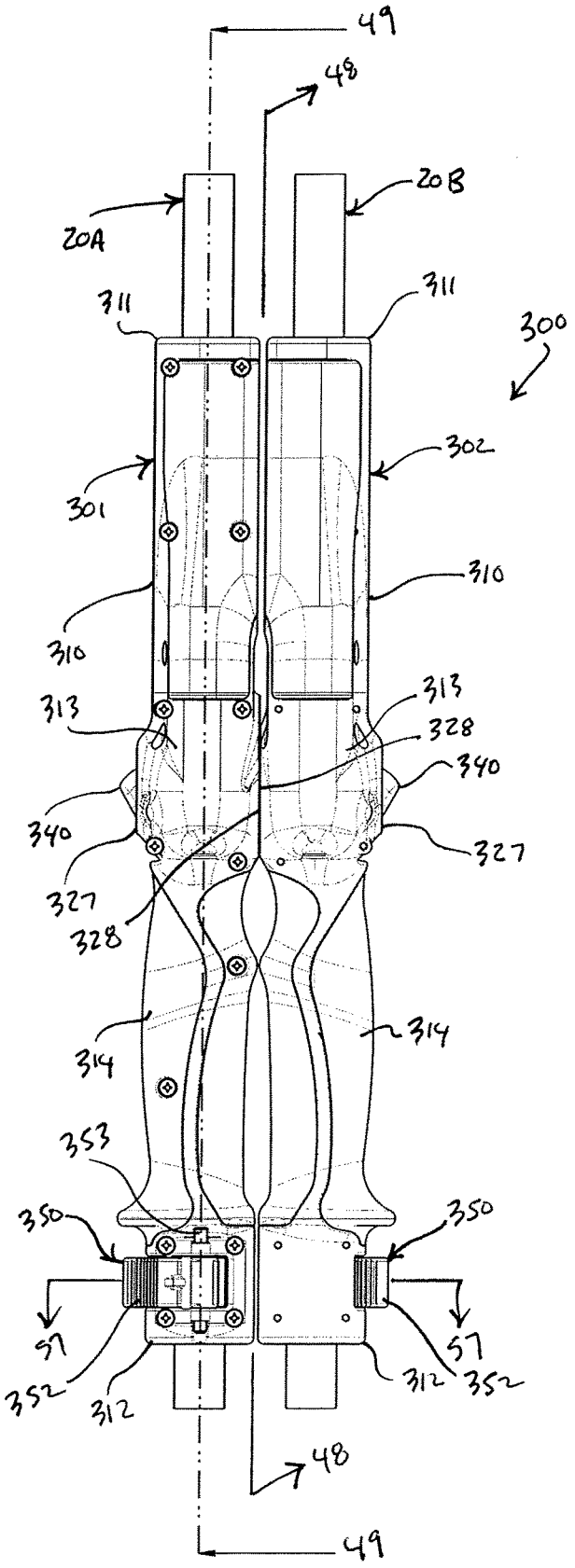
FIG. 47 is an enlarged, fragmented, front elevation view of a further embodiment of a gun rest assembly mounted on poles so as to form a shooting rest, the gun rest assembly includes rotatably connected slides each mounted reciprocally to one of the poles, each slide-and-pole combination being a pole assembly.

FIG. 47 is an enlarged, fragmented, front elevation view of another embodiment of a gun rest assembly 300 mounted on poles 20A and 20B so as to form a shooting rest. A weapon can be rested on gun rest assembly 300 of the shooting rest for stabilizing the weapon for improved aiming and accuracy as described in the previous embodiments. As in the previous embodiments, gun rest assembly 300 is mounted reciprocally to poles 20A and 20B for allowing gun rest assembly 30 to be reciprocally moved/adjusted along the lengths of poles 20A and 20B, and is adjustable into crisscrossed positions for adjusting and holding poles 20A and 20B in corresponding crisscrossed positions in preparation for resting a weapon on the crisscrossed gun rest assembly 300 for stabilizing the weapon for improved aiming and accuracy. Gun rest assembly 300 includes rotatably connected slides 301 and 302. Slide 301 is mounted reciprocally to pole 20A, and together form a first pole assembly of the shooting rest. Slide 302 is mounted reciprocally to pole 20B, independently of slide 301 and pole 20A pole assembly, and together form a second pole assembly of the shooting rest.

Figure 48:
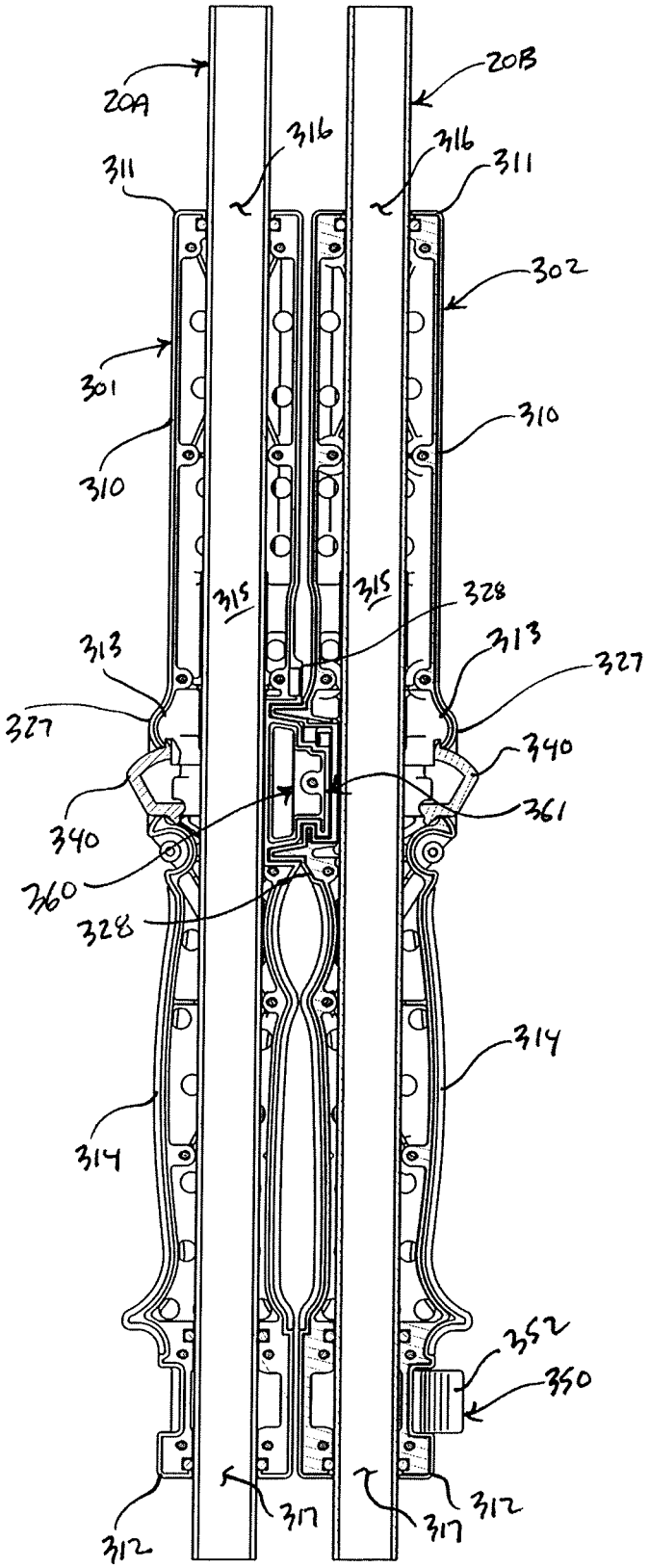
FIG. 48 is a section view taken along line 48-48 of FIG. 47.

Slides 301 and 302 are gun rest components of gun rest assembly 300. With the exception of the differences noted herein, slides 301 and 302 are identical, being identically sized and structured. In FIGS. 47 and 48, each one of slides 301 and 302 is a hollow sleeve 310. Sleeve 310, a housing, has upper extremity 311, lower extremity 312, middle 313 between upper extremity 311 and lower extremity 312, and handle 314. Handle 314, made and contoured specifically to be grasped or held by the hand, is between upper extremity 311 and lower extremity 312 and, more specifically, between middle 313 and lower extremity 312. In FIG. 48, channel 315 extends through the interior of sleeve 310 from opening 316 in upper extremity 311 to opening 317 in lower extremity 312. Pole 20A is received slidably through channel 315 of slide 301, and pole 20B is received slidably through channel 315 of slide 302. This allows slide 301 and pole 20A to reciprocate relative to each other, and allows slide 302 and pole 20B to reciprocate relative to each other. Each sleeve 310 is made of wood, metal, plastic, carbon fiber, fiberglass or other material or combination of materials having the properties of rigidity, flexibility, resilience, and impact resistance, and can be integrally formed, such as by molding or machining, or fashioned of a plurality of parts joined together with fasteners, such as screws, pins, welding, adhesive, etc.

Figure 49:
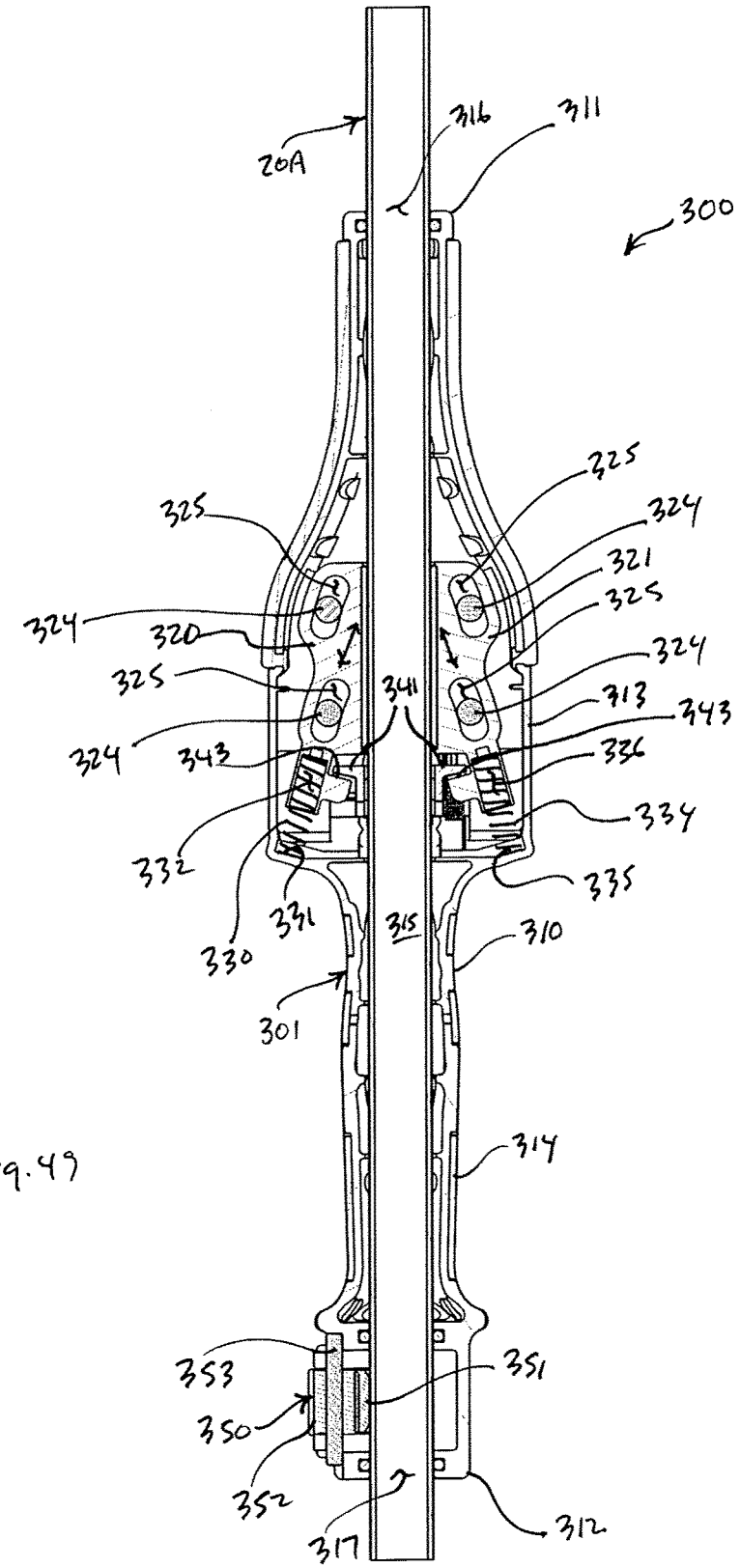
FIG. 49 is a section view taken along line 49-49 of FIG. 47 illustrating a clamp assembly of a slide of the shooting rest as it would appear closed gripping the pole for disabling the slide from moving reciprocally relative to the pole corresponding to the view of FIG. 48.

In FIG. 49, a section view of slide 301 taken along line 49-49 of FIG. 47, channel 315 is enlarged at middle 313 where a clamp assembly is housed. This clamp assembly is enclosed in sleeve 310 of slide 301 and is movable between a gripping or closed position for gripping pole 20A therebetween and a released or open position in FIG. 50 for releasing pole 20A therebetween. Slide 301 is disabled from moving reciprocally relative to pole 20A, in the gripping or closed position of the clamp assembly in FIG. 49. Slide 301 is enabled for moving reciprocally relative to pole 20A, in the released or open position of the clamp assembly in FIG. 50.

Figure 50:
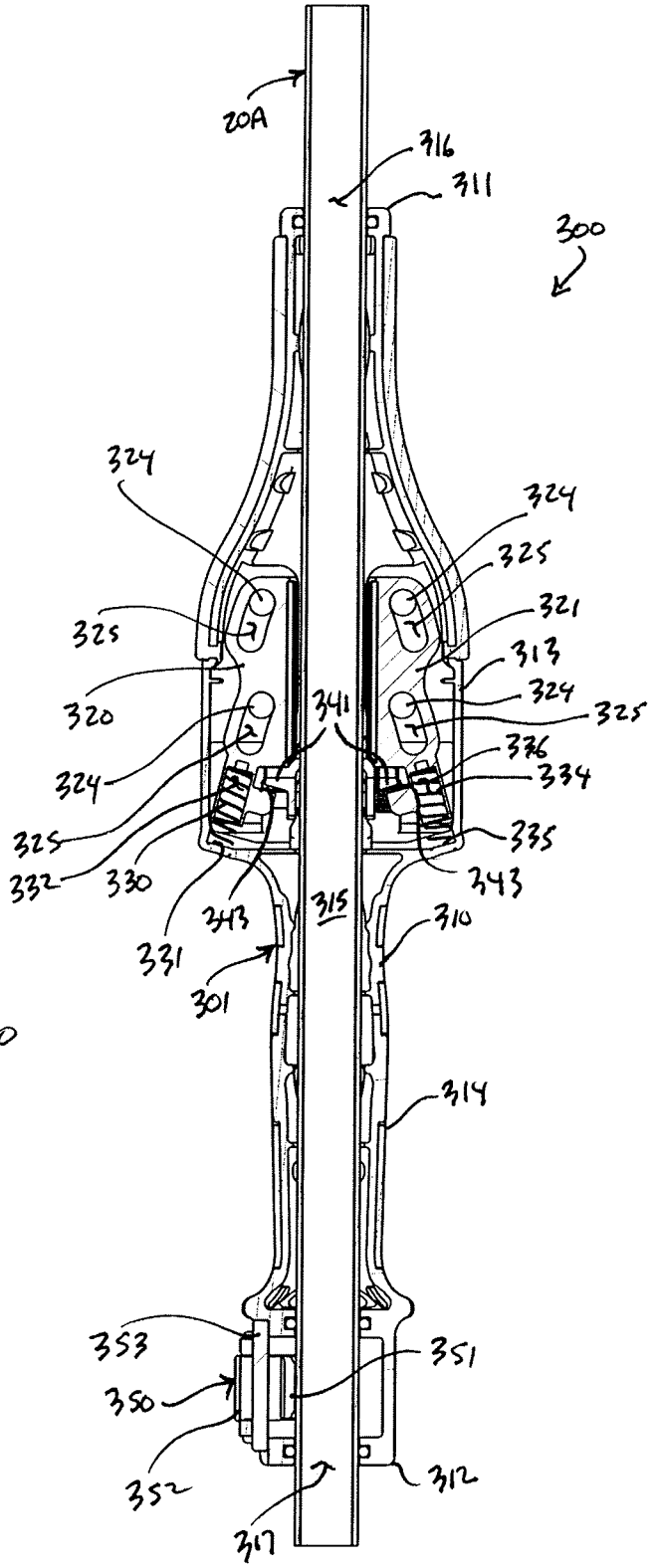
FIG. 50 is a view similar to that of FIG. 49 illustrating the clamp assembly as it would appear open releasing the pole for enabling the slide for moving reciprocally relative to the pole.
Figure 51:
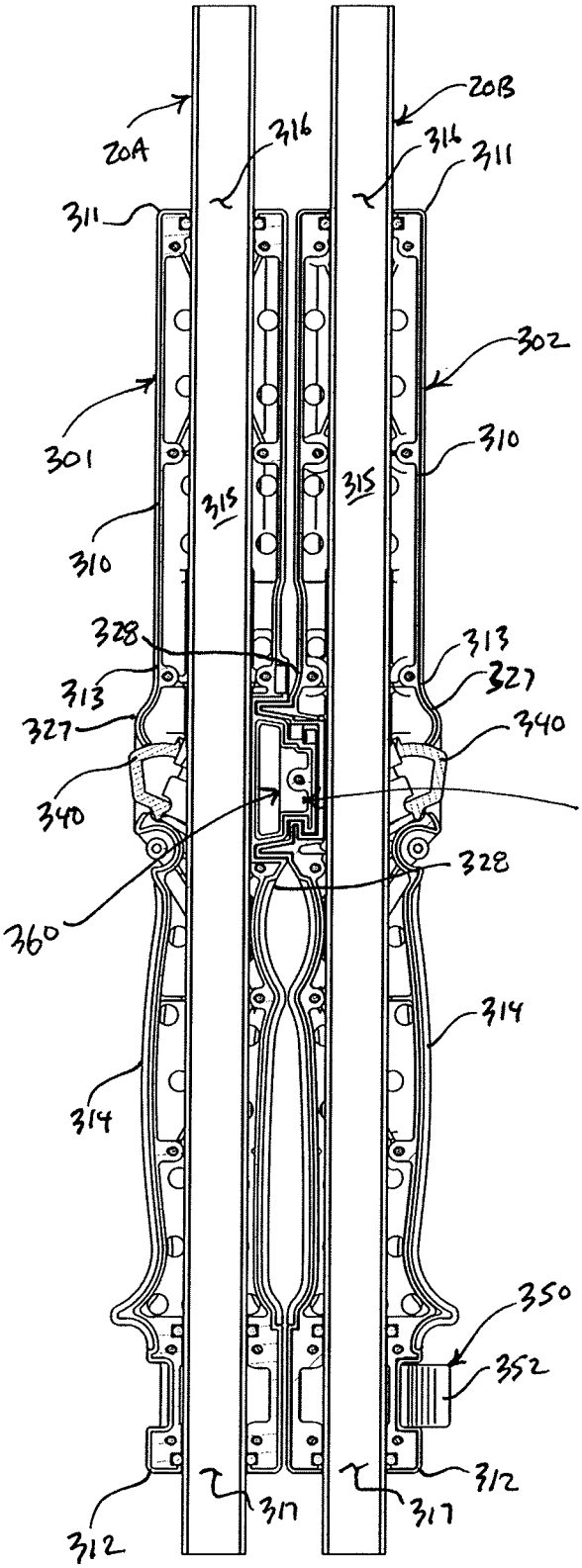
FIG. 51 is a view similar to that of FIG. 48 illustrating buttons of the slides as they would appear depressed corresponding to the view of FIG. 50.
Figure 52:
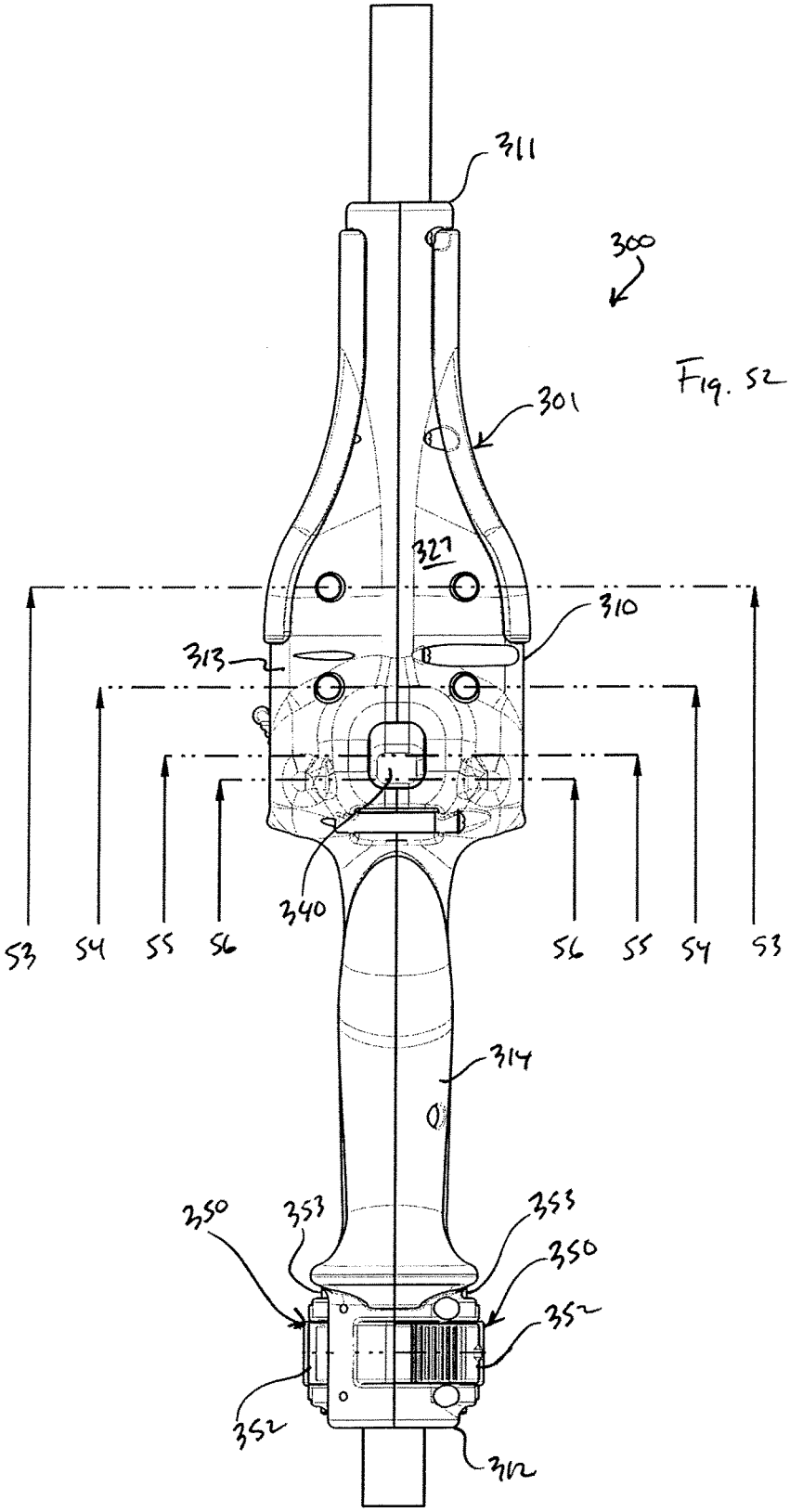
FIG. 52 is a side elevation view of the embodiment of FIG. 1.

In FIGS. 49 and 50, the clamp assembly includes two jaws 320 and 321 mounted reciprocally to slide 301 on either side of pole 20A for movement between gripping or closed positions in FIG. 49 for gripping pole 20A therebetween and released or open positions for releasing pole 20A therebetween. Slide 301 is disabled from moving reciprocally relative to pole 20A, in the gripping positions of jaws 320 and 321. Slide 301 is enabled for moving reciprocally relative to pole 20A, in the released or open positions of jaws 320 and 321.

Figure 53:
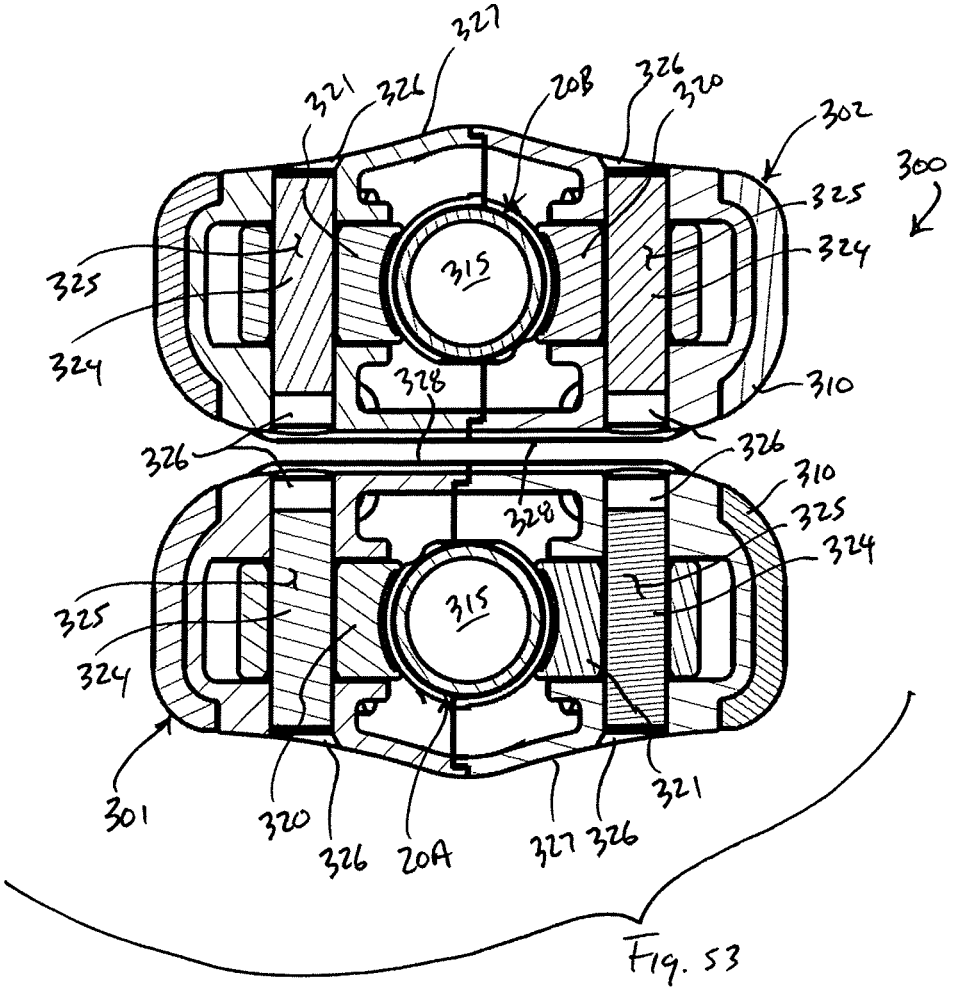
FIG. 53 is a section view taken along line 53-53 of FIG. 52.
Figure 54:
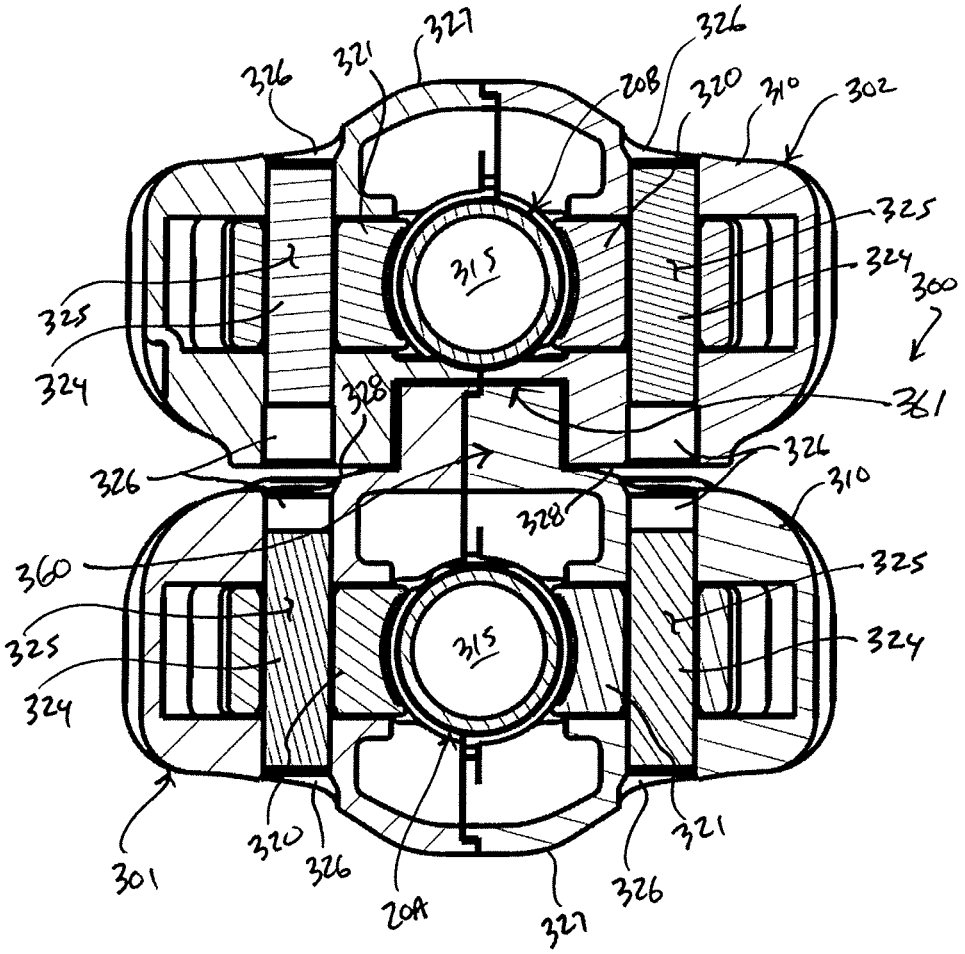
FIG. 54 is a section view taken along line 54-54 of FIG. 52.

Jaws 320 and 321 are identical, are diametrically opposed, are axially aligned, are parallel relative to one another, and extend upright in sleeve 310. Jaws 320 and 321 reciprocate obliquely, i.e. along respective oblique paths, relative to the long axis of pole 20A from the lowered released or open position in FIG. 49 away from pole 20A and upper extremity 311 of slide 301, and the raised gripping or closed position toward and against pole 20A and upper end 311 of slide 301. Jaws 320 and 321 are mounted reciprocally to slide 301 with two pin-and-slot assemblies, including an upper pin-and-slot assembly and a lower pin-and-slot assembly. In this example, each pin-and-slot assembly includes a pin 324 and a slot 325. Pin 325 is connected to sleeve 310 of slide 301, which extends through slot 325 through the corresponding jaw about which the corresponding jaw reciprocates. Pins 324 of the upper and lower pin-and-slot assemblies are located on either side of pole 20A. Pins 324 are fixed in place and are stationary. In this example, the opposed ends of pins 324 are retained in sockets 326 formed in front 327 and back 328 of sleeve 310 of slide 301. In FIGS. 49 and 50, slots 325 of jaw 320 are oblique relative to pole 20A, each extending downwardly and outwardly at an oblique angle of from 8-12 degrees relative to pole 20A in a direction from upper extremity 311 to lower extremity 312 of sleeve 310. Slots 325 of jaw 321 are likewise oblique relative to pole 20A, each extending downwardly and outwardly at an oblique angle of from 8-12 degrees relative to pole 20A in a direction from upper extremity 311 to lower extremity 312 of sleeve 310. The oblique angle of slots 325 and the interaction between slots 325 and pins 324 constrains jaws 320 and 321 to reciprocate obliquely relative to pole 20A. As a result, in the raised gripping or closed position toward and against pole 20A in FIG. 49, downward force applied to slide 301 in the direction from upper extremity 311 to lower extremity 312, such as by a user holding handle 314 and pushing downwardly, only works to pinch jaws 320 and 321 even harder against pole 20A ever increasing the clamping force between jaws 320 and 321 and the outer surface of pole 20A. In FIGS. 53 and 54, the gripping sides of jaws 320 and 321 are contoured, curved in this example, to relate to the contour of pole 20A, which is circular in this example. The gripping sides of jaws 320 and 321 are rubberized or padded to promote gripping when engaged against pole 20A.

In FIG. 49, jaws 320 and 321 are constantly tensioned with tension springs 330 and 334. Compression springs 330 and 334 are part of the clamp assembly and are enclosed in sleeve 310 of slide 301. Compression springs 330 and 334 constantly urge the respective jaws 320 and 321 toward their respective closed positions, and set jaws 320 and 321 into their closed positions until moved out of their closed positions via member 340 in FIGS. 47, 48, 51, and 52. Compression spring 330 is set at the same oblique angle as slots 325 of jaw 320 and is captured by and between inner surface 331 of sleeve 310 and socket 332 formed in a lower end of jaw 320, and compression spring 334 is set at the same oblique angle as slots 325 of jaw 321 and is captured by and between inner surface 335 of sleeve 310 and socket 336 formed in a lower end of jaw 321.

Slide 301 is disabled from moving reciprocally relative to pole 20A, in the closed positions of slide 301 jaws 320 and 321, and is enabled for moving in reciprocal directions relative pole 20A in the open positions of slide 301 jaws 320 and 321. Slide 302 is disabled from moving reciprocally relative to pole 20A, in the closed positions of slide 302 jaws 320 and 321, and is enabled for moving in reciprocal directions relative pole 20A in the open positions of slide 302 jaws 320 and 321. Slides 301 and 302 each have a member 340 used to move the corresponding jaws 320 and 321 between their closed positions and their open positions. Members 340 are identical. Member 340 will now be discussed in connection with slide 301, with the understanding that the ensuing discussion of member 340 of slide 301 applies equally to member 340 of slide 302.

Figure 55:
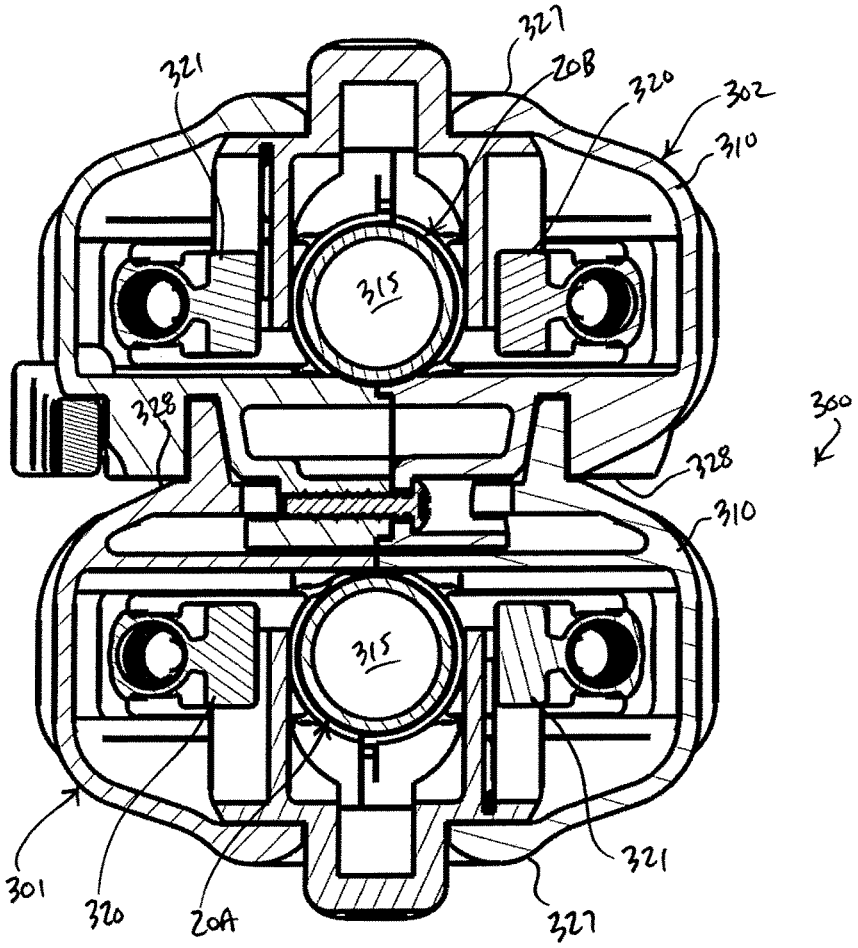
FIG. 55 is a section view taken along line 55-55 of FIG. 52.
Figure 56:
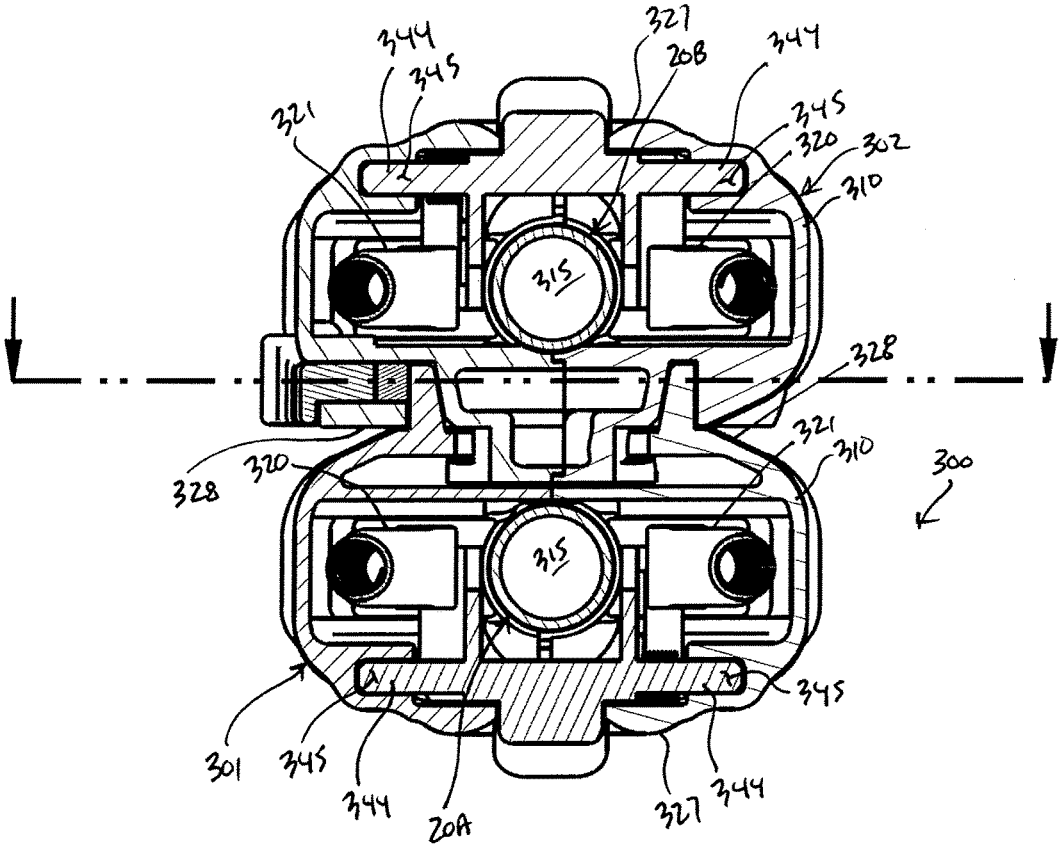
FIG. 56 is a section view taken along line 56-56 of FIG. 52.

In slide 301, member 340, which is a button positioned at middle 313 between upper extremity 311 of slide 301 and handle 314, extends into sleeve 310 of slide 301 through an opening in front 327 at middle 313 of sleeve 310 to opposed levers 341, on either side of pole 20A in FIGS. 55 and 56, which are applied to notches 343 in the respective jaws 320 and 321. Member 340 is mounted pivotally to sleeve 310 with pivot pins 344 in FIG. 56 for pivotal movement between a first or outer position in FIGS. 47, 48, and 55, and a second or inner position in FIGS. 51 and 56. Pivot pins 344 are part of member 340, and are received in opposed interior sockets 345 formed in sleeve 310. Jaws 320 and 321 are in their closed positions, in the first or outer position of member 340. Levers 341 pivot downwardly against notches 343 in response to movement of member 340 from the first or outer position of member 340 to the second or inner position of member 340 moving jaws 320 and 321 from their closed positions in FIG. 49 to their open positions in FIG. 50. Member 340 is moved from its first or outer position to its second or inner position via pressing by finger with a force sufficient to overcome the bias supplied by spring 330. Levers 341 pivot upwardly in response to movement of member 340 from the second or inner position of member 340 in FIG. 50 to the first or inner position of member 340 in FIG. 49 moving jaws 320 and 321 from their open positions in FIG. 50 to their closed positions in FIG. 49 via springs 330 and 334. Member 340 is moved from its second or inner position to its first or outer position by removing the pressing force against member 340. And so the interaction of levers 341 with notches 343 is an operative coupling, enclosed within slide 301, between member 340 and jaws 320 and 321, whereby jaws 320 and 321 move from the gripping/closed positions to the released/open positions, in response to movement of member 340 from its first/outer position to its second/inner position with a force sufficient to overcome springs 330 and 334, and jaws 320 and 321 move from the released/open positions to the gripping/closed positions, in response to movement of member 340 from its second/inner position to its first/outer position via springs 330 and 334. Button 340 is spring loaded, being spring-biased into its first/outer position. In FIG. 56, spring 348 encircles one of pins 344 and has tag ends that act against member 340 and sleeve 310, respectively, urging member 340 toward its first/outer position, which bias can be overcome with a pressing force applied against member 340 sufficient to overcome not only springs 330 and 334 but also spring 348. Spring 348 assists springs 330 and 334 in resetting member 340 to its first/outer position from its second/inner position. Member 340 can be pressed by the thumb of a user's hand concurrently gripping handle 324.

In FIG. 47, a slide lock 350 is mounted to each one of slides 301 and 302. Slide 301 is disabled from moving reciprocally relative to pole 20A, in a locked position of its slide lock 350, and slide 301 is enabled for moving reciprocally relative to pole 20A, in an unlocked position of its slide lock 350. Likewise, slide 302 is disabled from moving reciprocally relative to pole 20B, in a locked position of its slide lock 350, and slide 302 is enabled for moving reciprocally relative to pole 20B, in an unlocked position of its slide lock 350. Slide locks 350 can be used independently of each and of the clamp assemblies of the respective slides 301 and 302, and are useful for independently unlocking slides 301 and 302 from the respective poles 20A and 20B to enable selected reciprocal movement of slides 301 and 302 relative to the respective poles 20A and 20B, and are useful for independently locking slides 301 and 302 to the respective poles 20A and 20B to selectively disable reciprocal movement of slides 301 and 302 relative to the respective poles 20A and 20B.

Figure 57:
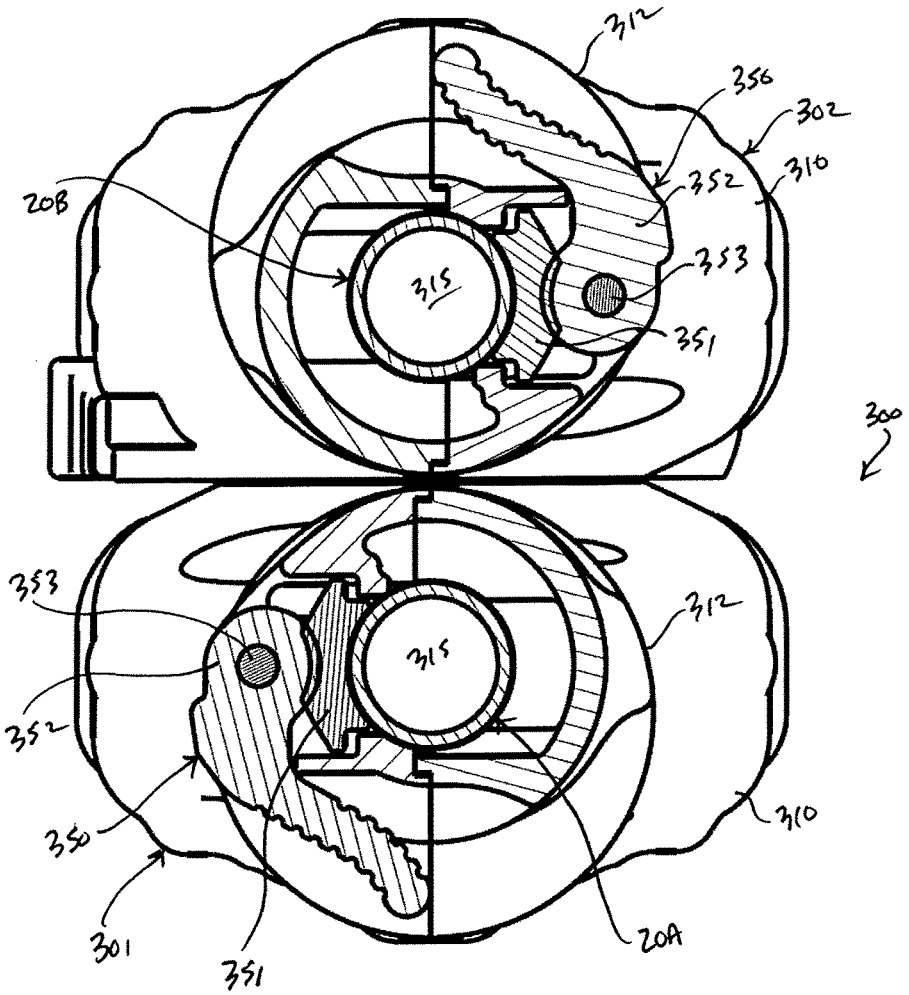
FIG. 57 is a section view taken along line 57-57 of FIG. 47 illustrating slide locks as they would appear locked for disabling the slides from moving reciprocally relative to the respective poles.
Figure 58:
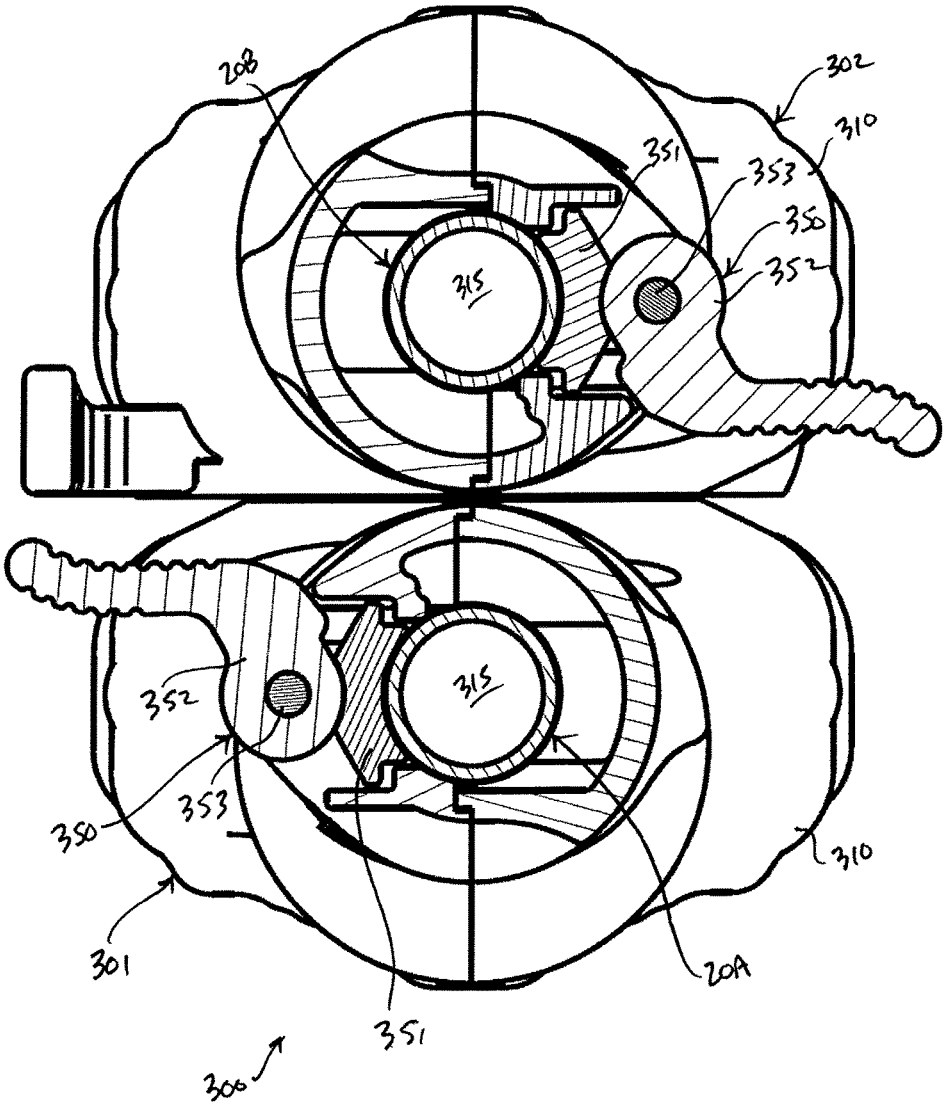
FIG. 58 is a view similar to that of FIG. 57 illustrating the slide locks as they would appear unlocked for enabling the slides for moving reciprocally relative to the respective poles.

In this example, slide locks 350 are mounted to the lower extremities 312 of sleeves 310 of the respective slides 301 and 302. In slide 301, slide lock 350 is a boot 351 captured between pole 20A and cam lever 352 mounted pivotally to lower extremity 312 of sleeve 310 with a pivot pin 353 for movement between a closed position in FIG. 57, defining the locked position of slide lock 350, and an open position in FIG. 58, defining the unlocked position of slide lock 350. Boot 351 is forcibly pushed frictionally against pole 20A by cam lever 352 in the closed position of cam lever 352 thereby disabling slide 302 from moving reciprocally relative to pole 20A. Boot 351 is released from pole 20A by cam lever 352 in the open position of cam lever 352 in FIG. 58 thereby enabling slide 302 for moving reciprocally relative to pole 20A. Although slide locks 350 are mounted to lower extremities 312 of the respective slides 301, they can be mounted to slides 301 at other locations, such as to upper extremities 311 of slides 301 and 302.

Figure 59:
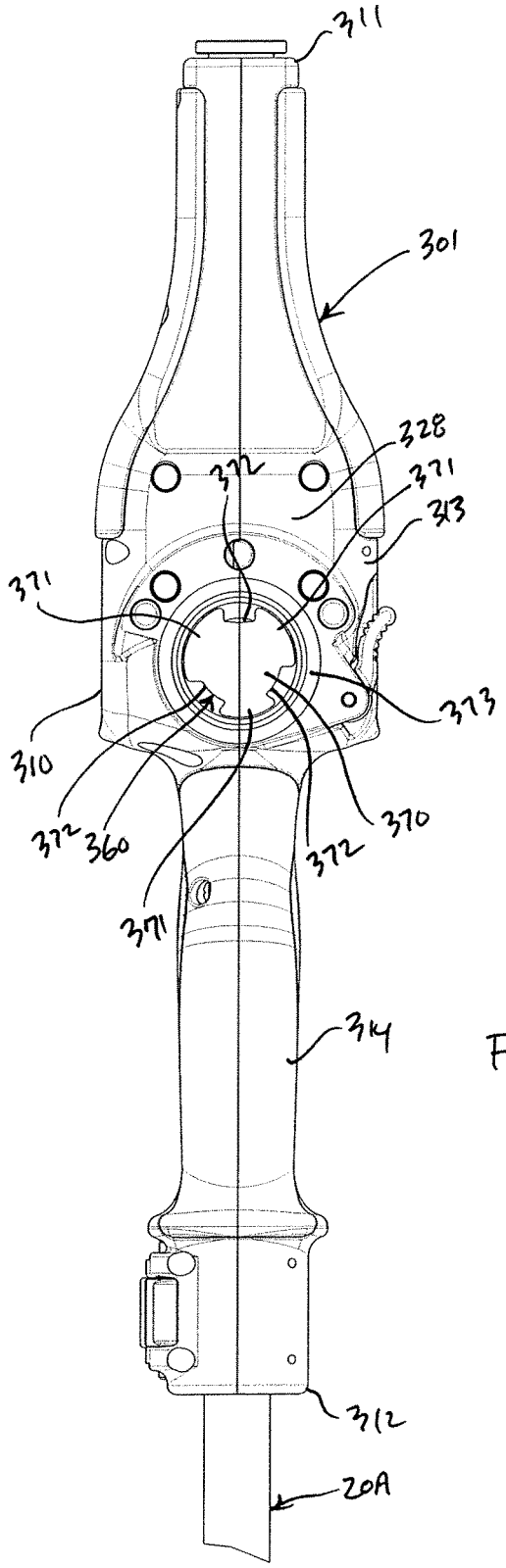
FIGS. 59 and 60 are rear elevation views of the respective slides first illustrated in FIG. 47.
Figure 60:
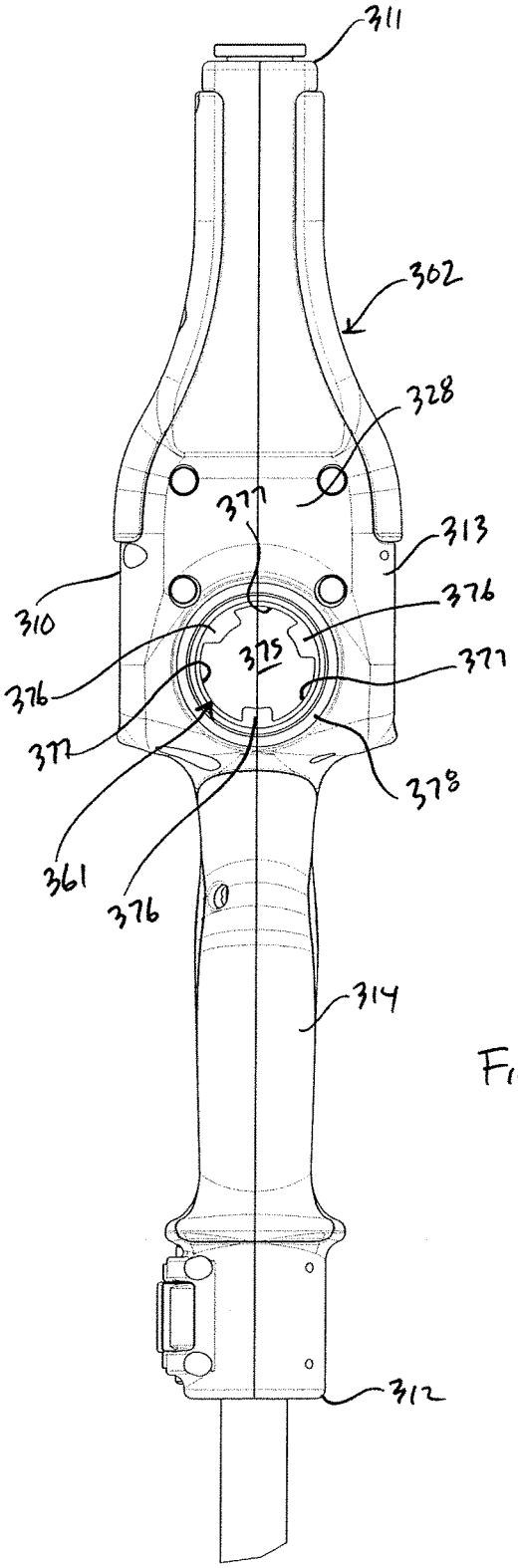

The slide 301 and pole 20A pole assembly is mounted rotatably to the slide 302 and pole 20B pole assembly, forming a bipod, a two-legged support, with a joint assembly including joint component 360 carried by slide 301 of the slide 301 and pole 20A pole assembly in FIG. 59, and joint component 361 carried by slide 302 of slide 302 and pole 20B pole assembly in FIG. 60. Joint components 360 and 361 are releasable from one another in a rotationally offset position of the slide 301 and pole 20A pole assembly relative to the slide 302 and pole 20B pole assembly in FIGS. 62 and 62, and when joined together interact with one another so as to prevent them, and thus the respective pole assemblies, from being separated/detached from one another when rotated out of the rotationally offset position of the slide 301 and pole 20A pole assembly relative to the slide 302 and pole 20B pole assembly. Joint components 360 and 361 can be released and attached to one another in the rotationally offset position of the slide 301 and pole 20A pole assembly relative to the slide 302 and pole 20B pole assembly in FIGS. 62 and 62. Joint components 360 and 361 interfere with one another in the rotationally offset position of slide 301 relative to slide 302 preventing joint components 360 and 361 from detaching from one another thereby preventing slides 301 and 302 from detaching from one another, while currently being free to rotate relative to one another for, in turn, permitting slides 301 and 301 to rotate relative to one another. The exterior sides of slides 301 and 302 from middle 313 and upper extremity 312 are lined with exterior padding or rubber to protect the surface of a weapon during the use of the bipod.

Figure 61:
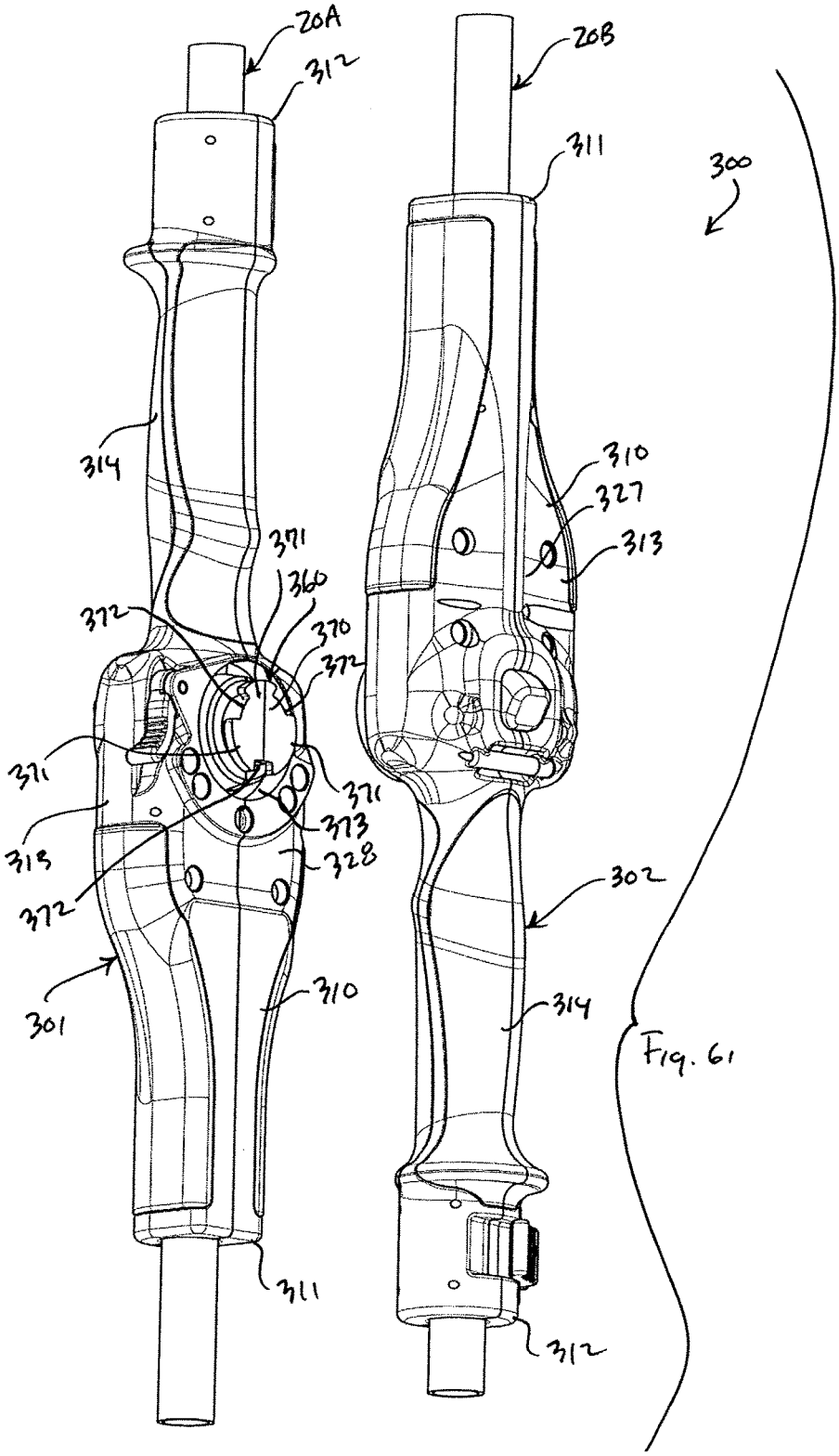
FIGS. 61 and 62 are perspective views of the slides as they would appear detached from one another and rotationally offset in preparation for connecting a first joint component of one of the slides in FIG. 61 to a second joint component of the other one of the slides in FIG. 62, the first and second joint components together form a joint assembly.

In FIGS. 59 and 61, joint component 360 of slide 301 is positioned centrally at back 328 of sleeve 310 at middle 313. Joint component 360 is a pin 370 that extends outwardly from back 328 to outwardly-directed lugs 371, which extend radially outward. Each pair of adjacent outwardly-directed lugs 371 is separated by an inwardly-directed notch 372. Notches 372 extend radially inward. An annular groove 373 formed in back 328 of sleeve 310 circumscribes the base of pin 370. Annular groove 373 is part of joint component 360.

Figure 62:
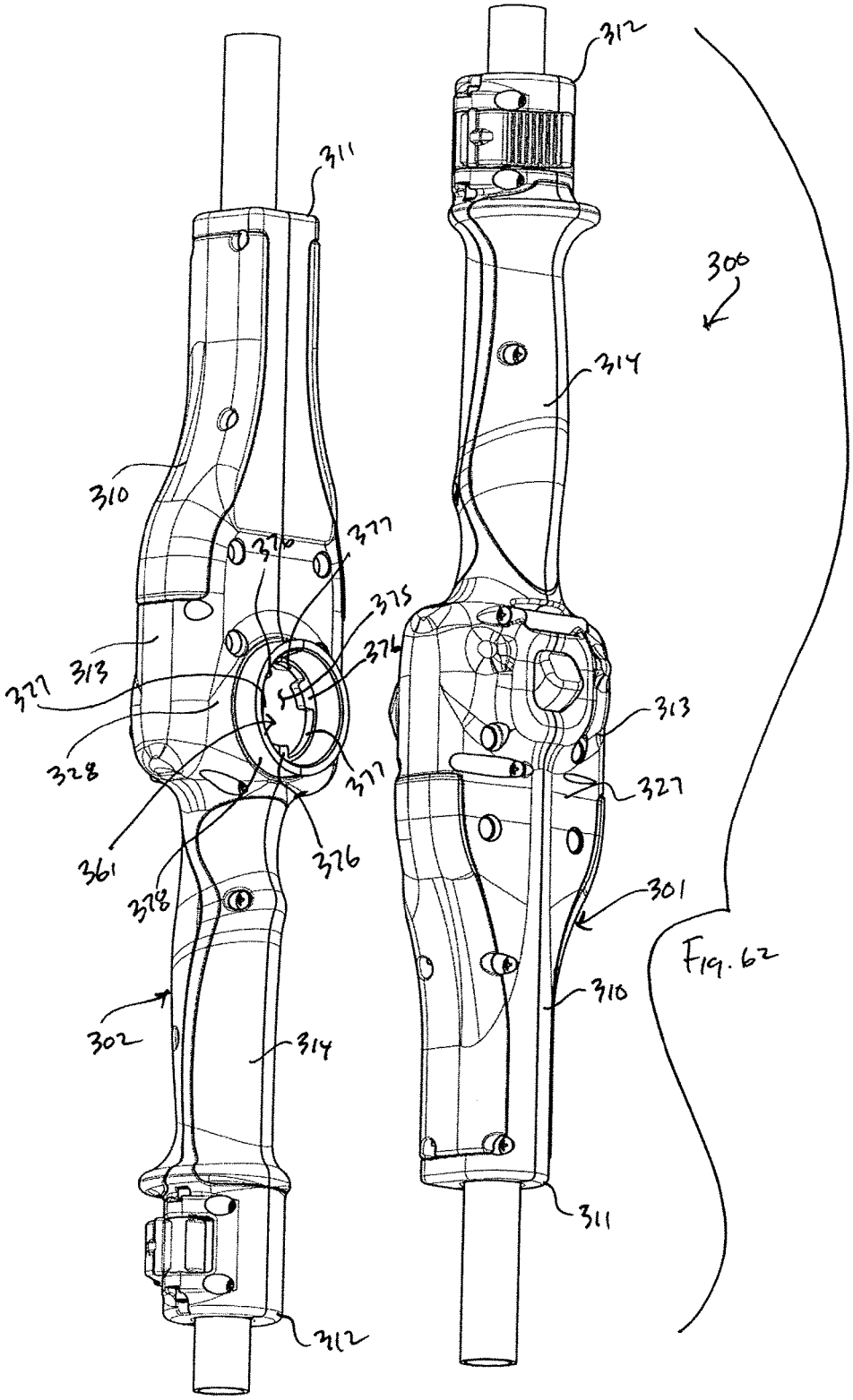

In FIGS. 60 and 62, joint component 361 of slide 302 is positioned centrally at back 328 of sleeve 310 at middle 313. Joint component 361 is a socket 375, formed with outwardly-directed lugs 376, which extend radially inward. Each pair of adjacent lugs 371 is separated by an outwardly-directed notch 377. Notches 377 extend radially outward. An annular drum or collar 378 is formed in back 328 of sleeve 310, extends outwardly from back 328 of sleeve 310, and circumscribes, and partially defines, socket 375. Annular collar 378 relates to annular groove 373 of slide 301. Annular collar 378 is part of joint component 361.

And so joint component 360, which can be referred to as a first joint component of the joint assembly, includes pin 370 having outwardly-directed lugs 371 and inwardly-directed notch 372 between each pair of adjacent outwardly-directed lugs 371, and joint component 361, which can be referred to as a second joint component of the joint assembly, includes socket 375 including inwardly-directed lugs 376 and outwardly-directed notch 377 between each pair of adjacent inwardly-directed lugs 376. Outwardly-directed lugs 371 are differently sized and shaped relative to each other, inwardly-directed notches 372 are differently sized and shaped relative to each other, inwardly-directed lugs 376 are differently sized and shaped relative to each other, and outwardly-directed notches 377 are differently sized and shaped relative to each other.

Figure 63:
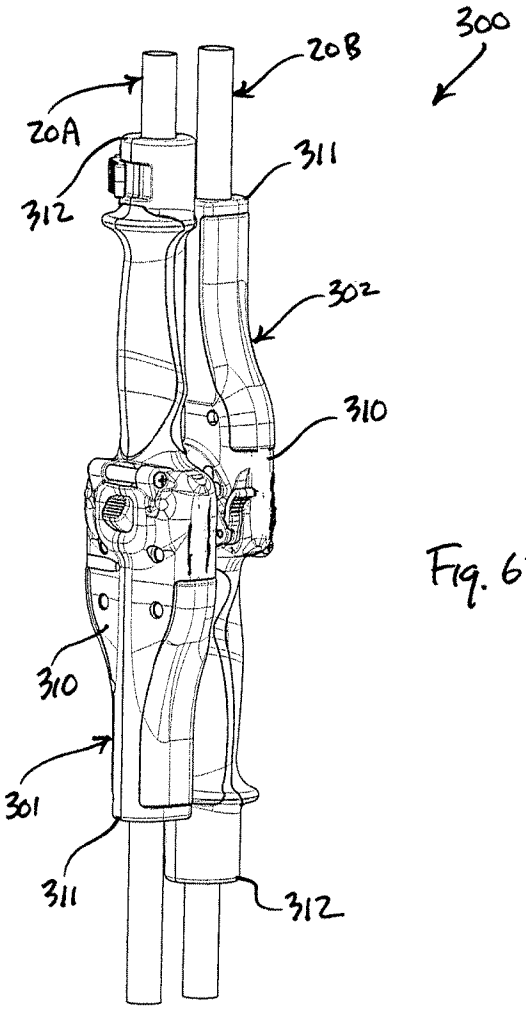
FIG. 63 is a perspective view corresponding to FIGS. 61 and 62 illustrating the slides as they would appear initially connected.
Figure 64:
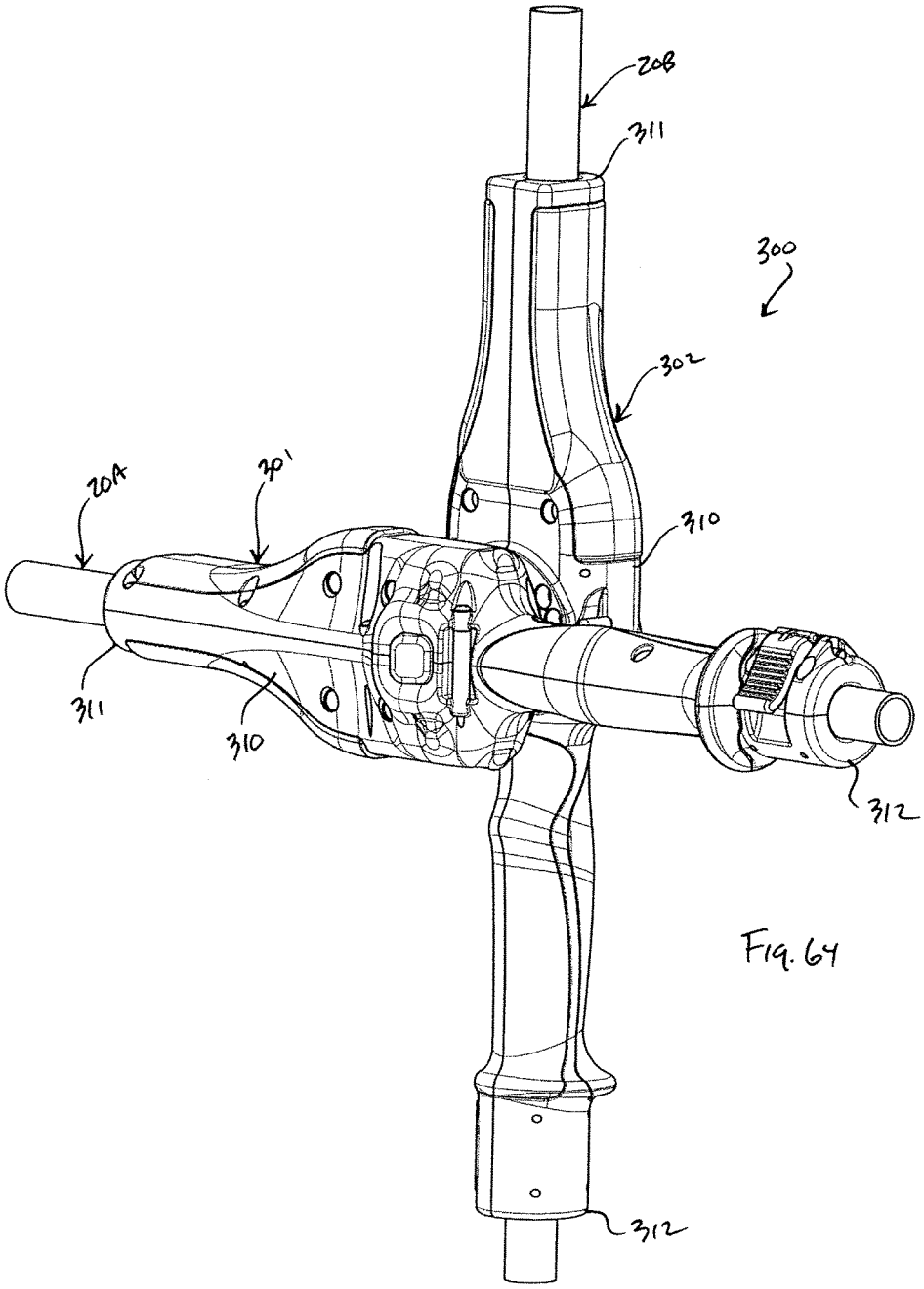
FIGS. 64-66 are perspective views illustrating a sequence of steps of rotation of one slide relative to the other slide from the rotationally offset position of the slides in FIG. 63 concurrently connecting the slides together in response.
Figure 65:
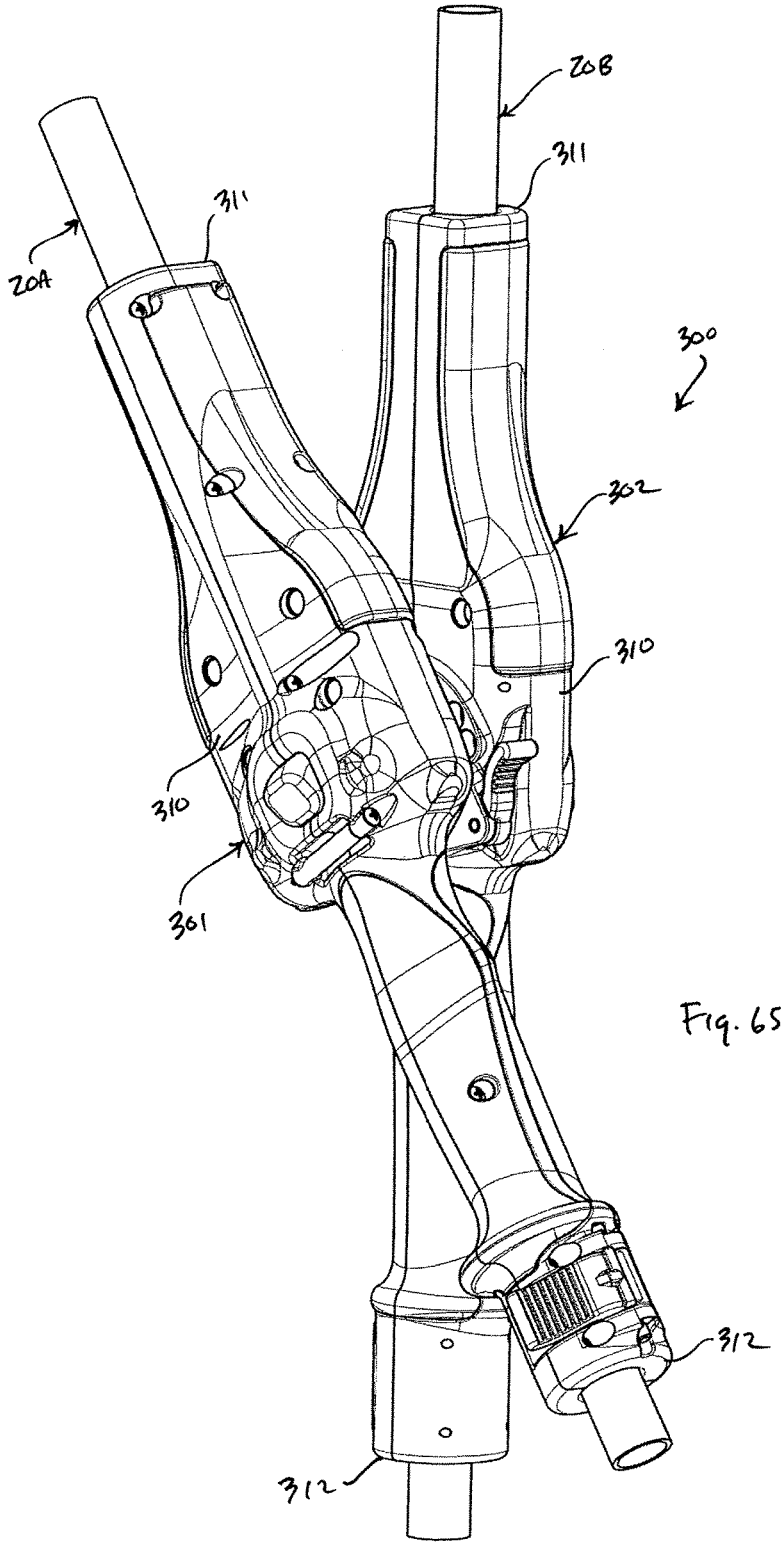
Figure 66:
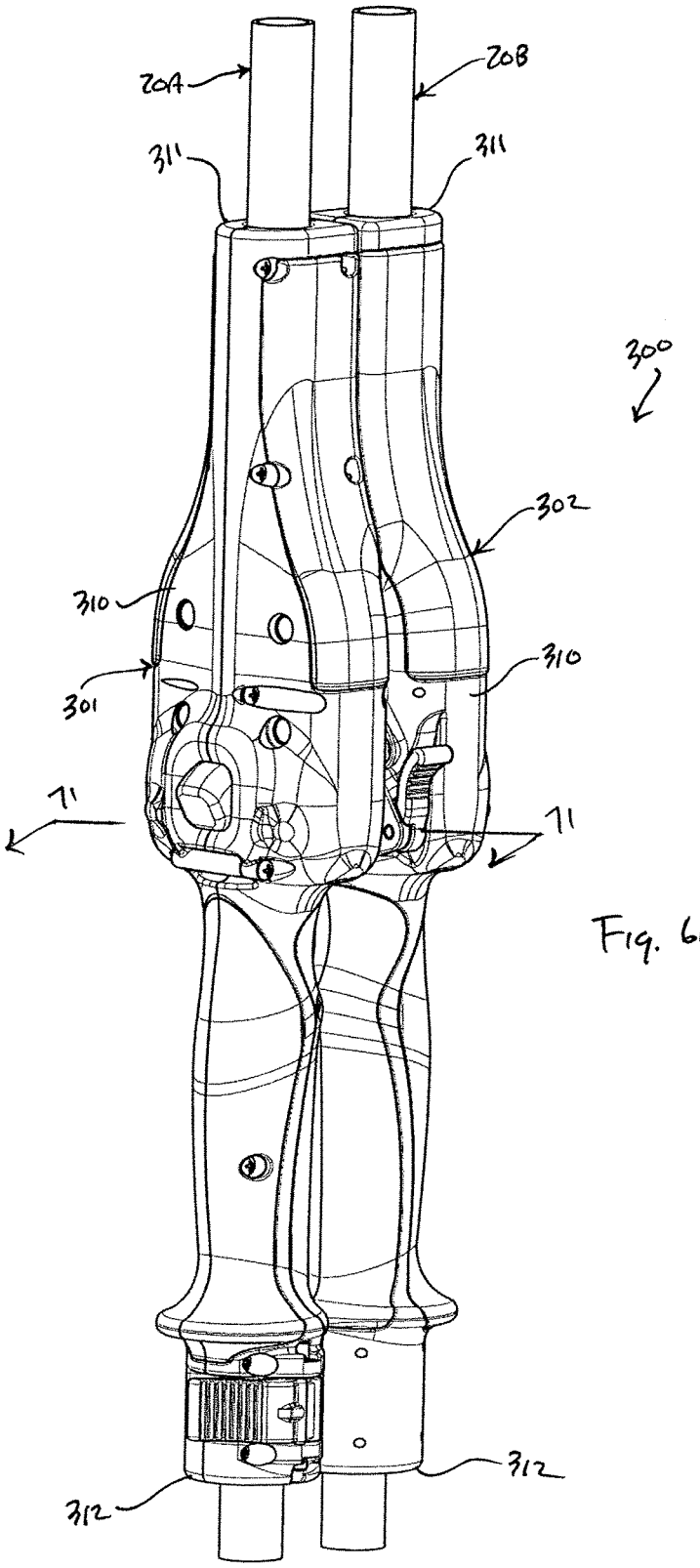
Figure 67:
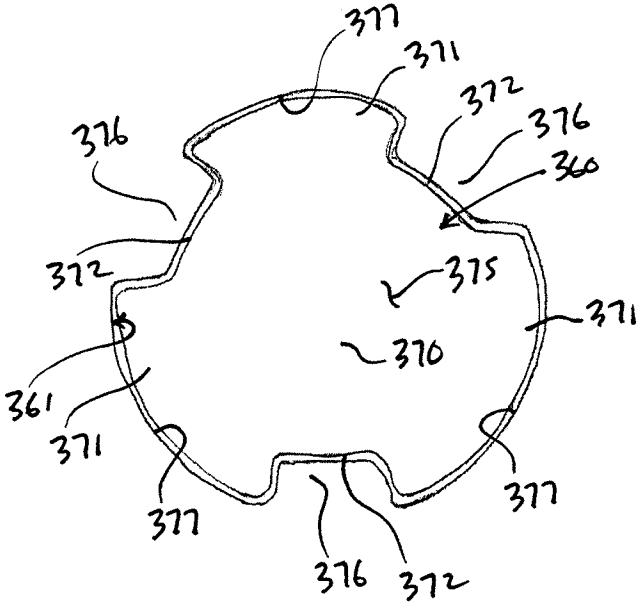
FIGS. 67-70 are schematic views illustrating the relationship of the first joint component relative to the second joint component corresponding to FIGS. 63-66, respectively.
Figure 68:
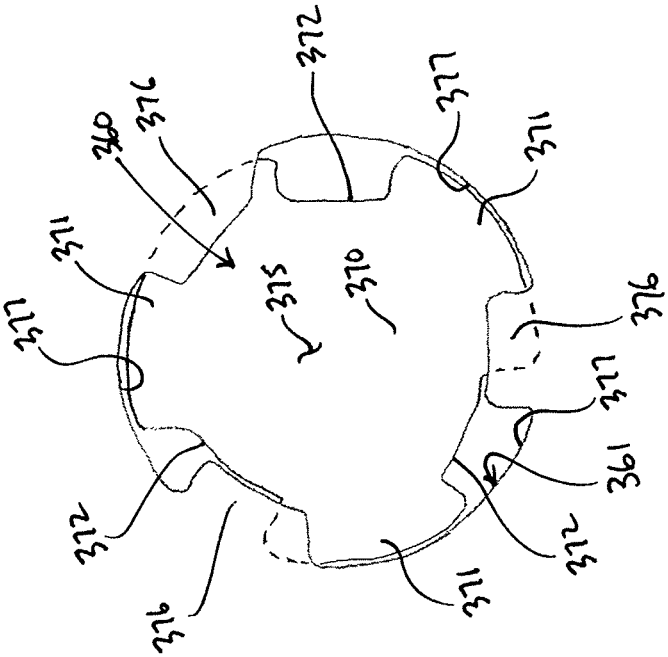
Figure 69:
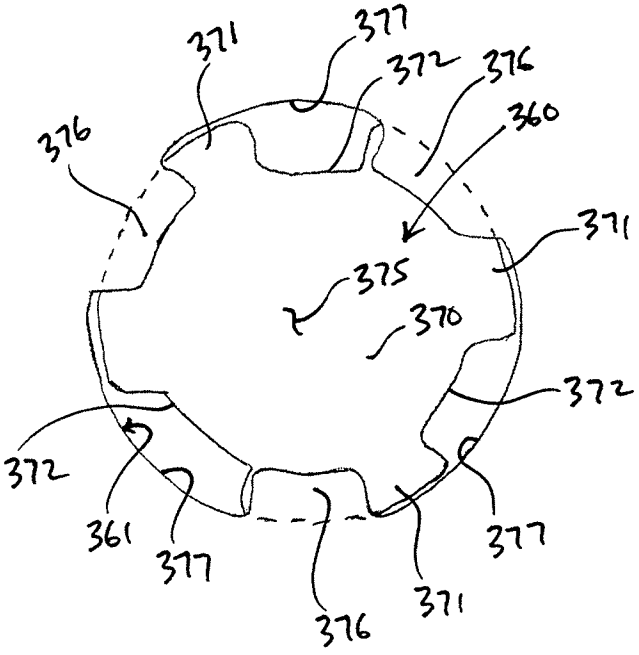
Figure 70:
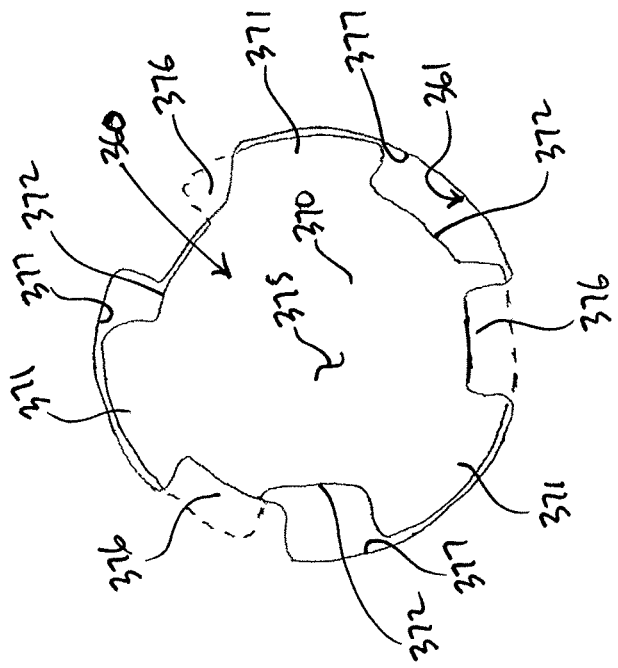
Figure 73:
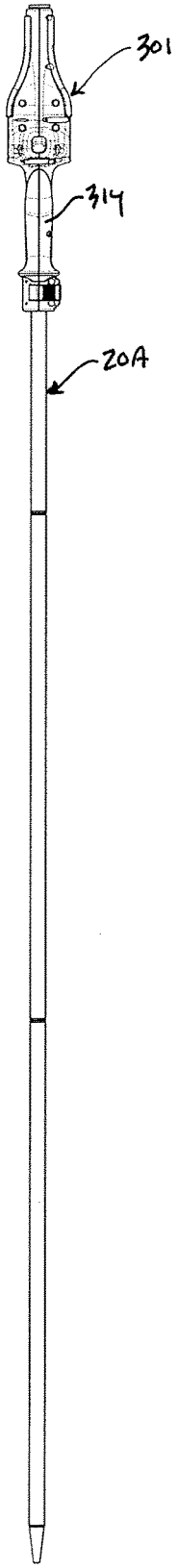
FIG. 73 is a front elevation view of a pole assembly corresponding to the embodiment of FIG. 47.

Sleeves 310 of slides 301 and 302 are parallel relative to one another, are juxtaposed back 328 to back 328, and are rotationally offset 180 degrees relative to one another about the axis of rotation of the joint assembly, which axis of rotation is orthogonal relative to poles 20A and 20B, so as to align upper extremities 311 with lower extremities 312 and so as to align joint element 360 with joint element 361, in the rotationally offset position of slide 301 and pole 20A pole assembly relative to slide 302 and pole 20B pole assembly in FIGS. 61 and 62. In this orientation, a rotationally offset orientation of slide 301 relative to slide 302, outwardly-directed lugs 371 relate to the outwardly-directed notches 377 and outwardly-directed lugs 376 relate to the inwardly-directed notches 372 for allowing pin 372 to be inserted into socket 375. Slides 301 and 302 are brought together back 328 to back 328 so as to insert pin 370 into socket 375, bring back 328 of slide 301 into contact with back 328 of slide 302, and insert annular collar 378 into annular groove 373 in response. Concurrently, outwardly-directed lugs 371 pass through outwardly-directed notches 377 to behind lugs 376 and outwardly-directed lugs 376 pass in the opposite direction through inwardly-directed notches 372 to behind lugs 271 in FIG. 67. FIG. 67 corresponds to FIG. 63 and shows how outwardly-directed lugs 371 correspond to and align with outwardly-directed notches 377 and how outwardly-directed lugs 376 correspond to and align with inwardly-directed notches 372. Pin 370 can rotate in socket 375 and outwardly-directed lugs 371 are behind inwardly directed lugs 376 when pin 370 is inserted into socket 375. Annular collar 378 rotates through annular groove 373. Interaction between annular collar 378 and annular groove 373, considered part of the joint assembly, align sleeves 301 and 302 relative to each other and align pin 370 in socket 375. FIGS. 64-66 are perspective views illustrating a sequence of steps of rotation of slide 301 relative to slide 302 from the rotationally offset position of the slides in FIG. 63 concurrently connecting slides 301 and 302 together in response concurrently connecting the pole assemblies together. Inwardly-directed lugs 371 behind outwardly-directed lugs 376 oppose and interfere with outwardly-directed lugs 376 behind inwardly-directed lugs 371 preventing joint component 360 from being pulled apart from joint component 361 preventing separation of the slide 301 and pole 20A pole assembly from the slide 302 and pole 20B pole assembly, in other than the rotationally offset position of the slide 301 and pole 20A pole assembly relative to the slide 302 and pole 20B pole assembly. FIGS. 68-70 are schematic views corresponding to FIGS. 64-66 illustrating the relationship of joint component 360 relative to joint component 361 corresponding to FIGS. 63-66, respectively, in which inwardly directed lugs 376 are shown to interfere with the outwardly directed lugs 371, indicated in dotted line, behind inwardly directed lugs 376. To detach slide 301 from slide 302, the described operation for connecting joint components 360 and 361 for connecting slides 301 and 302 of the respective pole assemblies need only be reversed. When detached from one another, slide 301 and pole assembly 20A and slide 302 and pole 20B pole assembly can each be used independent of one another as a monopod "walking stick" or "trekking pole" to facilitate balancing while walking, hiking, or otherwise going on foot. FIG. 73 illustrates slide 301 and pole 20A pole assembly detached from slide 302 and pole 20B pole assembly for this purpose. After sliding slide 201 along the length of pole 20A to a desired position and then locking slide 302 to pole 20A, both with the clamp assembly enclosed in slide 201 and slide lock 350, handle 314 can be taken up by hand and slide 301 and pole 20A can then be used as a walking stick or a trekking pole to facilitate balancing while walking, hiking, or otherwise going on foot.

Figure 71:
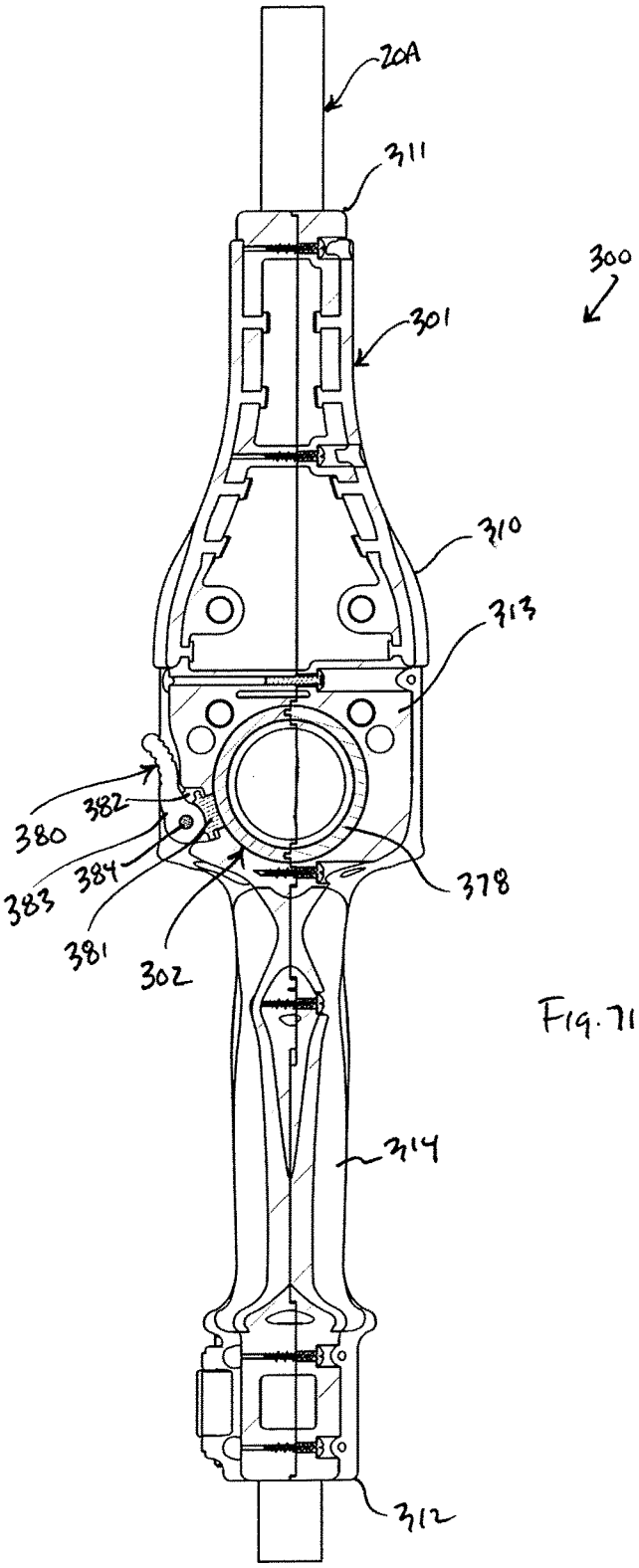
FIG. 71 is a section view taken along line 71-71 of FIG. 66 illustrating a joint lock as it would appear unlocked enabling rotation of the slides of FIG. 66 relative to one another.
Figure 72:
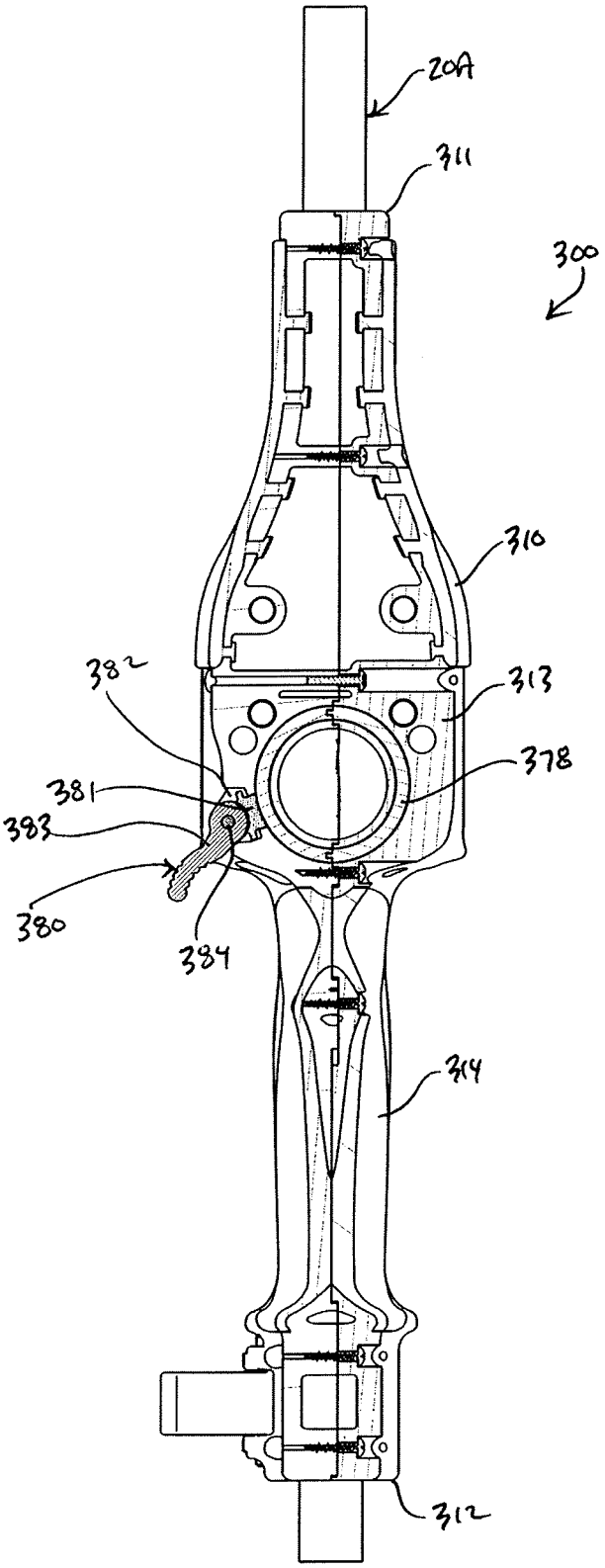
FIG. 72 is a view similar to that of FIG. 71 illustrating the joint lock as it would appear locked disabling rotation of the slides of FIG. 66 relative to one another.

In FIGS. 71 and 72, gun rest assembly 300 has a joint lock 380 for locking and unlocking the joint assembly. Joint components 360 and 361 are disabled from rotating relative to one another for disabling rotation of slide 301 relative to slide 302, and thus for disabling rotation of slide 301 and pole 20A pole assembly relative to slide 302 and pole 20B pole assembly, in a locked position of the joint lock 380. Joint components 360 and 361 are enabled for rotating relative to one another for enabling rotation of slide 301 relative to slide 302, and thus for enabling rotation of slide 301 and pole 20A pole assembly relative to slide 302 and pole 20B pole assembly, in an unlocked position of the joint lock 380.

Joint lock 380 includes annular collar 378 carried by slide 302, and a cam lever assembly mounted to slide 301. The cam lever assembly is released from annular collar 378 in FIG. 71 for unlocking the joint assembly, in an open position of the cam lever assembly. The cam lever assembly is engaged to annular collar 378 in FIG. 72 for locking the joint assembly, in a closed position of the cam lever assembly. Joint components 360 and 361 are enabled for rotating relative to one another for enabling rotation of slide 301 relative to slide 302, and thus for enabling rotation of slide 301 and pole 20A pole assembly relative to slide 302 and pole 20B pole assembly, in the open position of the cam lock assembly. Joint components 360 and 361 are disabled from rotating relative to one another for disabling rotation of slide 301 relative to slide 302, and thus for disabling rotation of slide 301 and pole 20A pole assembly relative to slide 302 and pole 20B pole assembly, in the closed position of the cam lock assembly.

In FIGS. 71 and 72, joint lock 380 includes a boot 381 housed in a seat 382 at middle 313 of sleeve 310 of slide 301 alongside the joint assembly, and a cam lever 383 mounted pivotally to middle 313 of sleeve 310 of slide 301 with a pivot pin 384 for movement between an open position in FIG. 71, defining the unlocked position of joint lock 380, and a closed position in FIG. 72, defining the locked position of joint lock 380. Cam lever 383 releases boot 381 from annular collar 378 for enabling rotation of slide 302 relative to slide 301 for, in turn, enabling rotation of slide 301 and pole 20A pole assembly relative to slide 302 and pole 20B pole assembly, in the open position of cam lever 383 in FIG. 71. Cam lever 383 forcibly pushes boot 381 frictionally against annular collar 378 for disabling slide 302 from rotating relative to slide 301 for, in turn, disabling slide 301 and pole 20A pole assembly from rotating relative to slide 302 and pole 20B pole assembly, in the closed position of cam lever 383 in FIG. 72.

Joint components 360 and 361 can be selected connected together for rotating slide 301 and pole 20A pole assembly to slide 302 and pole 20B pole assembly so as to form the a shooting rest onto which weapon can be rested for stabilizing the weapon for improved aiming and accuracy, and can be selected separated from one another for allowing the slide and pole assemblies to be used independently of one another as a walking stick or trekking pole to facilitate balancing while walking, hiking, or otherwise going on foot. Auxiliary attachments can be formed with joint component 361 for connection to joint component 360 of slide 301. Auxiliary attachments can also be formed with joint component 360 for connection to joint component 361 of slide 302. FIGS. 74-82 illustrate an example of an auxiliary attachment 390 formed with joint component 361 for connection to joint component 360 of slide 301.

Figure 74:
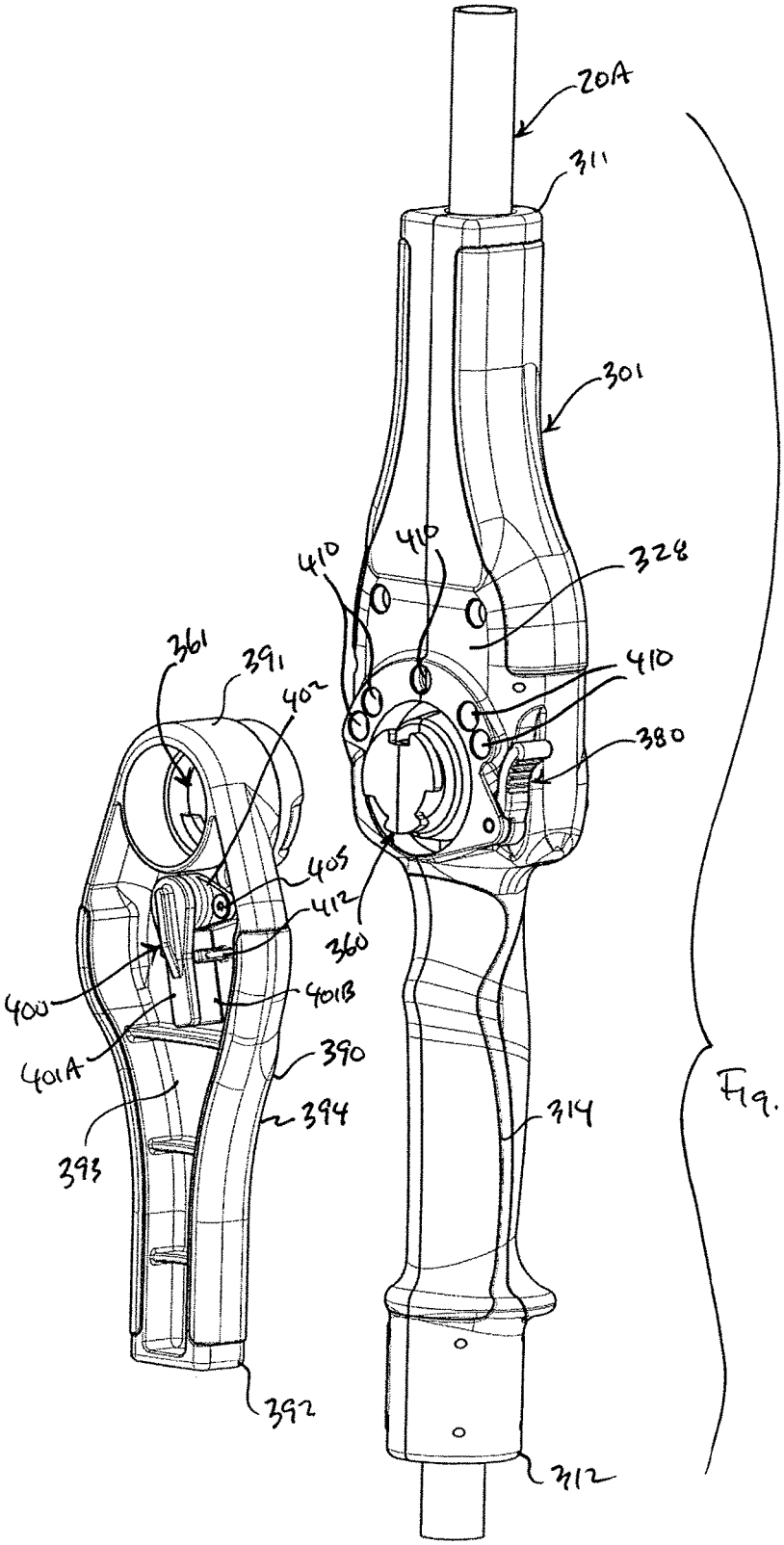
FIGS. 74 and 75 are perspective views of one of the slides of the embodiment of FIG. 47 and a support as they would appear detached from one another and rotationally offset in preparation for joining a first joint component of the slide to a second joint component of the support, the first and second joint components together form a joint assembly.
Figure 75:
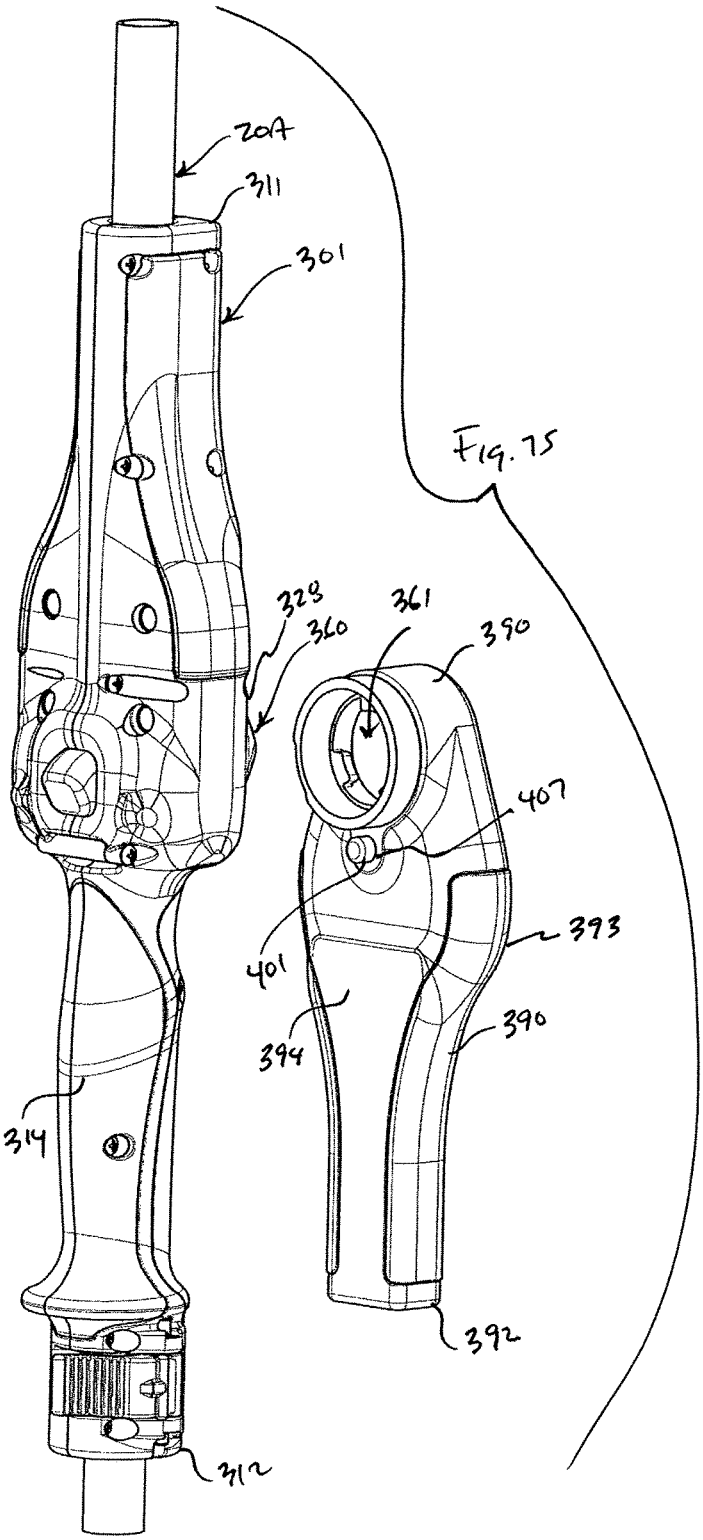

In FIGS. 74 and 75, auxiliary attachment 390, a support, is an elongate member having proximal end 391, distal end 392, front 393, back 394, and joint component 361 formed in proximal end 391. Joint component 361 is used to connect auxiliary attachment 390 rotatably to joint component 360 of slide 301 in the same way discussed above in connection with slides 301 and 302. Briefly, in FIGS. 74 and 75 sleeve 310 of slides 301 and auxiliary attachment 390 are parallel relative to one another, are juxtaposed back 328 to back 394, respectively, and are rotationally offset 180 degrees relative to one another about the axis of rotation of the joint assembly, which axis of rotation is orthogonal relative to poles 20A, so as to align distal end 392 of auxiliary attachment 390 with lower extremity 312 of slide 310 and so as to align joint element 360 with joint element 61, in the rotationally offset position of auxiliary attachment 390 relative to slide 301 and pole 20A pole assembly. Auxiliary attachment 390 and slide 301 are brought together initially connecting joint element 360 of slide 301 to joint element 361 of auxiliary attachment 390. 78-80 are perspective views illustrating a sequence of steps of rotation of auxiliary attachment 390 relative to slide 301 out of the rotationally offset position of auxiliary attachment 390 and slide 301 represented in FIGS. 74 and 75 concurrently connecting joint components 360 and 361 of slide 301 and auxiliary attachment 390, respectively, in response concurrently connecting auxiliary attachment 490 to slide 301 of the slide 301 and pole 20A pole assembly according to the discussion of the joint assembly above in connection with slide 301 and pole 20A pole assembly and slide 302 and pole 20B pole assembly. To detach auxiliary attachment 390 from slide 301, the foregoing operation need only be reversed. Once connected to slide 301, auxiliary attachment 390 can rotate relative to slide 301 into selected angular positions relative to slide 301 for forming a crisscrossed rest by slide 301 and auxiliary attachment 390 to receive and stabilizing a weapon for firing while the slide 301 and pole 20A pole assembly, a monopod, is held upright by hand at handle 314 by the shooter. The exterior sides of auxiliary attachment 390 between proximal end 391 and distal end 392 are lined with exterior padding or rubber to protect the surface of a weapon during the use of the monopod. As discussed above, joint lock 380 can used to lock and unlock the joint assembly between slide 301 and auxiliary attachment 390. Auxiliary attachment 360 is disabled from rotating relative to sleeve 301 in the locked position of joint lock 380, and is enabled for rotating relative to slide 301 in the unlocked position of joint lock 380. In the alternative, auxiliary lock assembly 4000 can be used. Auxiliary lock assembly 4000 is coupled between auxiliary attachment 390 and slide 301. Auxiliary attachment 390 is disabled from moving rotatably relative to slide 301, in a locked position of the auxiliary lock assembly 4000. Auxiliary attachment 390 is enabled for moving rotatably relative to slide 301, in an unlocked position of the auxiliary lock assembly 4000.

Figure 76:
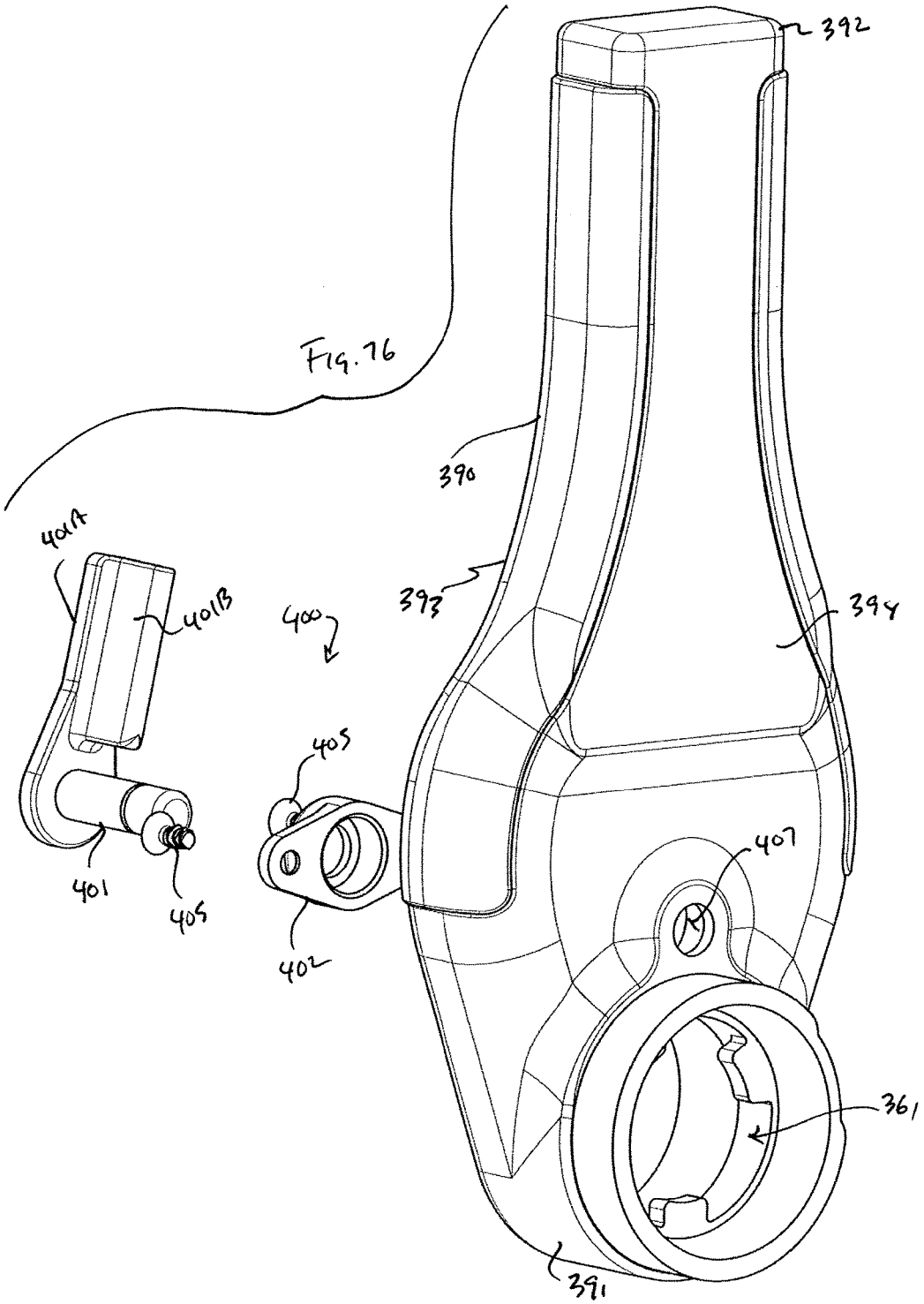
FIGS. 76 and 77 are exploded perspective views of the support of FIGS. 74 and 75.
Figure 77:
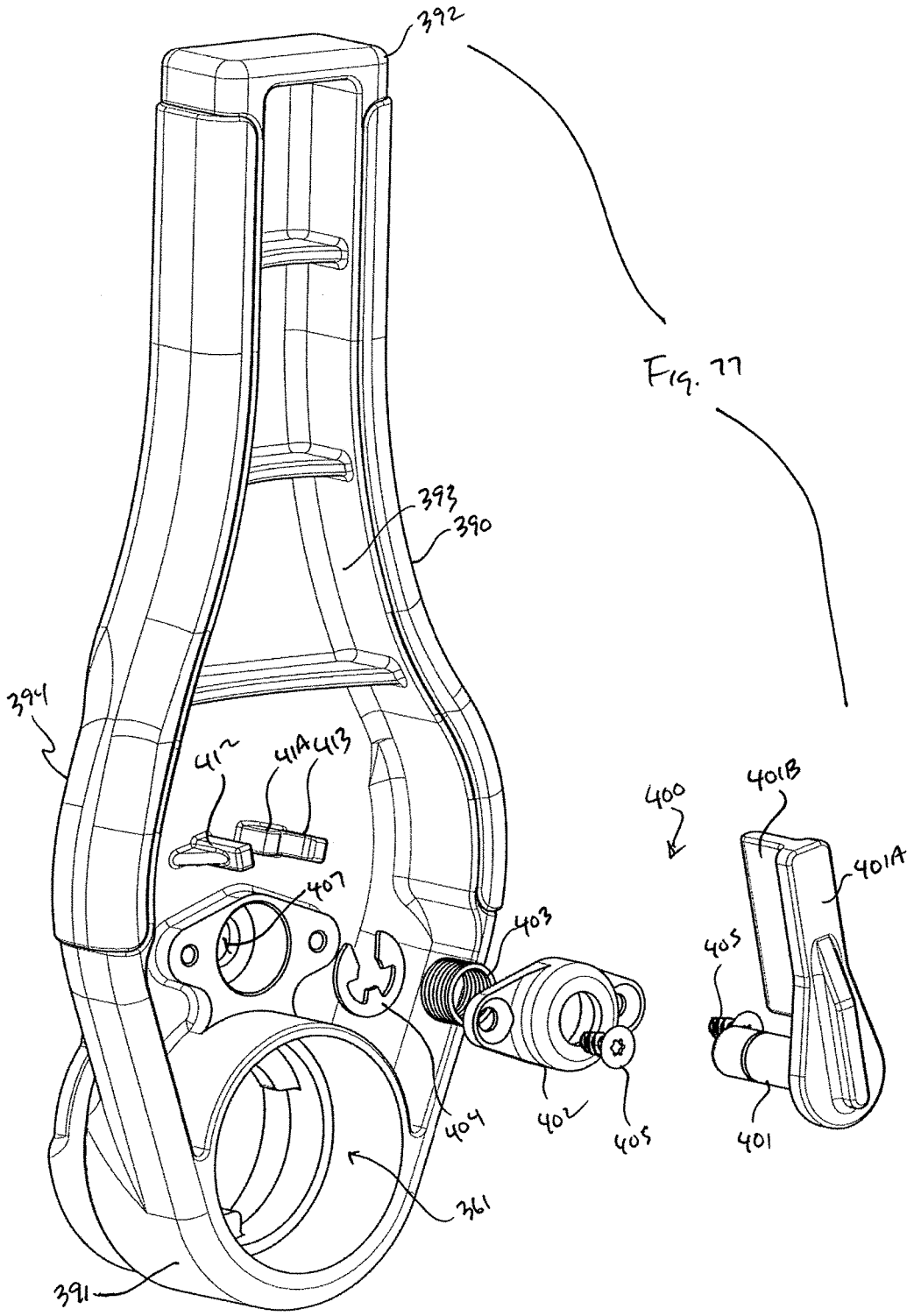
Figure 78:
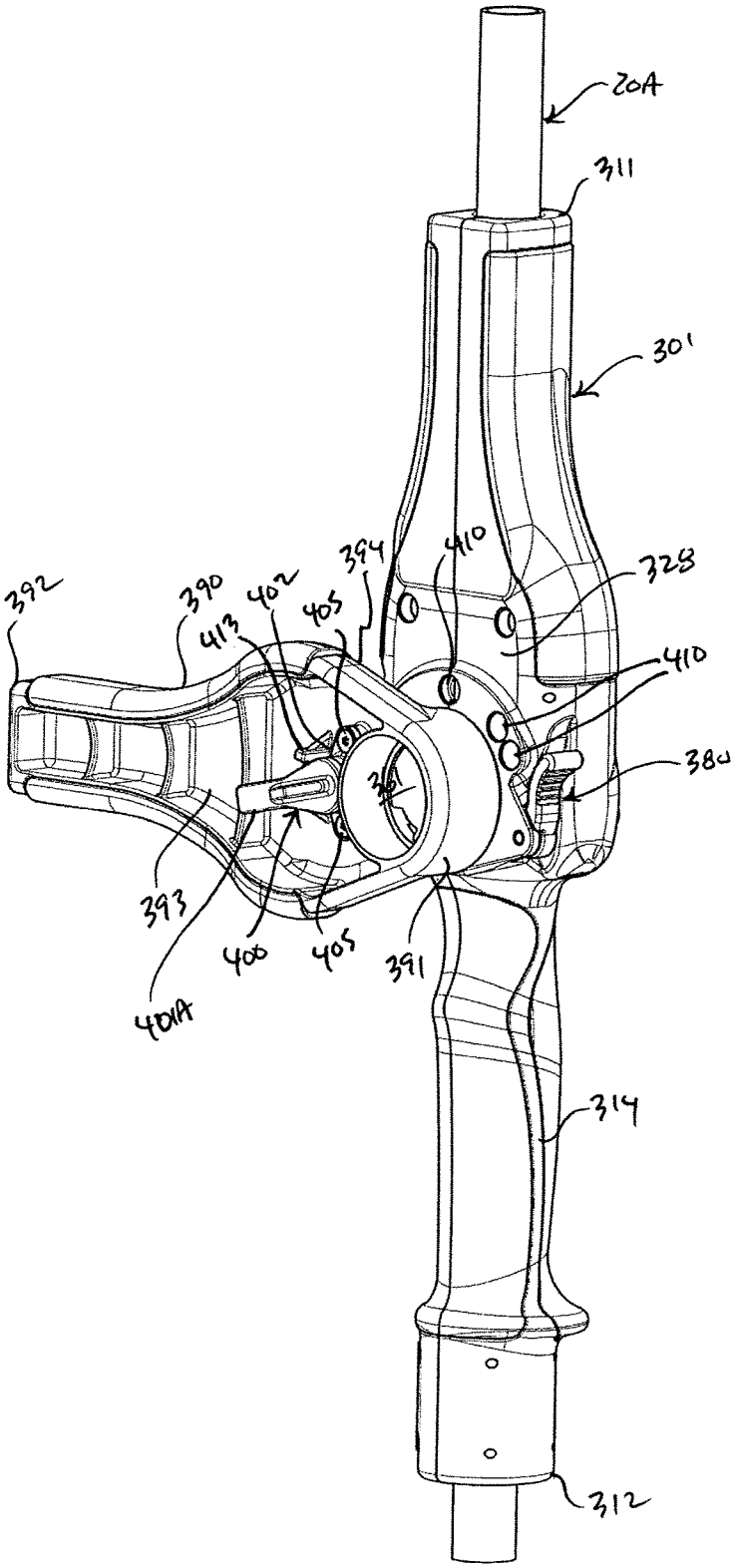
FIGS. 78-80 are perspective views illustrating the support joined to the slide of the embodiment of FIG. 74, the support shown as it would appear rotated into different positions relative to the slide.
Figure 79:
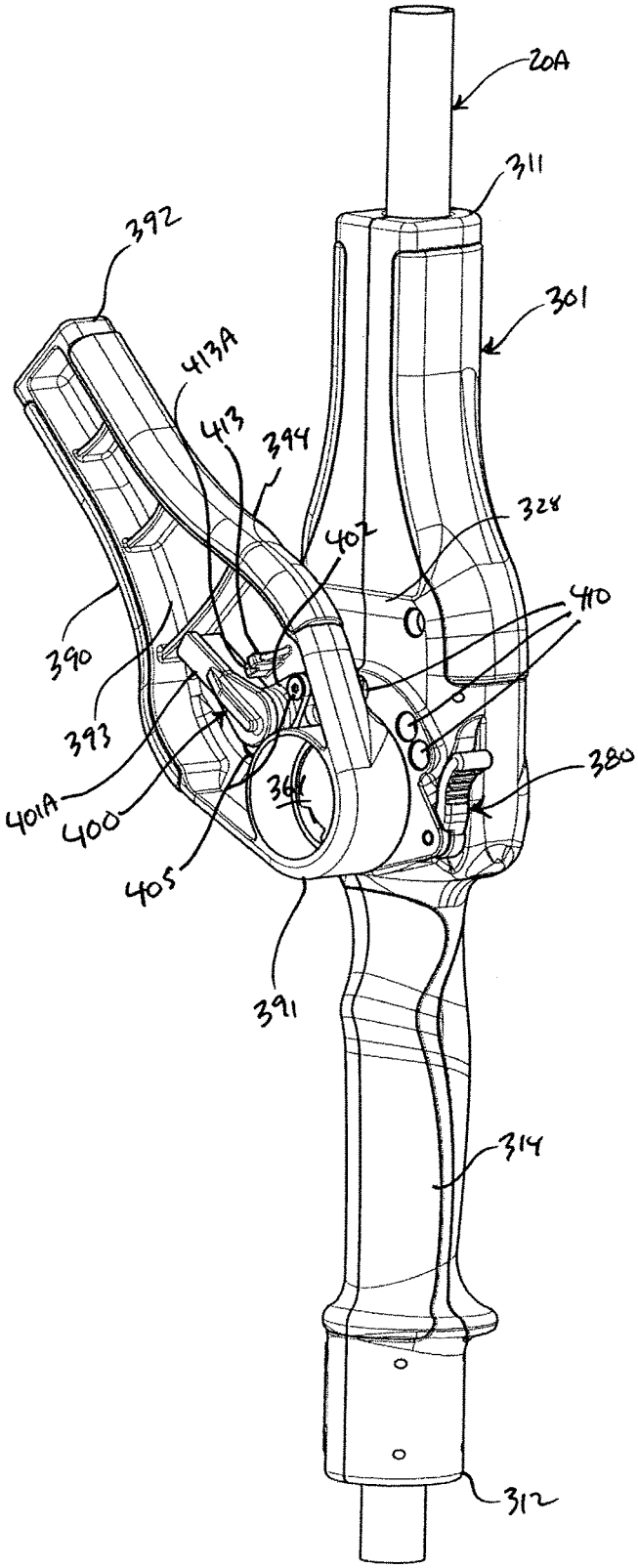
Figure 80:
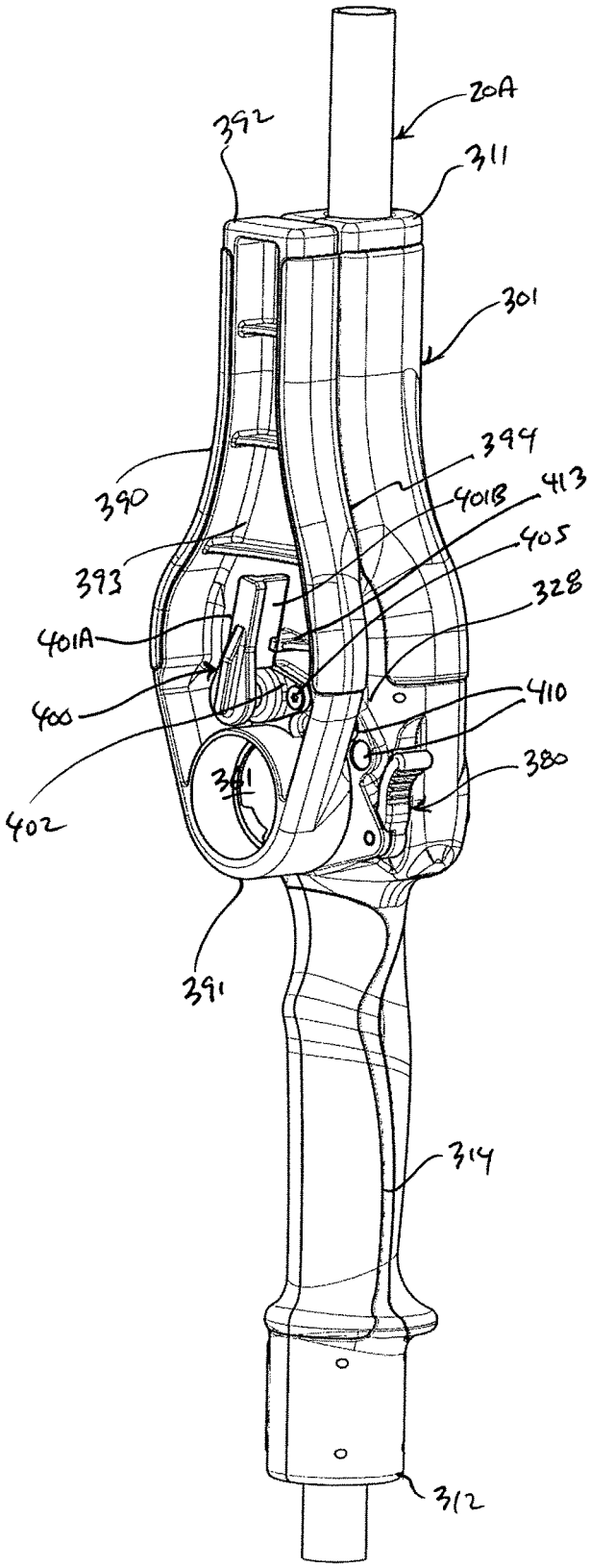
Figure 81:
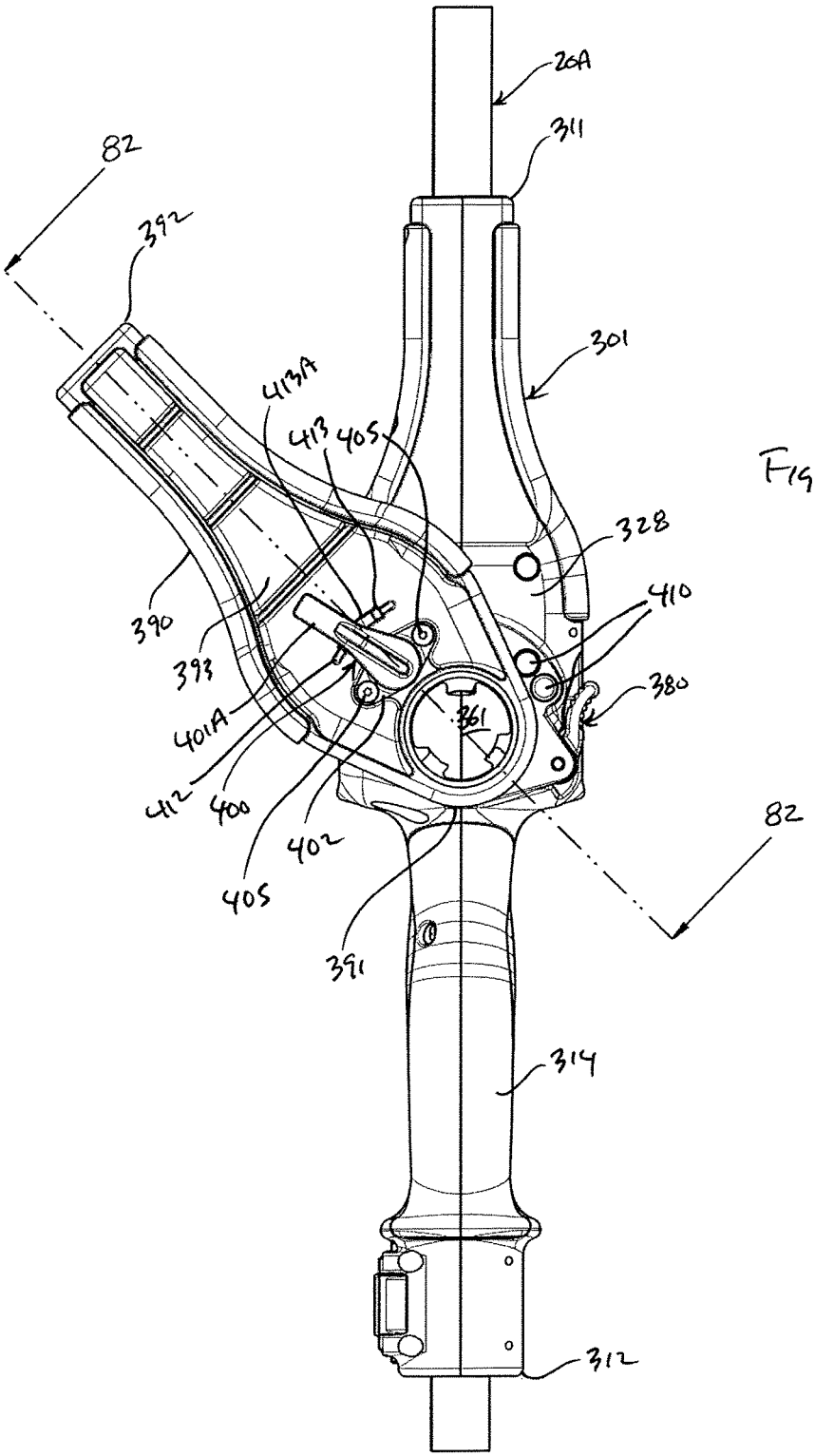
FIG. 81 is a front elevation view of the embodiment of FIG. 79.
Figure 82:
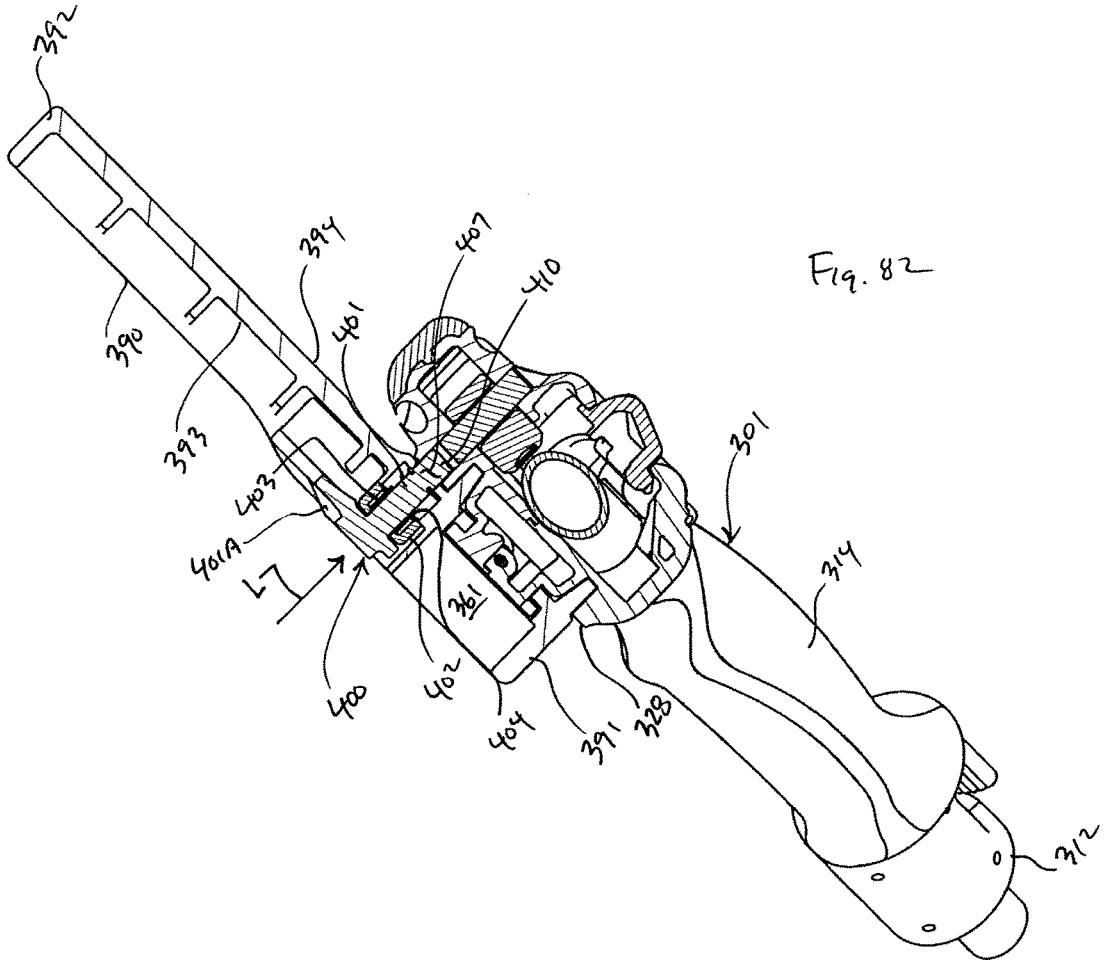
FIG. 82 is a section view taken along line 82-82 of FIG. 81.
Figure 83:
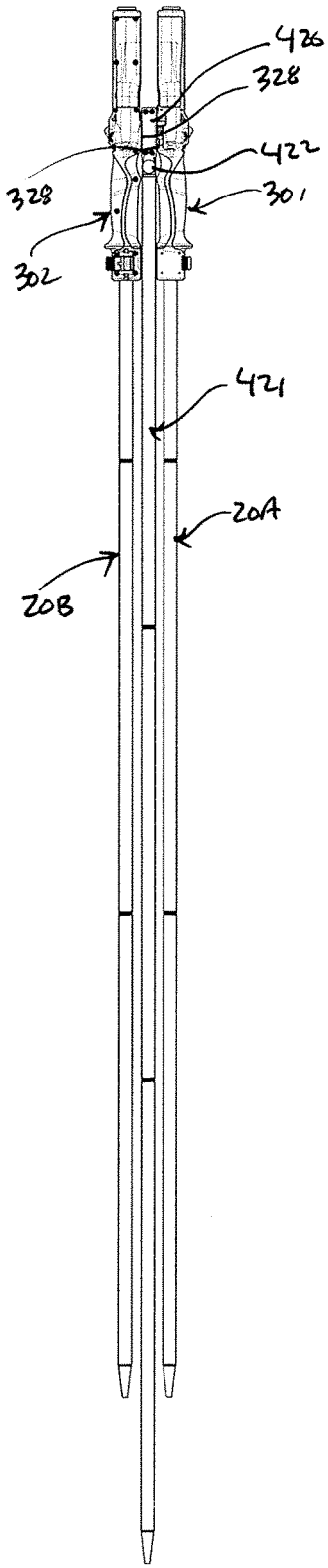
FIG. 83 is a side elevation view of a shooting rest constructed and arranged in accordance with the principle of the invention, the shooting rest includes pole assemblies, each including a slide mounted reciprocally to a pole, a coupling concurrently mounted rotatably to the slides of the respective pole assemblies, and an intermediate pole connected to the connector.
Figure 84:
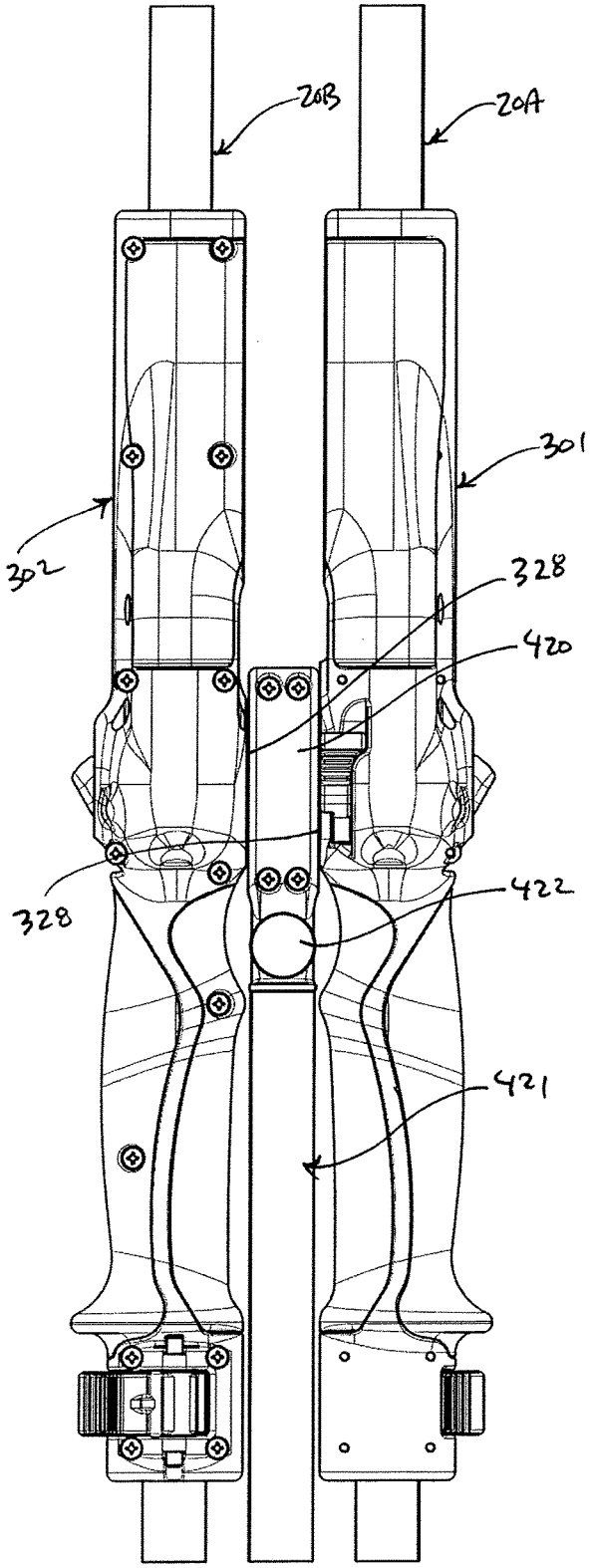
FIG. 84 is an enlarged, fragmented, side elevation view of the embodiment of FIG. 83 illustrating the slide connected to the coupling.

Referring in relevant part to FIGS. 76, 77, and 82, auxiliary lock assembly 4000 includes pin 401, keeper 402, spring 403, and clip 404. Pin 401 extends from handle 401A. Spring 403 is fitted into keeper 402, keeper 402 is connected to front 390 of auxiliary attachment with fasteners 405, pin 402 is inserted through keeper 402 and through opening 407 in auxiliary attachment 39 and projects outboard of back 394, and handle 401A is juxtaposed on the outer side of keeper 402. Spring 403 encircles spring 403, and is captured between keeper 402 and clip 404 clipped to pin 401. Spring 403, a compression spring, constantly acts against keeper 402 and clip 404 constantly urging pin 401 outwardly in the direction of arrowed line L in FIG. 82 toward back 328 of slide 301. Engagement of handle 401A against the outer side of keeper 402 limits the distance pin 401 projects from back 394. Pin 401 can be selectively aligned with each one of holes 410 in back 328 of slide 301 and selected inserted therein to pin and lock auxiliary attachment 310 to slide 301 at selected angular orientations relative to slide 301 corresponding to the locations of holes 410. Pin 410 will encounter a hole 410, in response to rotation of auxiliary attachment 390 relative to slide 301. The spring load applied to pin 401 by spring 403 snaps pin 401 outwardly into the aligned hole 410 setting auxiliary attachment 390 in place relative to slide 301 in a locked position of auxiliary lock assembly 4000 disabling auxiliary attachment from rotating relative to slide 301. Handle 401A can be taken up by hand and pulled with a force sufficient to overcome spring 403 to withdraw pin 401 from the corresponding hole 410 in an unlocked position of auxiliary attachment 390 enabling rotation of auxiliary attachment 390 to a selected new location where pin 401 is aligned with another selected hole 410. By releasing handle 401A, spring 403 snaps pin 401 outwardly into the new aligned hole 410 setting auxiliary attachment 390 in place relative to slide 301 in a locked position of auxiliary lock assembly 4000 disabling auxiliary attachment from rotating relative to slide 301 in response. Each hole 410 corresponds to a different position of auxiliary attachment 390 relative to slide 301, and auxiliary lock assembly 400 is used as discussed above to selectively set auxiliary attachment 390 to the selected positions corresponding to the positions of holes 410. In FIGS. 74, 76, and 77, handle 401A has extension 401B that inserts between runners 412 and 413 on front 393 of auxiliary attachment 390. Runner 413 has ramp 413A confronting extension 401B. Extension 401B runs upwardly over ramp 413B of runner 413 withdrawing pin 401 to the unlocked position of auxiliary lock assembly 4000, in response to rotating handle 401A in the direction of runner 413. Extension 401B runs downwardly over ramp 413B of runner 413 extending pin 401 to the locked position of auxiliary lock assembly 4000, in response to rotating handle 401A in the direction of runner 412.

As explained above, the slide 301 and pole 20A pole assembly is mounted rotatably to the slide 302 and pole 20B pole assembly, forming a bipod, a two-legged support, with the joint assembly including joint component 360 carried by slide 301 of the slide 301 and pole 20A pole assembly in FIG. 59, and joint component 361 carried by slide 302 of slide 302 and pole 20B pole assembly in FIG. 60. FIGS. 83, 84, and 87-89 illustrate slide 301 and pole 20A pole assembly and slide 302 and pole 20B pole assembly concurrently mounted rotatably to either side of a coupling 420 attached to leg or pole 421, forming a tripod, a three-legged support, with joint assemblies, including a first joint assembly including joint component 360A carried by slide 301 of the slide 301 and pole 20A pole assembly in FIG. 85 and joint component 361A carried by a first side of coupling 420 in FIG. 86, and a second joint assembly including joint component 360B carried by a second side of coupling 420 in FIG. 85 and joint component 361B carried by slide 302 of the slide 302 and pole 20B pole assembly in FIG. 86. Pole 421 is mounted pivotally to coupling 420 with a pivot 422. Slide 301 mounted rotatably to coupling 420 with the first joint assembly including joint component 360A carried by slide 301 of the slide 301 and pole 20A pole assembly in FIG. 85 and joint component 361A carried by the first side of coupling 420 in FIG. 86, and slide 302 is mounted rotatably to coupling 420 with the second joint assembly including joint component 360B carried by a second side of coupling 420 in FIG. 85 and joint component 361B carried by slide 302 of the slide 302 and pole 20B pole assembly in FIG. 86. Pole 421 is mounted pivotally to coupling 420 with a pivot 422.

Figure 85:
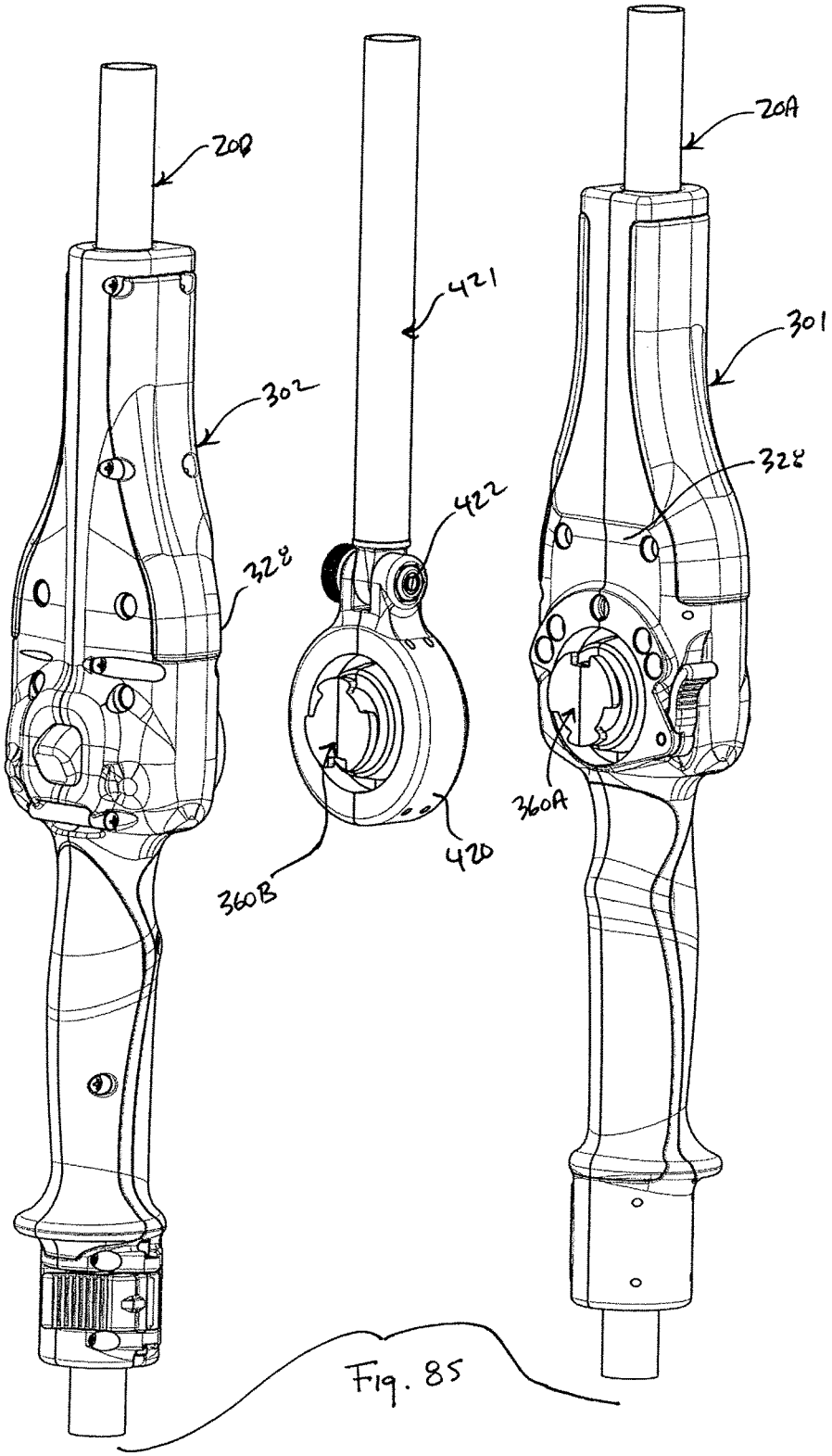
FIGS. 85 and 86 are perspective views of the slides detached from the coupling, and the coupling is rotationally offset relative to the slides in preparation for concurrently connecting to the respective slides.
Figure 86:
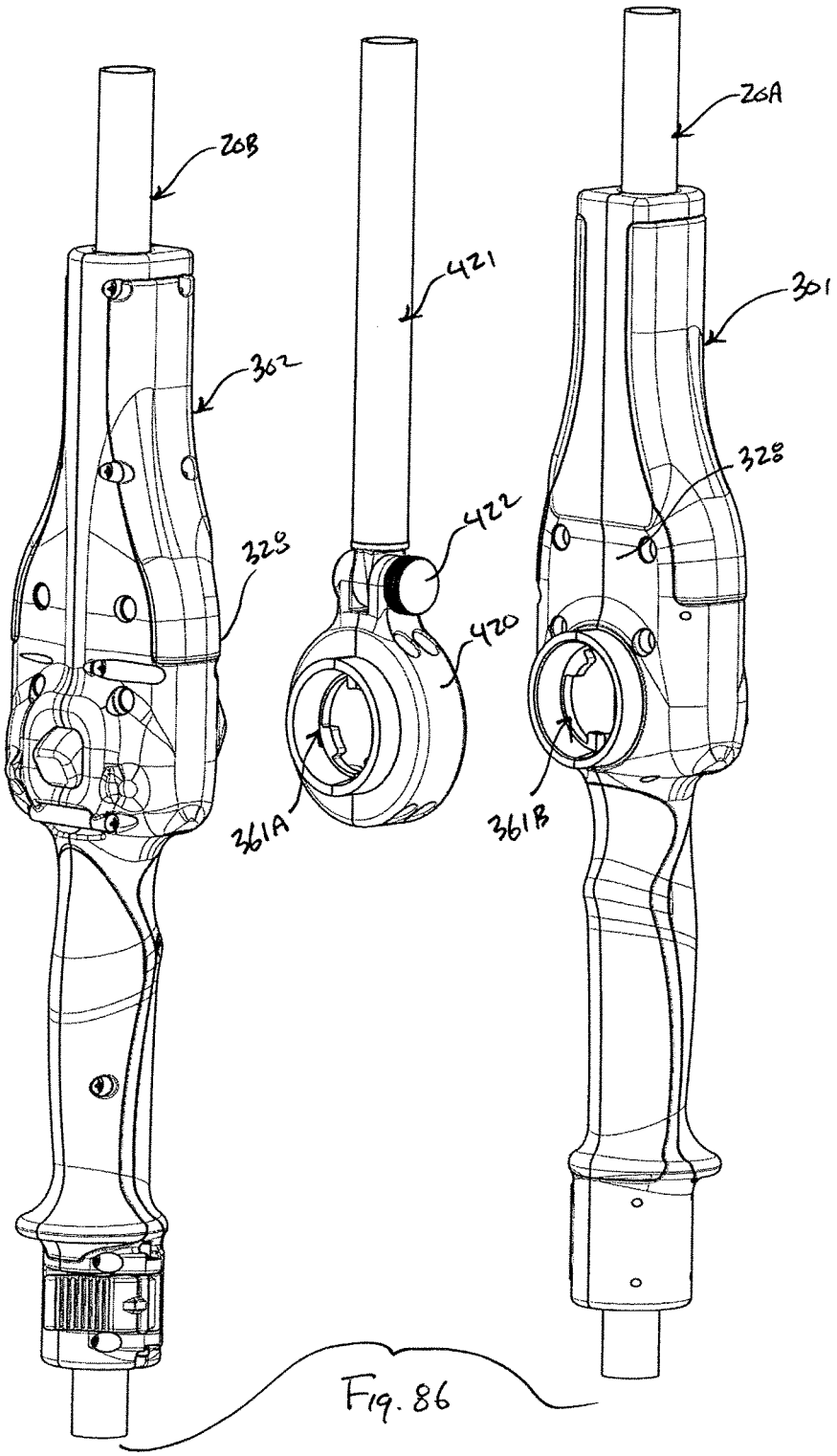
Figure 87:
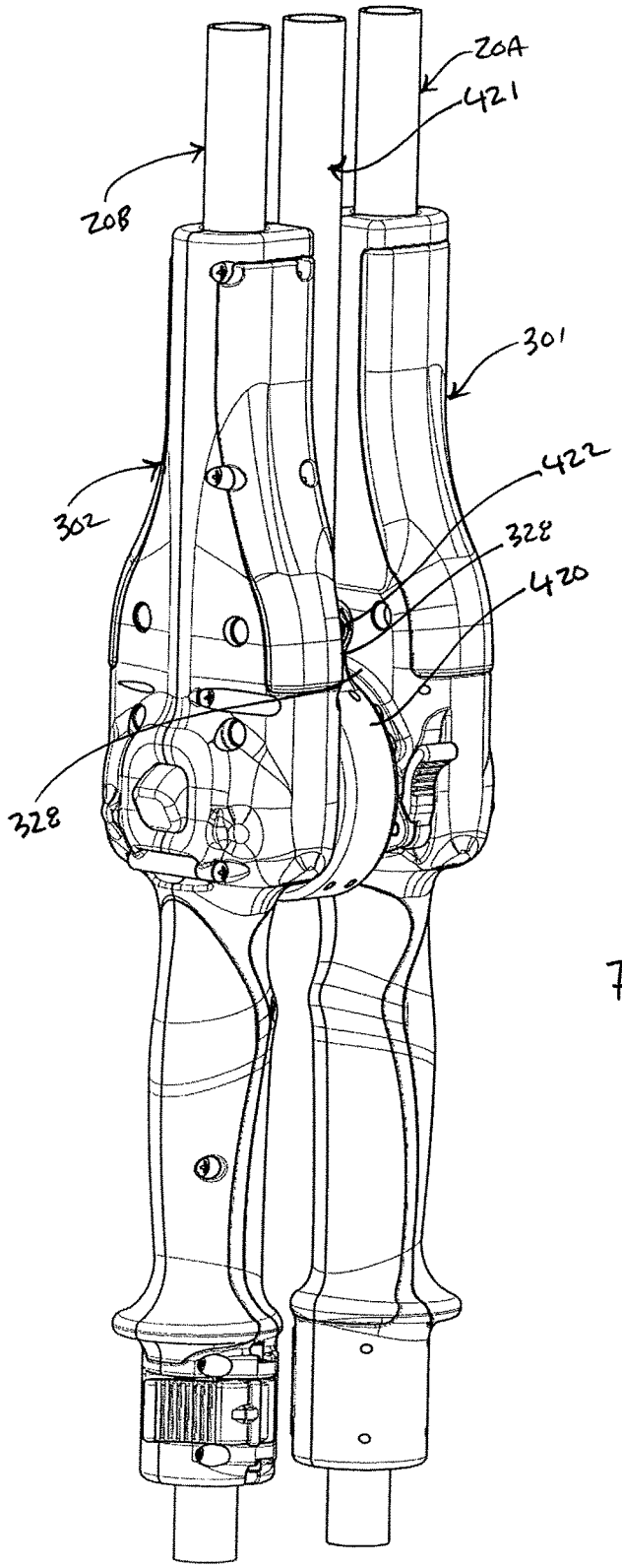
FIG. 87 is a perspective view corresponding to FIGS. 85 and 86 illustrating the slides as they would appear initially connected to the coupling in the rotationally offset position of the coupling.
Figure 88:
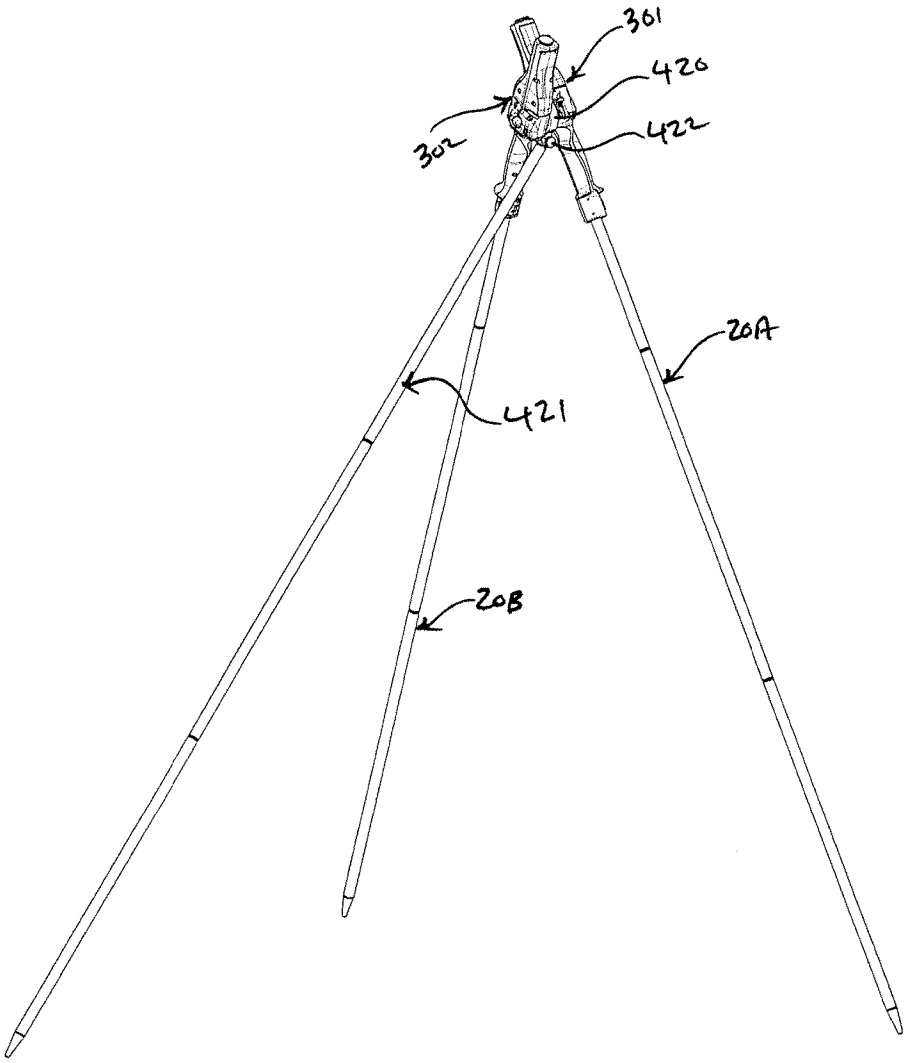
FIGS. 88 and 89 are perspective views of the shooting rest of FIG. 83 shown as it would appear deployed into different positions in preparation for use.
Figure 89:
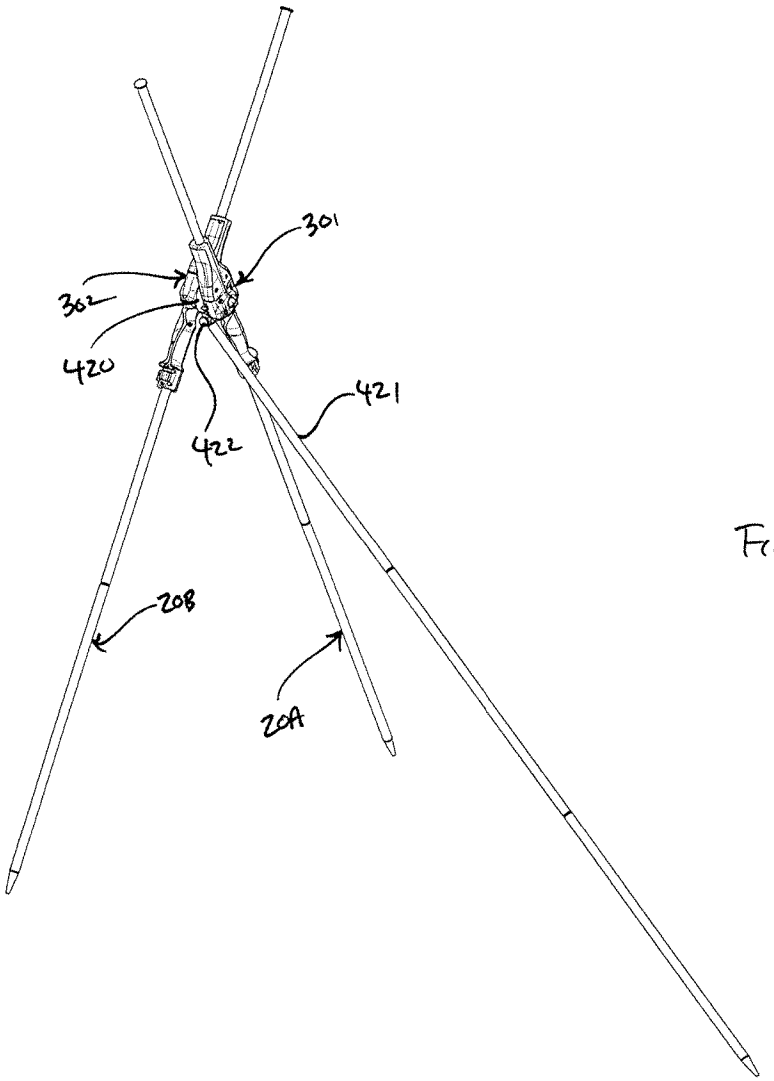

Joint components 360A and 361A of the first joint assembly and joint components 360B and 361B of the second joint assembly are identical in every respect to, and work identically to, joint components 360 and 361 discussed in connection with gun rest assembly 300. Briefly, in FIGS. 85 and 86 and 75 coupling 420 is positioned pole 421 in a rotationally offset position relative to slides 301 and 302 between slide 301 of sleeve 301 and pole 20A pole assembly and sleeve 302 and pole 20B pole assembly. Slides 301 and 302 face each other back 328 to back 328, and are parallel, axially aligned, are pointed upright from their respective lower extremities 312 to their respective upper extremities. Back 328 of slide 301 faces the first side of coupling 420, back 328 of slide 328 faces the second side of coupling 420, joint component 360A carried by slide 301 of the slide 301 and pole 20A pole assembly in FIG. 85 is aligned with joint component 361A carried by the first side of coupling 420 in FIG. 86, and joint component 360B carried by a second side of coupling 420 in FIG. 85 is aligned with joint component 361B carried by slide 302 of the slide 302 and pole 20B pole assembly in FIG. 86. In this rotationally offset position of coupling 420 relative to slide 301 of slide 301 and pole 20A pole assembly and slide 302 of slide 302 and pole 20B pole assembly. Coupling 420 and slide 301 are brought together initially connecting joint element 360A of slide 301 to joint element 361A of auxiliary attachment 390, and coupling 420 and slide 302 are brought together initially connecting joint element 360B of slide 301 to joint element 361B of auxiliary attachment 390, initially connecting slide 301 of slide 301 and pole 20A pole assembly to slide 302 of slide 302 and pole 20B pole assembly in FIG. 87 in response. Rotation of coupling 420 out of its rotationally offset position in FIG. 87, such as downwardly into a pole 421 down position in FIGS. 83 and 84, concurrently connects joint components 360A and 361A of slide 301 and coupling 420 and joint components 360B and 361B of slide 302 and coupling 420 in response, concurrently connecting slides 301 and 302 to either side of coupling 420 in response, all according to the discussion of the joint assembly above in connection with slide 301 and pole 20A pole assembly and slide 302 and pole 20B pole assembly, forming a tripod in FIGS. 83, 88, and 89. FIGS. 88 and 89 show slide 301 and pole 20A pole assembly and slide 302 and pole 20B pole assembly rotated relative to each other in a crisscross orientation with pole 421 pivoted to one side between poles 20A and 20B in FIG. 88 and to the other side between poles 20A and 20B in FIG. 89. Slides 301 and 302 can be independently or concurrently reciprocated to selected positions along the respective poles 20A and 20B in the tripod configuration.

Figure 90:
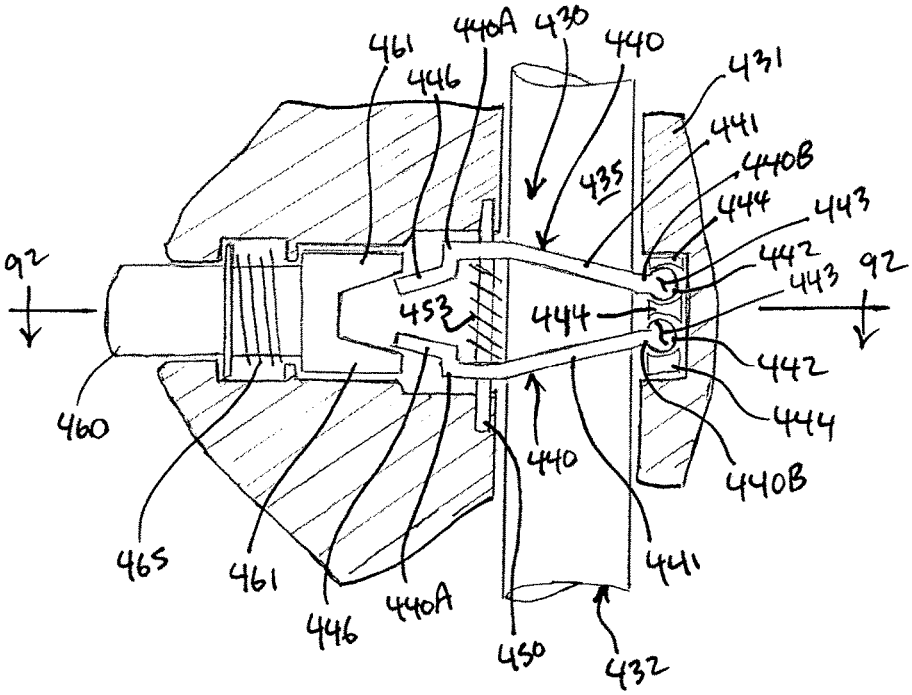
FIG. 90 is a vertical section view of a lock assembly shown as it would appear locked disabling reciprocal movement of a slide relative to a pole.
Figure 91:
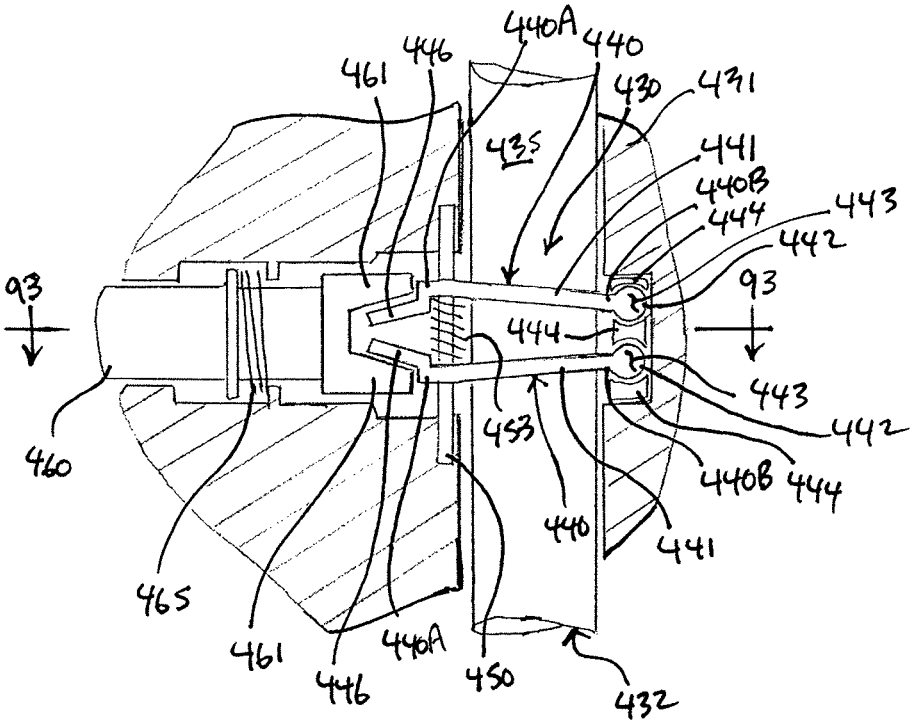
FIG. 91 is a view of the lock assembly of FIG. 90 shown as it would appear unlocked enabling reciprocal movement of the slide relative to the pole.
Figure 93:
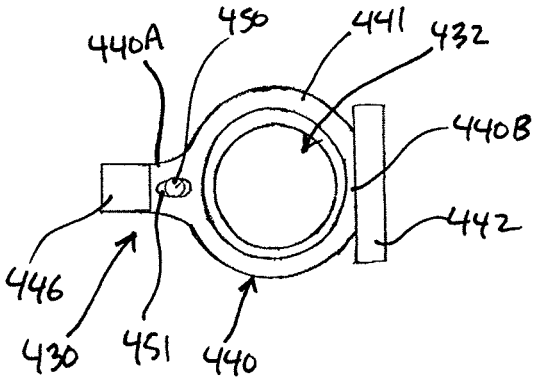
FIG. 93 is a section view taken along line 93-93 of FIG. 91.

FIG. 90 is a vertical section view of an embodiment of a lock assembly 430 shown locked, and FIG. 91 is a view similar to that of FIG. 90 illustrating lock assembly 430 as it would appear unlocked. Slide 431 is disabled from moving reciprocally relative to pole 432, in the locked position of lock assembly 430. Slide 431 is enabled for moving reciprocally relative to pole 432, in the unlocked locked position of lock assembly 430. Lock assembly 430 is discussed generally here, with the understanding that it can be used in the bipod, monopod, and tripod embodiments disclosed herein.

Figure 92:
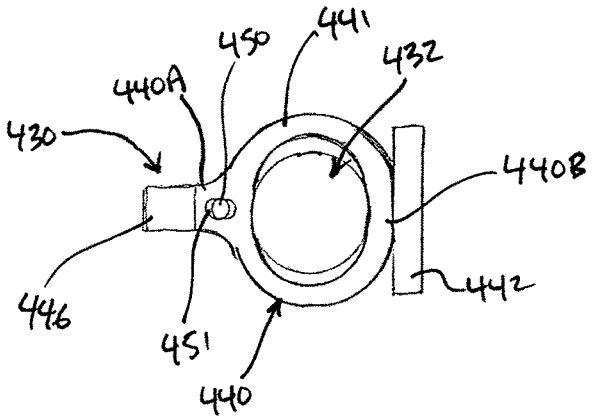
FIG. 92 is a section view taken along line 92-92 of FIG. 90.

In FIGS. 90-93 in relevant part, lock assembly 430, enclosed in channel 435 of slide 431 through which pole 432 extends, includes a pair of opposed hold-open clips 440, each including a proximal end 440A, a distal end 440B, and a circular section 441 therebetween encircling pole 432. The distal end 440B of each hold open clip 440 has a circular lug 442 pivoted alongside pole 432 to a corresponding socket 443 formed by bushings 444 of slide 431. The proximal end 440A of each hold-open clip 440 has a tab 446. Tabs 446 are inturned toward one another. Between the proximal ends of hold-open clips 440 is a vertical pin 450. The opposed ends of pin 450 are affixed to slide 431 on either side of the proximal ends 440A of hold-open clips 440. Pin 450 extends between proximal ends 440A of hold-open clips 440, and through an elongated hole 451 through the proximal end 440A of each hold-open clip 440 between tab 446 and circular section 441. A compression spring 453 encircles pin 450 between the proximal ends 440A of hold-open clips 440, and constantly acts on the proximal ends 440A of hold-open clip constantly urging the proximal ends 440A apart holding hold-open clips 440 in their locked positions canted relative to pole 442 in FIG. 90 pinching circular sections 441 against pole 432 disabling reciprocal movement of slide 431 relative to pole 432. FIG. 92 is a section view taken along line 92-92 of FIG. 90 illustrating one hold-open clip 440 locked to pole 432 disabling reciprocal movement of slide 431 relative to pole 432. Hold-open clips 440 are canted in opposite directions in their locked positions, the upper hold-open clip 440 disabling downward movement of slide 431 along pole 432, and the lower hold-open clip 440 disabling downward movement of slide 431 along pole 432. And so on the locked positions of hold-open clips 440, circular sections 441 are pinched against pole 432 disabling reciprocal movement of slide 431 relative to pole 432.

A button 460 is mounted reciprocally to slide 431 for movement between a locked position in FIG. 90 and an unlocked position in FIG. 91. Lock assembly 430 is locked on the locked position of button 460. Lock assembly 430 is unlocked in the unlocked position of button 460. Again, slide 431 is disabled from moving reciprocally relative to pole 432, in the locked position of lock assembly 430, and slide 431 is enabled for moving reciprocally relative to pole 432, in the unlocked locked position of lock assembly 430.

Button 460, a reciprocally mounted member, extends into channel 435 to opposed outturned cams 461 on either side of the respective tabs 446. Spring 453 holds proximal ends 440A of hold-open clips 440 apart which, in turn, holds hold-open clips 440 in their canted positions in FIGS. 90 and 92 disabling reciprocal movement of slide 431 relative to pole 432, in the locked position of button 460 in FIG. 90. A spring 465 enclosed between button 460 and slide 431 encircles button 460 at an intermediate location thereof and constantly acts against slide 431 and button 460 constantly urging button outwardly into its locked position away from tabs 446. Tabs 446 are free from influence by cams 461 in the locked position of button 460 in FIG. 90, causing hold-open clips 440 to assume their canted/locked positions via spring 453 disabling reciprocal movement of slide 431 relative to pole 432. Cams 461 act on tabs 446 urging them together in FIG. 91, in which lugs 442 concurrently pivot in the respective sockets 443 and circular sections 441 pivot inwardly toward one another freeing/releasing circular sections 441 from pole 443 in FIG. 93 enabling reciprocal movement of slide 441 relative to pole 442, in response to movement of button 460 from its locked outer position to its unlocked inner position, such as by pressing button 460 by finger with a force sufficient to overcome springs 453 and 465. After reciprocating slide 441 to a selected position along the length of pole 432, lock assembly 430 can be relocked disabling reciprocal movement of slide 441 relative to pole 442. Cams 461 withdraw from tabs 446 forcing proximal ends 440A apart via spring 453, in which lugs 442 concurrently pivot in the respective sockets 443 and circular sections 441 pivot outwardly away from one another to their canted positions in FIGS. 90 and 92 engaging circular sections 441 to pole 443 disabling reciprocal movement of slide 441 relative to pole 442, all in response to movement of button 460 from its unlocked inner position in FIG. 91 back to its locked outer position in FIG. 90, by releasing the pressing force applied to button 460 holding it in its unlocked position.

The invention has been described above with reference to illustrative embodiments, and while the various embodiments are useful for stabilizing a weapon for firing as discussed in detail, they can be used for receiving and stabilizing cameras, optical equipment, or the like, as may be desired. Those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Apparatus, comprising:

first and second pole assemblies;

each of the first and second pole assemblies comprises:

a slide mounted reciprocally to a pole, the slide includes an upper extremity, a lower extremity, and a handle between the upper extremity and the lower extremity;

first and second jaws mounted reciprocally to the slide between gripping positions for gripping the pole therebetween and released positions for releasing the pole therebetween;

the slide is disabled from moving reciprocally relative to the pole, in the gripping positions of the first and second jaws;

the slide is enabled for moving reciprocally relative to the pole, in the released positions of the first and second jaws;

the first pole assembly is mounted rotatably to the second pole assembly with a joint assembly including a first joint component thereof carried by the slide of the first pole assembly mounted rotatably to a second joint component thereof carried by the slide of the second pole assembly;

the first joint component is releasable from the second joint component for releasing the slide of the first pole assembly from the slide of the second pole assembly for releasing the first pole assembly from the second pole assembly, when the first pole assembly is rotationally offset relative to the second pole assembly via the joint assembly;

the first joint component comprises a pin, the pin includes outwardly-directed lugs and an inwardly-directed notch between each pair of adjacent outwardly-directed lugs;

the second joint component comprises a socket, the socket includes inwardly-directed lugs and an outwardly-directed notch between each pair of adjacent inwardly-directed lugs;

the pin is rotated to the socket;

the outwardly-directed lugs are behind the inwardly directed lugs;

the outwardly-directed lugs relate to the outwardly-directed notches and the outwardly-directed lugs relate to the inwardly-directed notches for allowing the first joint component to be pulled apart from the second joint component for separating the first pole assembly from the second pole assembly, in the rotationally offset position of the first pole assembly relative to the second pole assembly; and the inwardly-directed lugs interfere with the outwardly-directed lugs behind the inwardly-directed lugs for preventing the first joint component from being pulled apart from the second joint component for preventing separation of the first pole assembly from the second pole assembly, other than in the rotationally offset position of the first pole assembly relative to the second pole assembly.

2. The apparatus according to claim 1, further comprising:

a joint lock for locking and unlocking the joint assembly;

the first joint component and the second joint component are disabled from rotating relative to one another for disabling rotation of the first pole assembly relative to the second pole assembly, in a locked position of the joint lock; and the first joint component and the second joint component are enabled for rotating relative to the second joint component for enabling rotation of the first pole assembly relative to the second pole assembly, in an unlocked position of the joint lock.

3. The apparatus according to claim 2, wherein the joint lock comprises:

a collar carried by the slide of one of the first and second pole assemblies, the collar encircles the joint assembly;

a cam lever assembly mounted to the slide of the other one of the first and second pole assemblies;

the cam lever assembly is released from the collar for unlocking the joint assembly, in an open position of the cam lever assembly; and the cam lever assembly is engaged to the collar for locking the joint assembly, in a closed position of the cam lever assembly.

4. The apparatus according to claim 3, wherein each of the first and second jaws reciprocates obliquely relative to the pole from the released position away from the pole and the upper extremity of the slide and the gripping position toward the pole and the upper extremity of the slide, in each of the first and second pole assemblies.

5. The apparatus according to claim 4, wherein each of the first and second jaws is mounted reciprocally to the slide with upper and lower pin-and-slot assemblies, in each of the first and second pole assemblies.

6. The apparatus according to claim 5, further comprising a first spring coupled between the first jaw and the slide constantly urging the first jaw toward the gripping position, and a second spring coupled between the second jaw and the slide constantly urging the second jaw toward to the gripping position, in each of the first and second pole assemblies.

7. The apparatus according to claim 6, wherein the first and second jaws are enclosed within the slide, in each of the first and second pole assemblies.

8. The apparatus according to claim 7, further comprising, in each of the first and second pole assemblies:

a member, extending into the slide, mounted to the slide for movement between first and second positions, an operative coupling, enclosed within the slide, between the member and the first and second jaws, whereby the first and second jaws move from the gripping positions to the released positions, in response to movement of the member from the first position to the second position with a force sufficient to overcome the first and second springs, and the first and second jaws move from the released positions to the gripping positions, in response to movement of the member from the second position to the first position via the first and second springs.

9. The apparatus according to claim 8, wherein the member is located between the upper extremity of the slide and the handle, in each of the first and second pole assemblies.

10. The apparatus according to claim 9, further comprising, in each of the first and second pole assemblies:

a slide lock mounted to the slide;

the slide is disabled from moving reciprocally relative to the pole, in a locked position of the slide lock; and the slide is enabled for moving reciprocally relative to the pole, in an unlocked position of the slide lock.

11. The apparatus according to claim 10, wherein the slide lock is formed in the lower extremity of the slide, in each of the first and second pole assemblies.

12. Apparatus, comprising:

an attachment;

a pole assembly, the pole assembly includes a slide mounted reciprocally to a pole, and the slide includes an upper extremity, a lower extremity, and a handle between the upper extremity and the lower extremity;

first and second jaws mounted reciprocally to the slide between gripping positions for gripping the pole therebetween and released positions for releasing the pole therebetween;

the slide is disabled from moving reciprocally relative to the pole, in the gripping positions of the first and second jaws;

the slide is enabled for moving reciprocally relative to the pole, in the released positions of the first and second jaws;

the attachment is mounted rotatably to the pole assembly with a joint assembly including a first joint component thereof carried by the attachment mounted rotatably to a second joint component thereof carried by the slide;

the first joint component is releasable from the second joint component for releasing the attachment from the slide for releasing the attachment from the pole assembly, when the attachment is rotationally offset relative to the pole assembly via the joint assembly;

a lock assembly coupled between the attachment and the slide;

the attachment is disabled from moving rotatably relative to the slide, when the lock assembly is in a locked position; and the attachment is enabled for moving rotatably relative to the slide, when the lock assembly is in an unlocked position.

13. The apparatus according to claim 12, wherein each of the first and second jaws is mounted reciprocally to the slide with upper and lower pin-and-slot assemblies.

14. The apparatus according to claim 13, further comprising a first spring coupled between the first jaw and the slide constantly urging the first jaw toward the gripping position, and a second spring coupled between the second jaw and the slide constantly urging the second jaw toward to the gripping position.

15. The apparatus according to claim 14, wherein the first and second jaws are enclosed within the slide.

16. The apparatus according to claim 15, further comprising:

a member, extending into the slide, mounted to the slide for movement between first and second positions, and an operative coupling, enclosed within the slide, between the member and the first and second jaws, whereby the first and second jaws move from the gripping positions to the released positions, in response to movement of the member from the first position to the second position with a force sufficient to overcome the first and second springs, and the first and second jaws move from the released positions to the gripping positions, in response to movement of the member from the second position to the first position via the first and second springs.

17. The apparatus according to claim 16, wherein the member is located between the upper extremity of the slide and the handle.

18. The apparatus according to claim 12, further comprising:

a slide lock mounted to the slide;

the slide is disabled from moving reciprocally relative to the pole, in a locked position of the slide lock; and the slide is enabled for moving reciprocally relative to the pole, in an unlocked position of the slide lock.

19. The apparatus according to claim 18, wherein the slide lock is formed in the lower extremity of the slide.

20. The apparatus according to claim 12, wherein:

the first joint component comprises a pin, the pin includes outwardly-directed lugs and an inwardly-directed notch between each pair of adjacent outwardly-directed lugs;

the second joint component comprises a socket, the socket includes inwardly-directed lugs and an outwardly-directed notch between each pair of adjacent inwardly-directed lugs;

the pin is rotated to the socket;

the outwardly-directed lugs are behind the inwardly directed lugs;

the outwardly-directed lugs relate to the outwardly-directed notches and the outwardly-directed lugs relate to the inwardly-directed notches for allowing the first joint component to be pulled apart from the second joint component for separating the first pole assembly from the second pole assembly, in the rotationally offset position of the first pole assembly relative to the second pole assembly; and the inwardly-directed lugs interfere with the outwardly-directed lugs behind the inwardly-directed lugs for preventing the first joint component from being pulled apart from the second joint component for preventing separation of the first pole assembly from the second pole assembly, other than in the rotationally offset position of the first pole assembly relative to the second pole assembly.

* * * * *